US009802778B2

(12) United States Patent
Isobe et al.

(10) Patent No.: US 9,802,778 B2
(45) Date of Patent: Oct. 31, 2017

(54) IMAGE FORMING APPARATUS FOR FORMING IMAGE ON SHEET

(71) Applicant: CANON KABUSHIKI KAISHA, Tokyo (JP)

(72) Inventors: Ken-ichiro Isobe, Yokohama (JP); Michio Sugano, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/184,026

(22) Filed: Jun. 16, 2016

(65) Prior Publication Data

US 2016/0378043 A1 Dec. 29, 2016

(30) Foreign Application Priority Data

Jun. 26, 2015 (JP) ..... 2015-129204
Jun. 26, 2015 (JP) ..... 2015-129205

(51) Int. Cl.
*B65H 7/18* (2006.01)
*B65H 7/20* (2006.01)
*G03G 15/00* (2006.01)

(52) U.S. Cl.
CPC ..... *B65H 7/18* (2013.01); *B65H 7/20* (2013.01); *G03G 15/652* (2013.01); *B65H 2511/152* (2013.01); *B65H 2511/30* (2013.01); *B65H 2511/528* (2013.01); *B65H 2513/53* (2013.01); *B65H 2601/271* (2013.01); *G03G 2215/00383* (2013.01); *G03G 2215/00392* (2013.01); *G03G 2215/0132* (2013.01)

(58) Field of Classification Search
CPC ..... B65H 7/18; B65H 7/20; B65H 2511/152; B65H 2511/30; B65H 2511/528; B65H 2513/53; B65H 2601/271
See application file for complete search history.

(56) References Cited

U.S. PATENT DOCUMENTS

| | | | | |
|---|---|---|---|---|
| 6,527,267 | B1 | 3/2003 | Kuwata et al. | |
| 6,643,480 | B2 | 11/2003 | Kuwata et al. | |
| 6,912,044 | B2 | 6/2005 | Sekiyama et al. | |
| 6,973,285 | B2 | 12/2005 | Sekiyama et al. | |
| 7,735,822 | B2 * | 6/2010 | Aruga | B65H 1/26 271/145 |
| 9,024,984 | B2 * | 5/2015 | Akatsuka | B41J 11/0095 271/147 |
| 9,193,548 | B2 * | 11/2015 | Kobayashi | B65H 3/0684 |

FOREIGN PATENT DOCUMENTS

| | | | |
|---|---|---|---|
| JP | 05-278896 | A | 10/1993 |
| JP | 06-092486 | A | 4/1994 |
| JP | 06-199428 | A | 7/1994 |
| JP | 2005-231887 | A | 9/2005 |
| JP | 2005-350193 | A | 12/2005 |
| JP | 2006-133310 | A | 5/2006 |
| JP | 2015-105175 | A | 6/2015 |

* cited by examiner

*Primary Examiner* — Jeremy R Severson

(74) *Attorney, Agent, or Firm* — Fitzpatrick, Cella, Harper & Scinto

(57) ABSTRACT

An image forming apparatus may comprise the following elements. A stacking unit in which a sheet is stacked. A conveyance unit conveys the sheet. A time-counting unit counts a conveyance time from when the conveyance unit starts to convey the sheet until the sheet arrives at a predetermined position on a conveyance path. A determination unit determines that over stacking has occurred, if the conveyance time of the sheet exceeds a first over stacking threshold value.

40 Claims, 38 Drawing Sheets

IMAGE FORMING APPARATUS FOR FORMING IMAGE ON SHEET

BACKGROUND OF THE INVENTION

Field of the Invention

The present invention relates to an image forming apparatus for forming an image on a sheet.

Description of the Related Art

An image forming apparatus has a stacking unit for stacking sheets. As the stacking unit, a feed cassette and a manual bypass tray provided within the image forming apparatus are used. If the number of sheets that exceeds the number expected in design is stacked in these stacking units, a feeding failure may occur. Japanese Patent Laid-Open No. 05-278896 proposes an image forming apparatus that detects over stacking by measuring the height of a sheet bundle stacked in a cassette, using a sensor.

However, if the height of a bundle of envelope type sheets is detected using a sensor, over stacking is erroneously detected in some cases. Since air is likely to accumulate in an envelope type sheet, the envelope type sheet can be easily pressed down. A feed cassette is provided with a locking claw for regulating the number of stacked sheets, but a large number of envelope type sheets are forcibly over-stacked by pressing down the large number of envelope type sheets in some cases. Thus, since the height of the sheet bundle is visually low, over stacking of the sheets cannot be accurately detected even with the sensor for detecting the height of the sheet bundle.

SUMMARY OF THE INVENTION

The present invention detects over stacking of sheets more accurately than with conventional techniques. The present invention provides an image forming apparatus comprising the following elements. A stacking unit in which a sheet is stacked. A conveyance unit is configured to convey the sheet. A time-counting unit is configured to count a conveyance time from when the conveyance unit starts to convey the sheet until the sheet arrives at a predetermined position on a conveyance path. A determination unit is configured to determine that over stacking has occurred, on the conveyance time of the sheet exceeding a first over stacking threshold value.

Further features of the present invention will become apparent from the following description of exemplary embodiments with reference to the attached drawings.

BRIEF DESCRIPTION OF THE DRAWINGS

FIGS. 36A to 36D are diagrams illustrating double feeding of over-stacked sheets.

DESCRIPTION OF THE EMBODIMENTS

Embodiment 1

[Configuration of Image Forming Apparatus]

Figure 1:
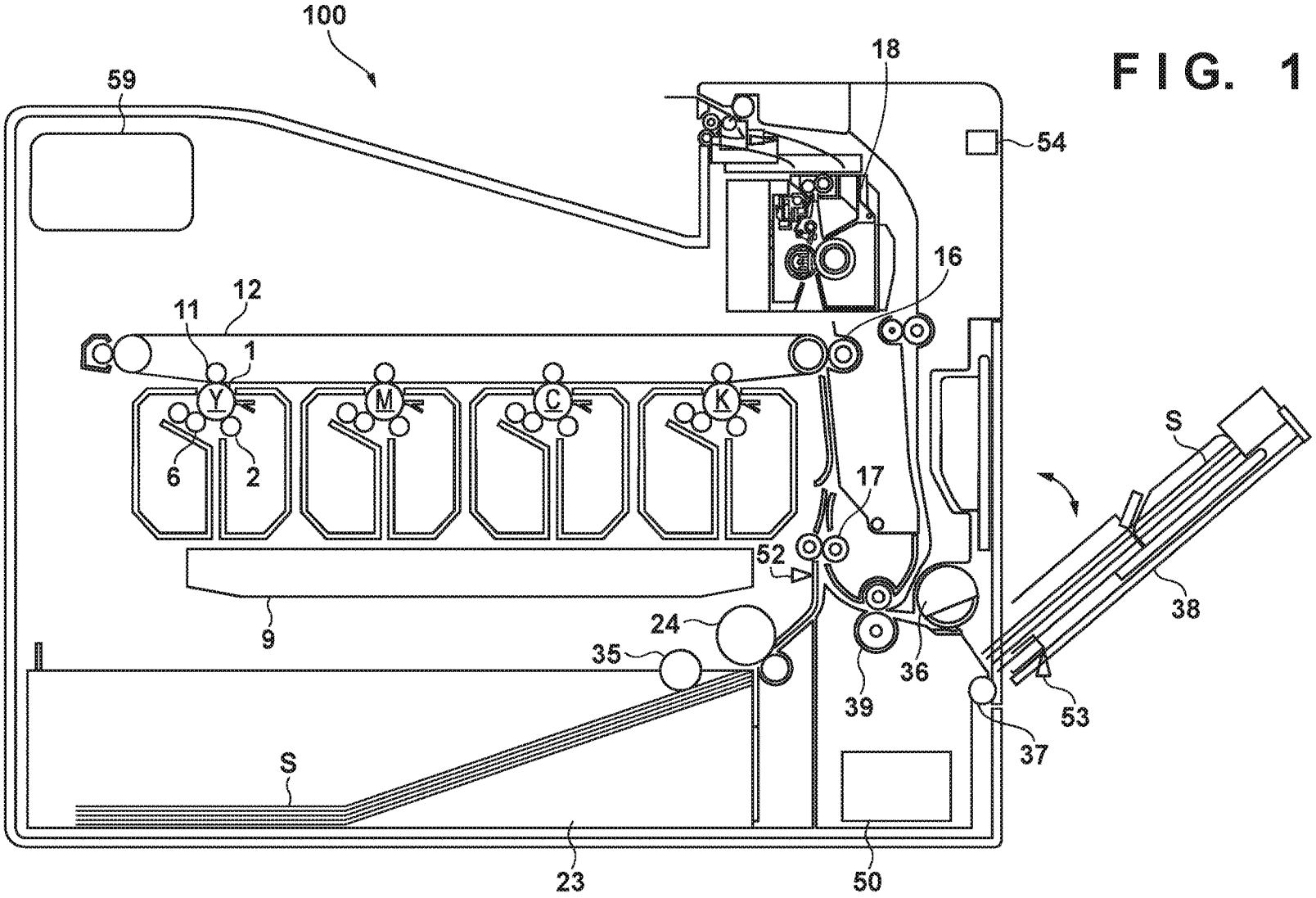
FIG. 1 is a schematic cross-sectional view of an image forming apparatus.

An image forming apparatus 100 will be described using FIG. 1. Although the image forming apparatus 100 according to this embodiment is an electrophotographic printer, an image forming apparatus to which the present invention is applicable may employ other image forming methods, such as an inkjet method and a thermal transfer method. The image forming apparatus 100 has four image forming units (stations), and forms toner images of yellow (Y), magenta (M), cyan (C), and black (K). In FIG. 1, referenced signs Y, M, C, and K, which are associated with the respective colors, are assigned to the four image forming units. A photosensitive drum 1 is a photosensitive member and an image carrier, and rotates clockwise at a predetermined circumferential speed (process speed). A charging roller 2 uniformly charges the surface of the photosensitive drum 1. An optical scanning device 9 outputs a light beam in accordance with an image signal. The surface of the photosensitive drum 1 is irradiated with a light beam, and an electrostatic latent image is formed. Toner is attached to a development roller 6 to develop an electrostatic latent image, and a toner image is formed. YMCK toner images are transferred to an intermediate transfer belt 12 in an overlapping manner by a primary transfer roller 11, and a multi-color image is obtained.

A feed cassette 23 is an exemplary stacking unit in which sheets are stacked. Sheets S contained in the feed cassette 23 are picked up by a pickup roller 35, and are sent out to a conveyance path by a feed roller 24. The pickup roller 35 and the feed roller 24 are each an exemplary conveyance unit for conveying a sheet. Skew correction is executed when a leading end of a sheet S abuts against a registration roller 17. The sheet S is conveyed to a secondary transfer unit by the registration roller 17. The toner image conveyed by the intermediate transfer belt 12 is subjected to secondary transfer onto the sheet by a secondary transfer roller 16. A fixing device 18 fixes the toner image to the sheet S and discharges the sheet S to the outside of the image forming apparatus 100.

A manual bypass tray 38 is an exemplary stacking unit in which sheets are stacked. The manual bypass tray 38 pivots around a fulcrum 37, thereby being switched between a housed state of being housed in the image forming apparatus 100 and a usage state where the sheets S can be stacked therein. The sheets S stacked in the manual bypass tray 38 are picked up by a paper feed roller 36, sent out to the conveyance path by a conveyance roller 39, and moved toward the registration roller 17. The paper feed roller 36 and the conveyance roller 39 are each an exemplary conveyance unit for conveying a sheet.

A controller 50 is a control unit for comprehensively controlling the overall image forming apparatus 100. An operation unit 59 has a display device and an input device. The controller 50 detects whether or not the sheets S are stacked in the manual bypass tray 38 using a sheet sensor 53. Furthermore, the controller 50 determines whether or not a conveyance delay or a jam has occurred using a sheet sensor 52. A sheet sensor for detecting whether or not the sheets S are stacked may also be provided in the feed cassette 23. The sheet sensor 53 may be called a tray sensor, and the sheet sensor 52 may be called a registration sensor. The sheet sensor 53 is for detecting the presence of the sheets S, whereas the sheet sensor 52 is used for detecting a leading end and a trailing end of each sheet S and detecting the conveyance time of each sheet S.

[Functions of Controller]

Figure 2:
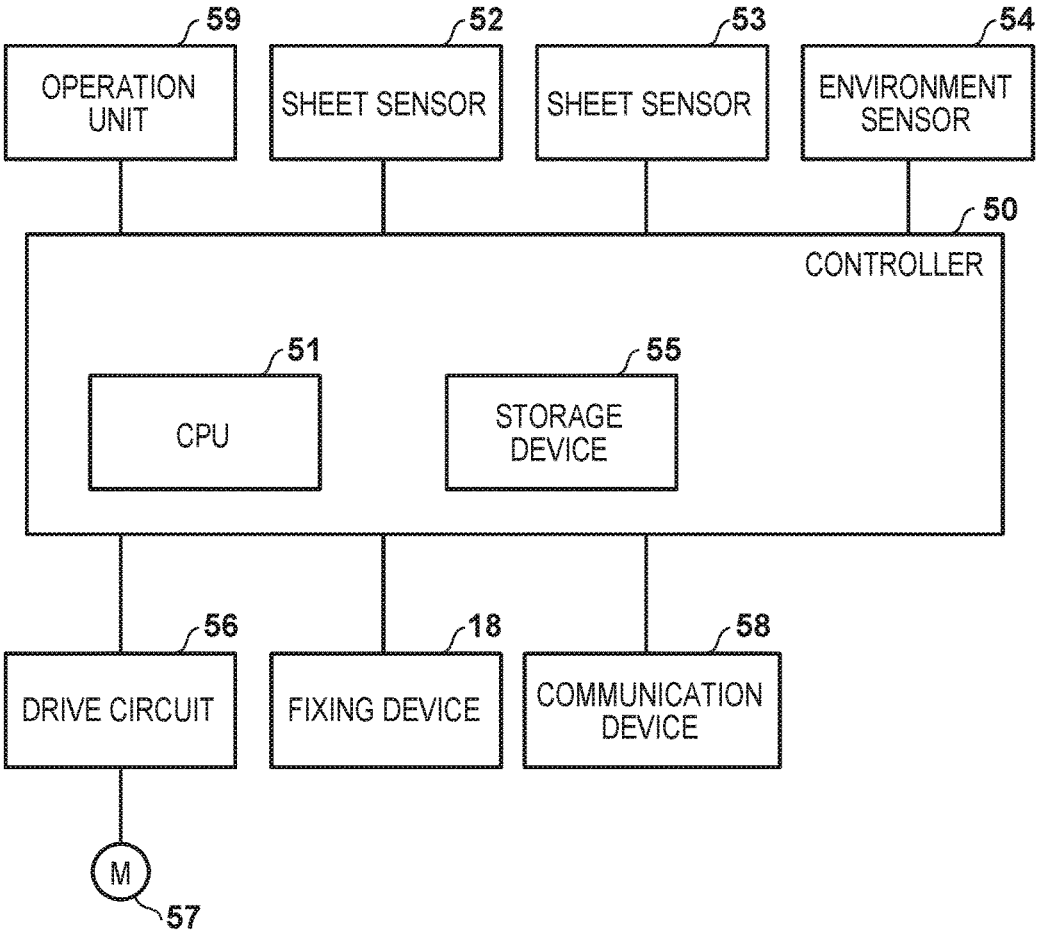
FIG. 2 is a diagram showing a control system.

Functions of the controller 50 will be described using FIG. 2. The overall image forming apparatus 100 is comprehensively controlled by executing control programs stored in a CPU 51 or a storage device 55. The storage device 55 has a memory such as a ROM or a RAM. The controller 50 sets image forming conditions in accordance with an image formation mode designated through an operation unit 59. The image forming conditions are, for example, the conveyance speed of sheets S, the fixing temperature of the fixing device 18, and the like. For example, the image formation modes may include a plain paper mode for forming an image on plain paper, a cardboard mode for forming an image on cardboard, an envelope mode for forming characters on an envelope, and the like. The controller 50 stores the image forming conditions for the respective image formation modes in the storage device 55, and reads out the image forming conditions corresponding to the designated image formation mode.

The CPU 51 detects whether or not sheets S are stacked in the manual bypass tray 38 using the sheet sensor 53. Furthermore, the CPU 51 determines whether or not a conveyance delay or a jam has occurred using the sheet sensor 52. If a sheet S has caused a conveyance delay or a jam on the conveyance path, the CPU 51 causes a message indicating the occurrence of the conveyance delay or the jam to be displayed on the operation unit 59. If over stacking of sheets S in the feed cassette 23 or the manual bypass tray 38 is detected, the CPU 51 causes a message indicating the occurrence of the over stacking to be displayed on the operation unit 59. A conveyance delay is a phenomenon in which the conveyance time of a sheet S becomes too long to be able to ensure the accuracy of an image forming position or the like, and may also be called a conveyance error or a failure in conveyance. A jam refers to, in the narrow sense, a phenomenon in which a sheet S is stuck and jammed on the conveyance path. A phenomenon in which sheets S cannot be fed from the manual bypass tray 38 due to over stacking is also a kind of a jam. Thus, over stacking may cause the case where a sheet S has successfully been fed from the manual bypass tray 38 but the conveyance time is too long, or the case where the feeding fails.

The CPU 51 uses an environment sensor 54 to acquire environmental parameters such as the absolute moisture amount, environmental temperature, and environmental humidity of the environment where the image forming apparatus 100 is installed. Image forming conditions for respective combinations of the image formation modes and the environmental parameters are stored in the storage device 55 in the controller 50. The controller 50 reads out, from the storage device 55, the image forming conditions corresponding to a combination of the designated image formation mode and the environmental parameters acquired from environment sensor 54.

The CPU 51 outputs a feed start signal to a drive circuit 56 for driving a motor 57. The drive circuit 56, upon receiving the feed start signal, starts to drive the motor 57. The CPU 51 sets the conveyance speed in advance corresponding to the image formation mode in the drive circuit 56. The motor 57 rotates at a rotation speed corresponding to the set conveyance speed. The CPU 51 may control a solenoid or the like for driving a pickup roller 35.

Figure 3:
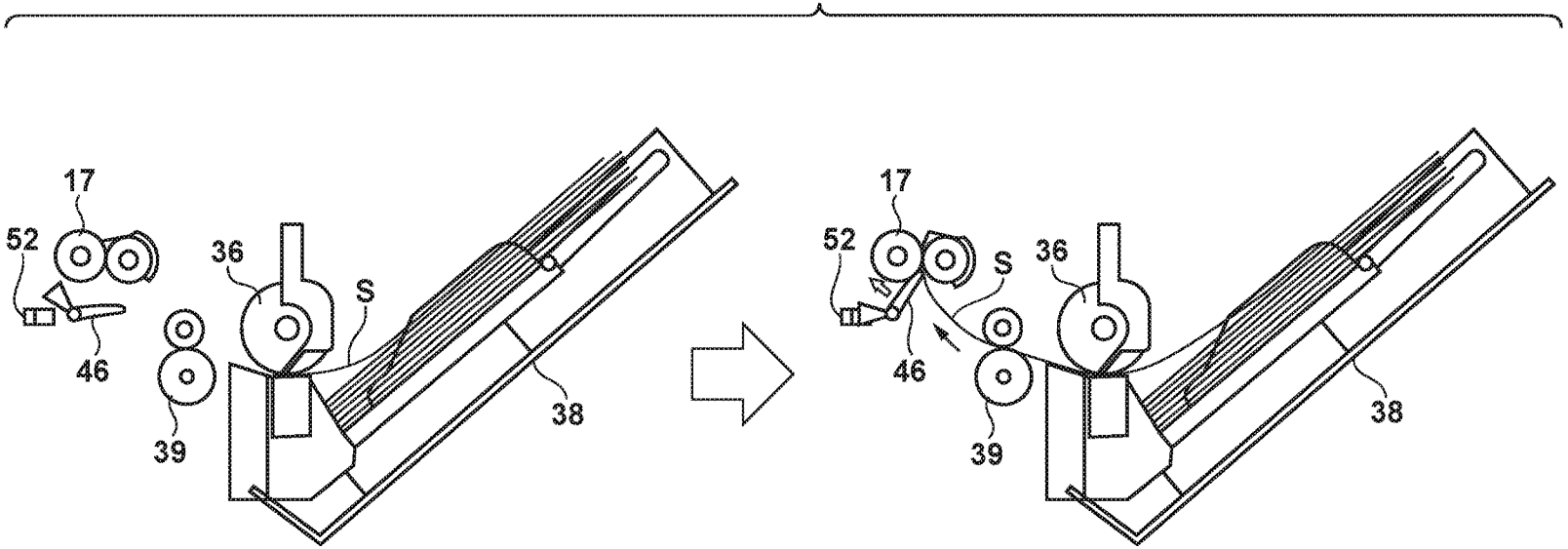
FIG. 3 is a diagram showing feeding of a sheet from a manual bypass tray.

As shown in FIG. 3, when the leading end of the sheet S pulls down a flag 46 provided near the registration roller 17, the sheet sensor 52 outputs a detection signal indicating that the leading end of the sheet S has been detected to the controller 50. The flag 46 may be called as a flapper. The CPU 51 counts, using a timer or a counter, the conveyance time from the timing at which conveyance of a sheet S is started until the timing at which the sheet sensor 52 detects the leading end of the sheet S.

Figure 4:
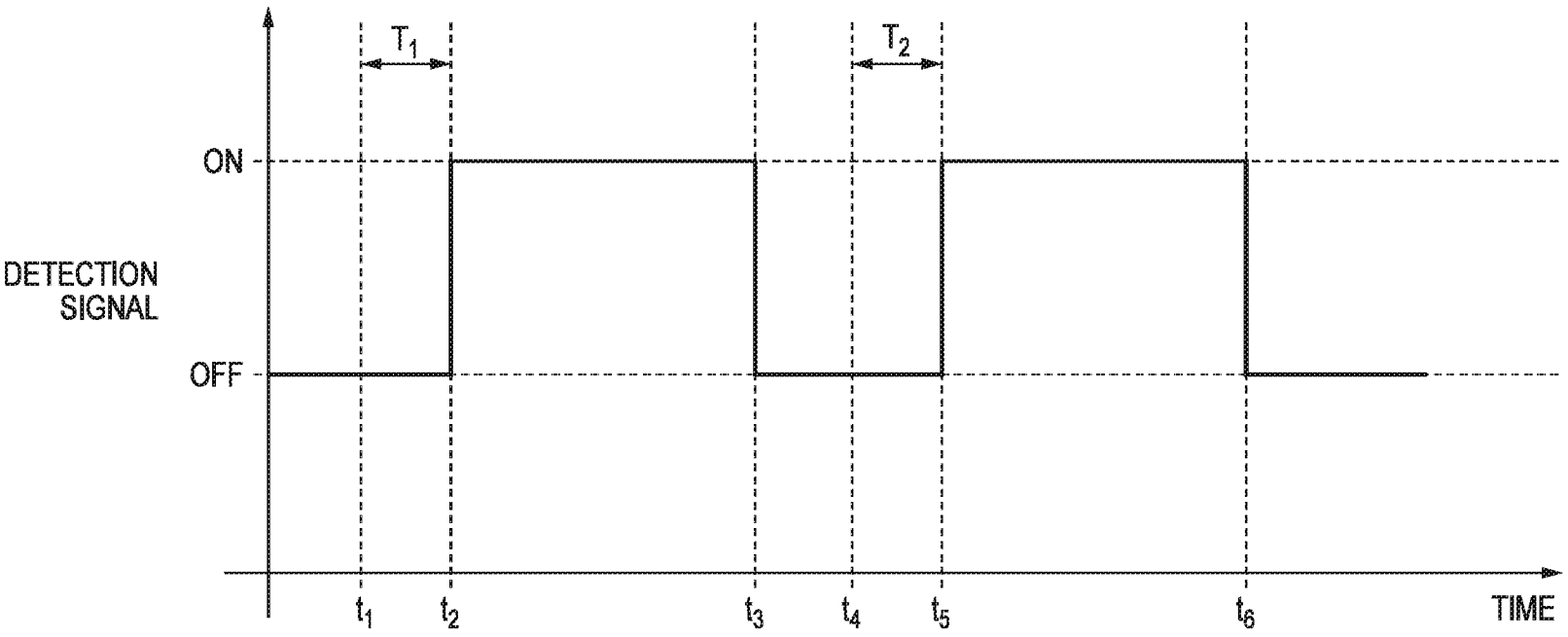
FIG. 4 is a diagram showing a relationship between a detection signal that is output from a sheet sensor and conveyance time.

FIG. 4 is a diagram showing an exemplary detection signal of the sheet sensor 52. The horizontal axis indicates the time, and the vertical axis indicates the level of the detection signal. At time t1, conveyance of a first sheet S is started. At time t2, the leading end of the sheet S arrives at the sheet sensor 52, and the detection signal changes from OFF to ON. The CPU 51 determines the period from the time t1 to the time t2 to be conveyance time T1 of the first sheet S. At time t3, the trailing end of the first sheet S passes the sheet sensor 52, and the level of the detection signal is switched from ON to OFF. At time t4, conveyance of a second sheet S is started. At time t5, the leading end of the second sheet S arrives at the sheet sensor 52, and the detection signal changes from OFF to ON. The CPU 51 determines the period from the time t4 to the time t5 to be a conveyance time T2 of the second sheet S. At time t6, the trailing end of the second sheet S passes the sheet sensor 52, and the level of the detection signal is switched from ON to OFF.

Figure 5A:
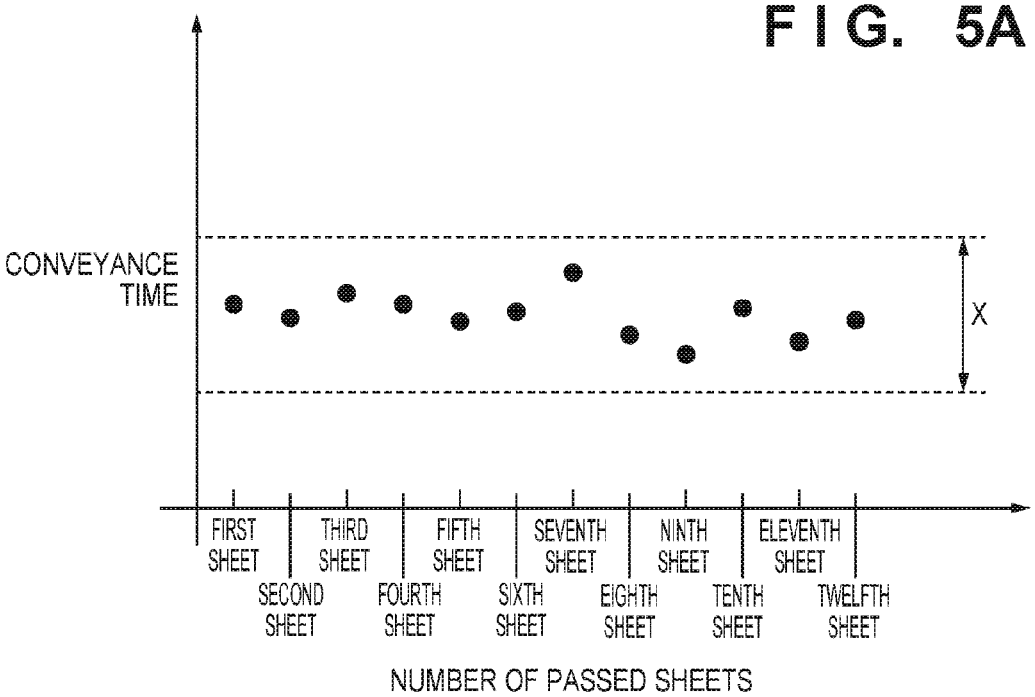
FIGS. 5A and 5B are diagrams showing an example of conveyance time and a conveyance delay regarding a sheet bundle that is not in an over-stacked state.

FIG. 5A shows exemplary conveyance time at the time when a plurality of sheets S are continuously fed. The conveyance time T may vary more or less depending on a friction state of the pickup roller 35 and the paper feed roller 36, and the type of the sheets S (thickness, basis weight, envelope type or not, presence of surface coating etc.). However, if the plurality of sheets S are correctly stacked in the manual bypass tray 38, and a jam does not occur, the conveyance time of each sheet S stays within a tolerance X.

Figure 5B:
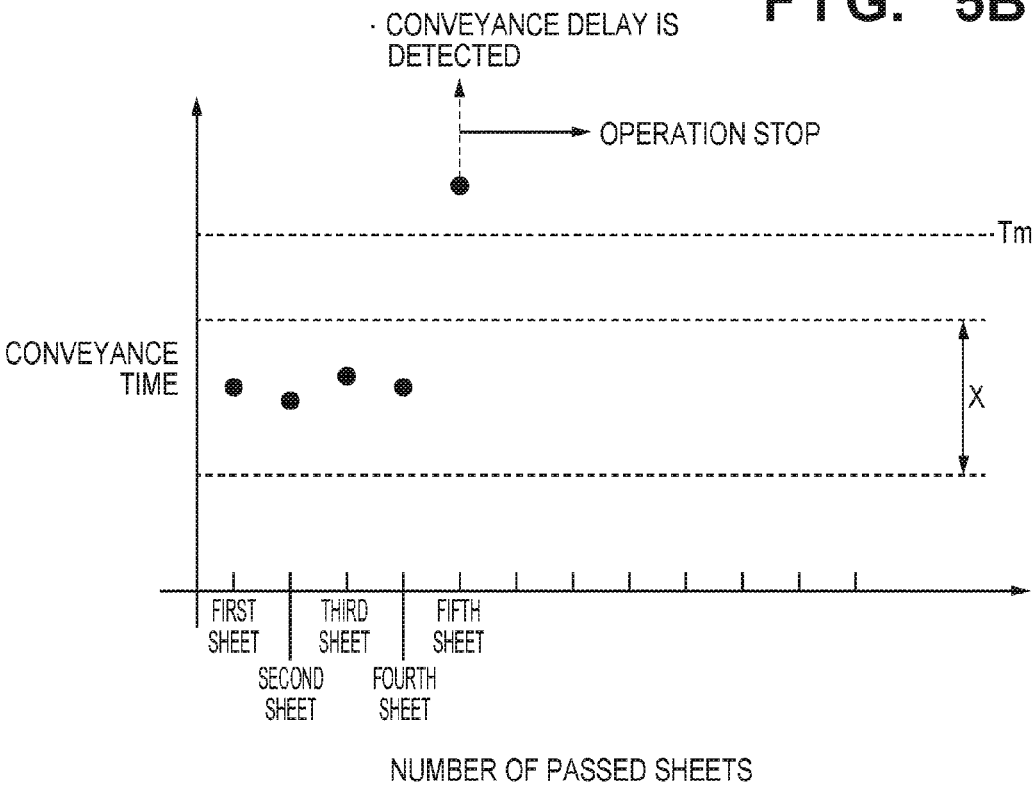

FIG. 5B shows an exemplary conveyance time at the time when a plurality of sheets S are continuously fed. In particular, a conveyance delay (conveyance error) has occurred on the fifth sheet S. As shown in FIG. 5B, there are cases where a conveyance delay occurs on the second and subsequent sheets S after a job has started. The CPU 51 monitors the conveyance time T of each sheet S, and determines whether or not the conveyance time T exceeds a threshold value Tm. If the conveyance time T exceeds the threshold value Tm, the CPU 51 determines that a conveyance delay has occurred, discharges all sheets S that remain on the conveyance path, and stops the motor 57. The threshold value Tm for determining a conveyance delay is set to a value that deviates from the tolerance X and is larger than the upper limit value of the tolerance X. If the conveyance time exceeds the threshold value Tm, the accuracy of image formation on the sheets S is not ensured, and accordingly, the CPU 51 stops image formation.

The CPU 51 may preferentially feed the first sheet, and cause the first sheet S to wait at the registration roller 17 until the image forming unit is ready. In this case, the CPU 51 may not determine that a conveyance delay has occurred regarding the first sheet S, even if the conveyance time T exceeds the threshold value Tm. The period from when a job has started started until the image forming unit is ready is longer than a normal conveyance time T. Therefore, conveyance delay of the first sheet S is largely permissible. Thus, in this embodiment, the conveyance delay determination is applied to the second and subsequent sheets S.

However, there are cases where the first sheet S does not arrive at the flag 46 even though the conveyance time T when the first feeding operation for the first sheet S was performed, greatly exceeds the threshold value Tm. That is to say, there are cases where, even if the count value of the timer of the CPU 51 exceeds a retry threshold value Tr, the sheet sensor 52 cannot detect the leading end of the sheet S (the threshold value Tm may be employed as the retry threshold value Tr). In this case, the CPU 51 instructs the drive circuit 56 to perform a second feeding operation (retry). Note that the CPU 51 may continue, also during the retry, counting the conveyance time T starting from the first feeding operation. If the first sheet S does not arrive at the flag 46 even after the conveyance time T has exceeded a jam threshold value Tj, the CPU 51 determines that a jam has occurred. If the CPU 51 detects a jam, the CPU 51 causes a message indicating the occurrence of the jam to be displayed on the operation unit 59, and transmits this message to an email address of a maintenance person via the communication device 58. The message may be delivered in the form of an email, for example.

[Configuration of Manual Bypass Tray]

Figure 6:
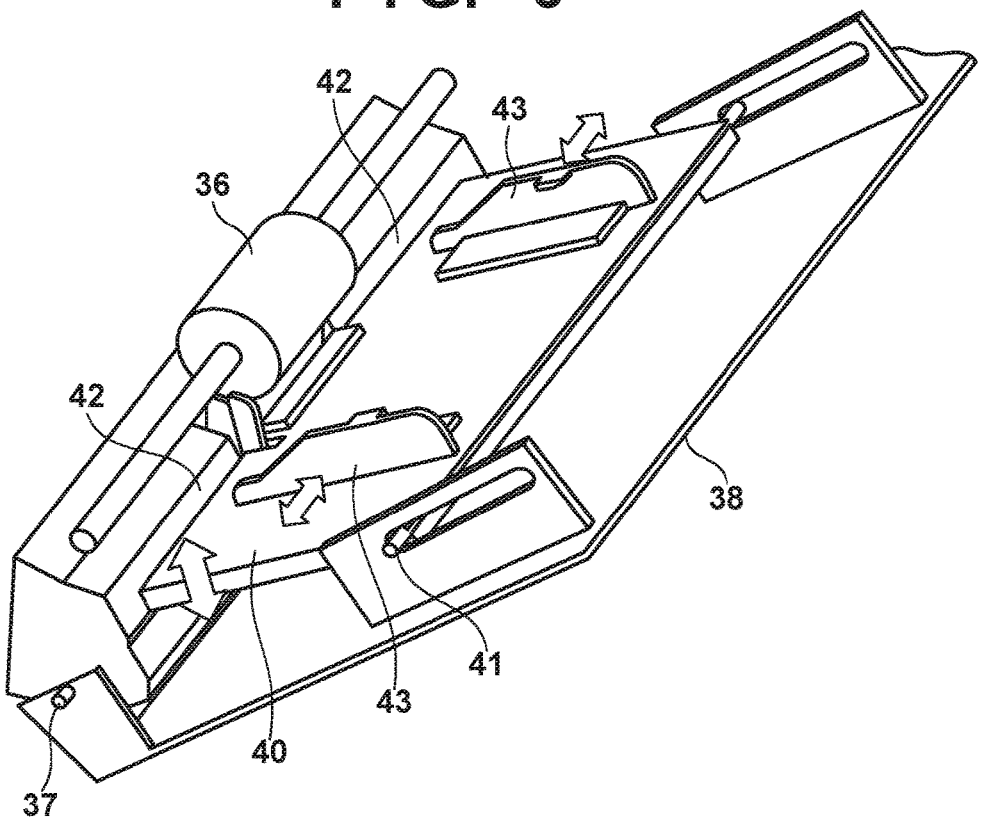
FIG. 6 is a perspective view of a manual bypass tray.

A configuration of the manual bypass tray 38 will be described in detail with reference to FIGS. 6 to 8. As already shown in FIG. 1, the manual bypass tray 38 is arranged in a side surface of a housing of the image forming apparatus 100. In an unused state, the manual bypass tray 38 is housed within the housing of the image forming apparatus 100. When in use, the manual bypass tray 38 is opened pivoting around the fulcrum 37. The manual bypass tray 38 stops pivoting upon forming a certain angle relative to the housing side surface. As shown in FIG. 6, the manual bypass tray 38 has two side regulating plates 43 and a tray unit 40. The two side regulating plates 43 can move on the tray unit 40 in a direction perpendicular to the conveyance direction, and causes both ends (left end and right end) of a sheet bundle in the direction perpendicular to the conveyance direction to be aligned. The tray unit 40 pivots around a fulcrum 41. The tray unit 40 is biased in a direction approaching the paper feed roller 36 by a biasing mechanism (not shown). The leading ends of sheets S are regulated as a result of the sheets S falling down due to gravity and abutting against an abutting wall 42.

Figure 7A:
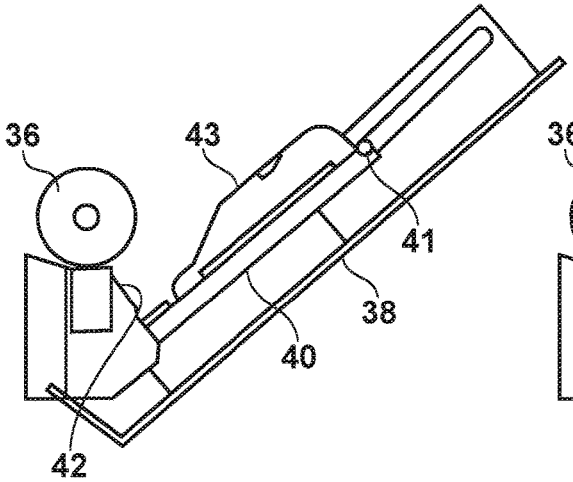
FIGS. 7A and 7B are cross-sectional views of the manual bypass tray.

As shown in FIG. 7A, the tray unit 40 is pushed down in a direction of moving away from the paper feed roller 36, against the biasing mechanism by a tray control mechanism (not shown) when paper is not passed through. Thus, the sheets S stacked in the tray unit 40 move to a position where they are not in contact with the paper feed roller 36.

Figure 7B:
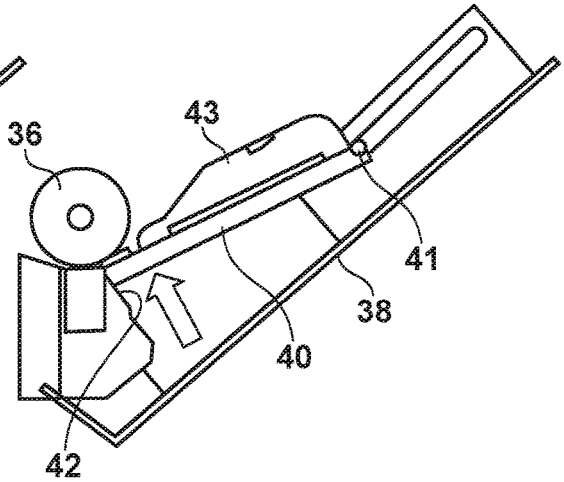

As shown in FIG. 7B, when paper passes through, the tray unit 40 is lifted up by the biasing mechanism as the tray control mechanism retracts. Thus, the uppermost sheet S stacked in the tray unit 40 comes into contact with the paper feed roller 36. Note that when a plurality of sheets S are continuously passed through, lifting up and lowering of the tray unit 40 is repeated every time one sheet S passes through. The bundle of sheets S slides down in a downward direction under its own weight due to vibration caused by lifting up and lowering of the tray unit 40, and the sheets S readily abut against the abutting wall 42. The tray control mechanism may be driven by a driving source (motor, solenoid, etc.) controlled by the CPU 51.

Figure 8:
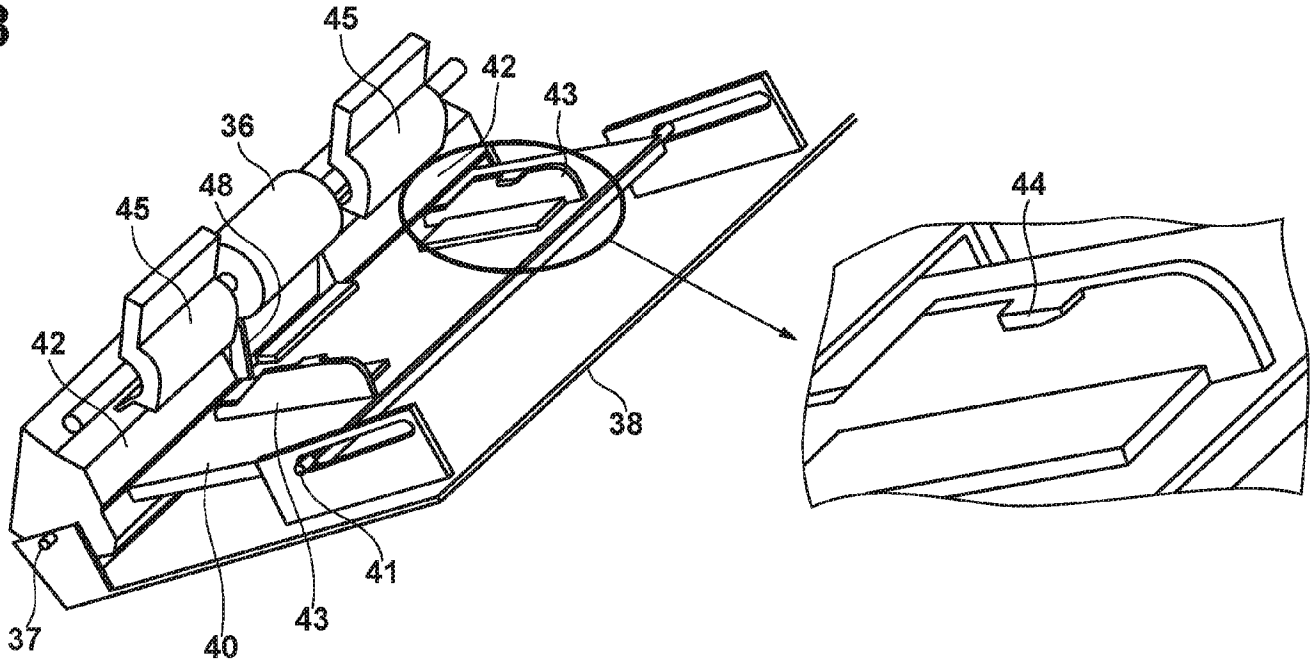
FIG. 8 is a perspective view showing a side regulating plate, a guiding member, and a locking claw.

As shown in FIG. 8, the manual bypass tray 38 may have guiding members 45 and locking claws 44. The guiding members 45 are provided near the paper feed roller 36. The sheets S placed on the tray unit 40 slide down toward the abutting wall 42. At this time, the guiding members 45 guide the sheets S such that the leading end of the sheets S can readily go under the paper feed roller 36 without resting on the paper feed roller 36. Furthermore, the guiding members 45 guide the sheets S such that the leading ends of the fed sheets S do not rise and get caught on the paper feed roller 36.

The flag 48 of the sheet sensor 53 is installed upstream to the abutting wall 42 in the conveyance direction. Upon a sheet S being stacked in the tray unit 40, the leading end of the sheet S pushes the flag 48 before abutting against the abutting wall 42. Thus, the sheet sensor 53 detects that the sheet S is stacked on the tray unit 40, and outputs a detection signal to the CPU 51. When a sheet S is not stacked in the tray unit 40, the flag 48 is restored to its initial position, and therefore, the sheet sensor 53 does not detect a sheet S. Upon the level of the detection signal from the sheet sensor 53 changing from a high level to a low level, the CPU 51 determines that the sheet S is not stacked in the tray unit 40.

The locking claws 44 are provided respectively in the two side regulating plates 43. The locking claws 44 regulate the sheets S so as not to ride up onto the side regulating plates 43. Thus, shifting of the sheet S in the direction perpendicular to the conveyance direction is suppressed. If sheets S are over-stacked, the bundle of the sheets S comes into contact with the locking claws 44. Conveyance resistance of the sheets S increases due to the friction force exerted between the sheets S and the locking claws 44, and a conveyance delay of the sheets S may occur. Whether or not the uppermost sheet S of the bundle of stacked sheets S comes into contact with the locking claws 44 is a guide for the amount of stacked sheets that ensures correct conveyance operation.

[Over Stacking of Envelopes]

Here, envelopes are employed as exemplary envelope type sheets. Here, a state where the envelopes are over-stacked in the manual bypass tray 38 will be described in detail.

Case where a Bundle of Envelopes is Stacked Under Locking Claws 44

Figure 9:
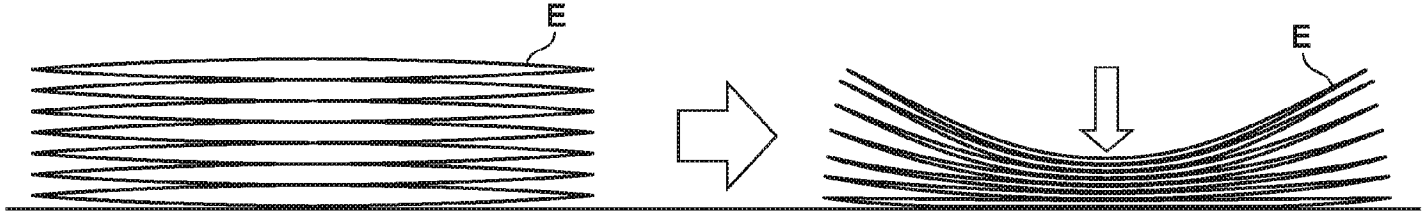
FIG. 9 is a diagram showing a bundle of envelopes.

As shown in FIG. 9, the envelopes E have a bag-like shape. That is to say, each of the envelopes E has a layer of air. When a plurality of envelopes E are stacked, a bundle of envelopes E with elastic force that can be easily pressed down is formed.

Figure 10A:
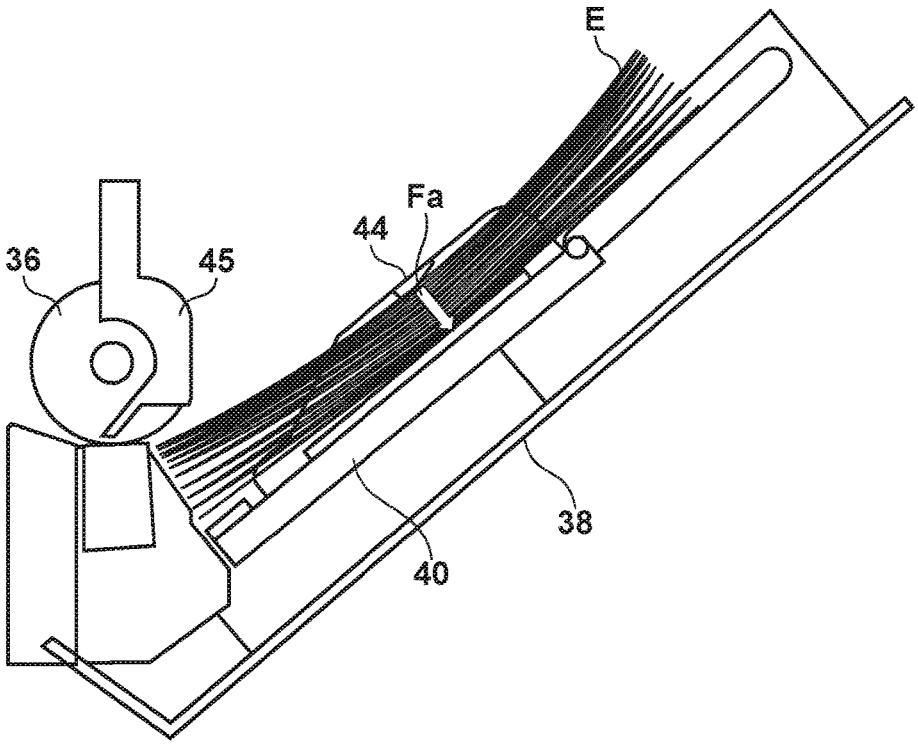
FIGS. 10A and 10B are diagrams illustrating resistance that occurs due to over stacking.

As shown in FIG. 10A, since the bundle of envelopes E can be easily pressed down, even a bundle of the envelopes E whose number exceeds the upper limit number can be inserted under the locking claws 44. However, the resistance force Fa generated by pressing down the bundle is exerted onto the bundle of the envelopes E from the locking claws 44. The bundle enters a state of being strongly held down by the locking claws 44, and a friction force between the envelopes E and the locking claws 44 increases.

Case where Envelopes are Stacked on Locking Claws 44

Figure 10B:
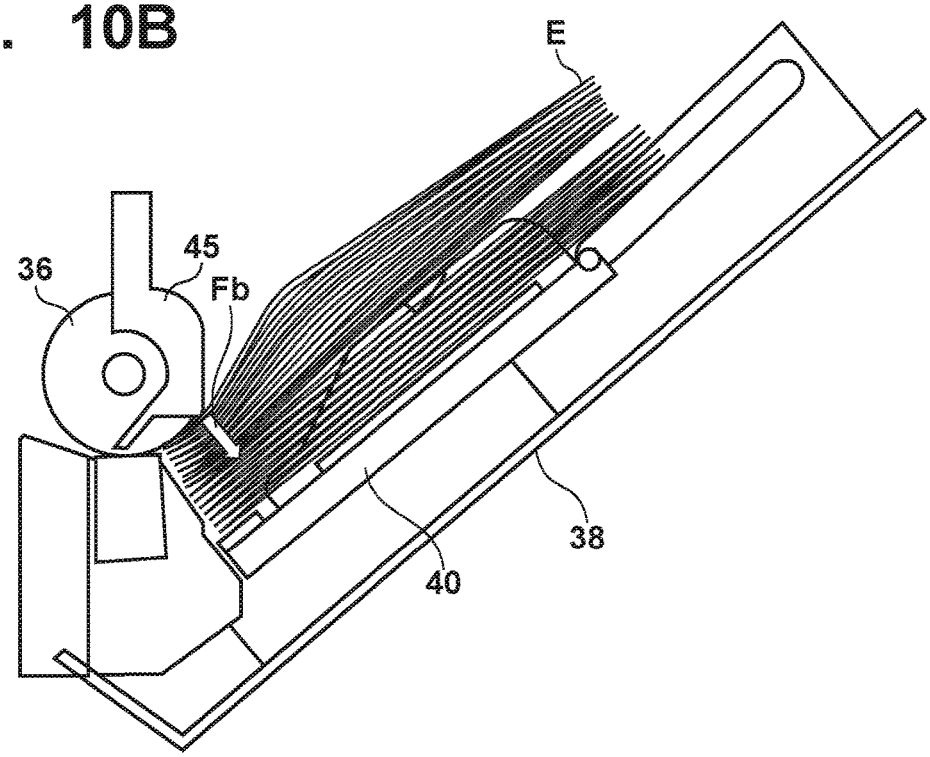

As shown in FIG. 10B, if a bundle of envelopes E whose number is much larger than the upper limit number is stacked on the tray unit 40, a part of the bundle is stacked so as to ride up onto the locking claws 44. This part of the bundle comes into contact with the guiding member 45. Since the bundle of envelopes E can be easily pressed down, the bundle can also be pushed in under the guiding members 45. However, the resistance force Fb generated by pressing down the bundle of envelopes E is exerted onto the bundle from the guiding members 45. The bundle enters a state of being strongly held down by the guiding member 45, and a friction force is generated between the envelopes E and the guiding members 45.

[Feeding of Envelopes in Over-Stacked State]

Next, the behavior of the conveyance mechanism when the envelopes E are over-stacked will be described in detail.

Over-Stacked State of Envelopes by Certain Number of Envelopes of Less

Figure 11:
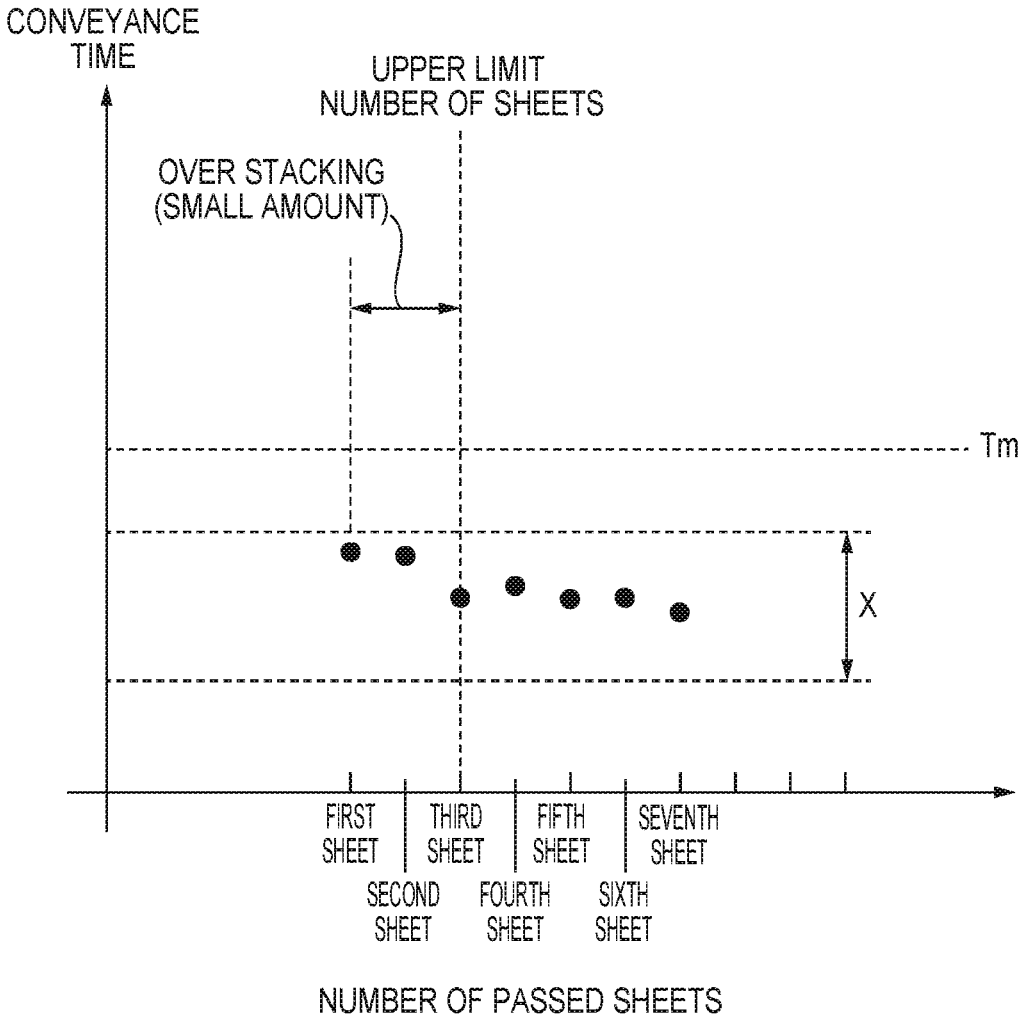
FIG. 11 is a diagram showing conveyance time in the case where the degree of over stacking is small.

In the case where the envelopes E are over-stacked and the number of envelopes E is only slightly larger than the upper limit number determined in the design of the image forming apparatus 100, the resistance force Fa generated by the locking claws 44 and the resistance force Fb generated by the guiding members 45 is small. FIG. 11 shows a relationship between the number of envelopes to be passed through and the conveyance time at the time when the number of stacked envelopes E is larger than the upper limit number by two. Although a first envelope E and a second envelope E correspond to over-stacked envelopes E, the respective conveyance times of those envelopes are within the tolerance X. Accordingly, no conveyance delay occurs.

Over-Stacked State of Envelopes by Certain Number of Envelopes or More

Figure 12:
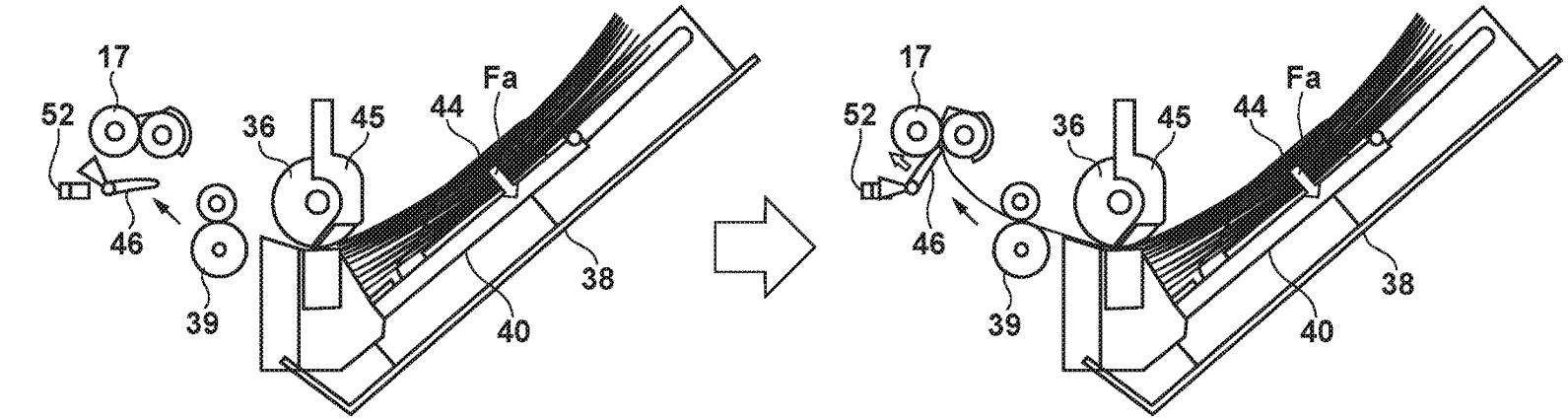
FIG. 12 is a diagram showing feeding of over-stacked envelopes.
Figure 13A:
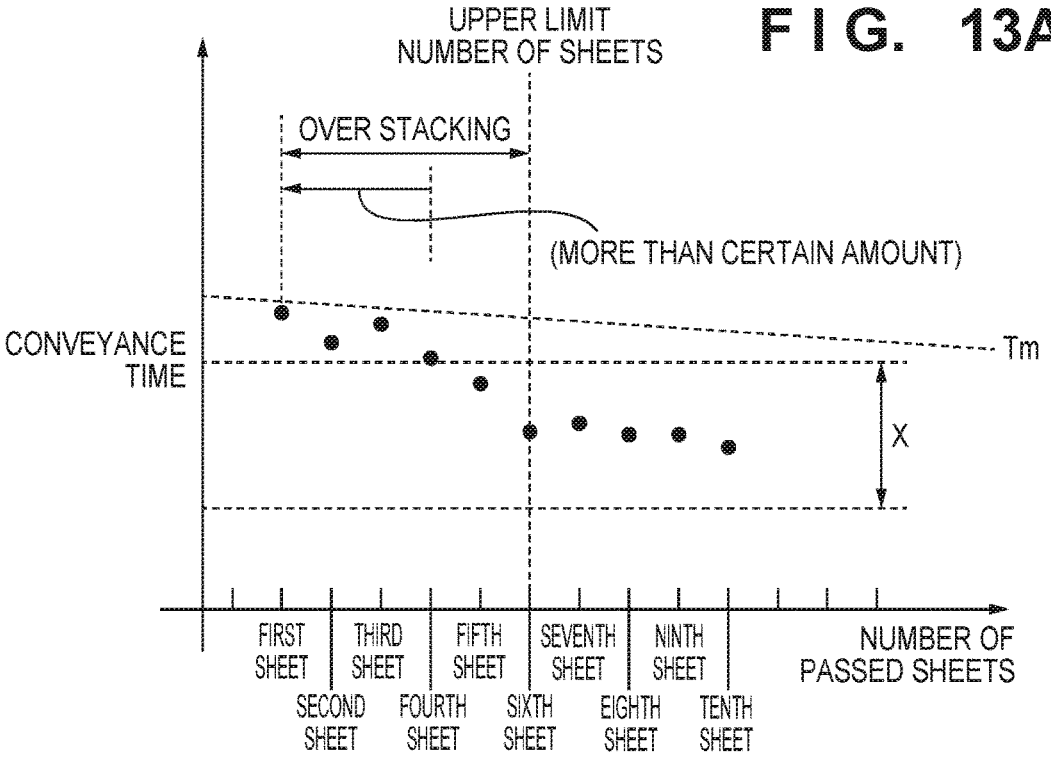
FIGS. 13A and 13B are diagrams showing a relationship between conveyance time and a threshold value for a conveyance delay.

If the number of over-stacked envelopes E is larger than or equal to the upper limit number by a certain number, the resistance force Fa and the resistance force Fb increase. As shown in FIG. 12, if the envelopes E are over-stacked under the locking claws 44, the envelopes E continues to receive the resistance force Fa from the locking claws 44 all the way from when feeding is started until the leading end of an envelope E pulls down the flag 46. If a large conveyance resistance is generated, the paper feed roller 36 and the conveyance roller 39 slip and the conveyance speed of the envelopes E decreases. As shown in FIG. 13A, the conveyance time T counted by the CPU 51 is longer than the conveyance time T at the time when the envelopes E whose number is smaller than or equal to the upper limit number are stacked, and deviates from the tolerance X. If a plurality of envelopes E continue to be passed through in this state, the amount of over-stacked envelopes decreases, and the conveyance time converges into the tolerance X.

Figure 13B:
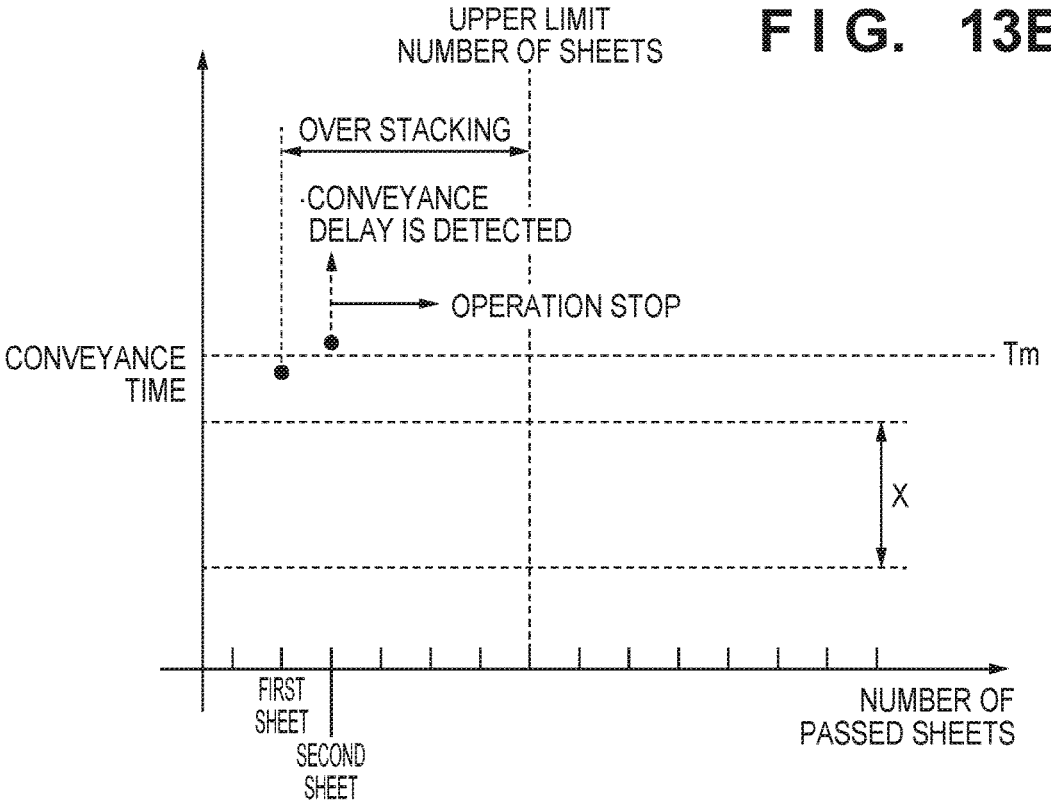

As shown in FIG. 13B, if the conveyance time T deviates from the tolerance X and also exceeds the threshold value Tm, the CPU 51 determines that a conveyance delay (conveyance error) has occurred, and stops the motor 57 after discharging all envelopes E on the conveyance path.

Over-Stacked State where Many More Envelopes are Stacked

If many more envelopes E are stacked on the tray unit 40, the resistance forces Fa and Fb further increase. Since the amount of slipping of the rollers also increases with an increase in the resistance forces Fa and Fb, the conveyance speed further decreases, or not even a single envelope E can be fed. In this case, the envelopes E do not reach the flag 46 before the conveyance time exceeds the jam threshold value Tj, and therefore, the CPU 51 determines that a jam has occurred, and stops the motor 57.

However, in the case where preferential feeding is employed, the CPU 51 executes second feeding (retry) even if the first feeding of a first envelope of a job has failed. That is to say, if the envelope E does not reach the flag 46 for the first feeding before the conveyance time T exceeds the retry threshold value Tr, a retry is executed. If the envelope E reaches the flag 46 before the accumulated conveyance time T of the first envelope E exceeds the jam threshold value Tj, the CPU 51 continues the job. On the other hand, if the envelope E does not reach the flag 46 even after the conveyance time T exceeds the jam threshold value Tj, the CPU 51 determines that a jam has occurred on the envelope E, and stops the motor 57. Thus, in the case where the conveyance time T is continuously counted from when the first feeding is started, if the envelope E does not reach the flag 46 even after the conveyance time T has exceeded the retry threshold value Tr, the retry is executed. Furthermore, if the envelope E does not reach the flag 46 even after the conveyance time T exceeds the jam threshold value Tj that is larger than the retry threshold value Tr, it is declared that a jam has occurred. Note that the retry threshold value Tr may be the same as the threshold value Tm. That is to say, the threshold value Tm may be used as the retry threshold value Tr for the first envelope E, and regarding the second and subsequent envelopes E, the threshold value Tm may be used as a threshold value for determining a conveyance delay.

[Over Stacking Determination]

A procedure for determining over stacking of the sheets S on the manual bypass tray 38 will be described in detail. If the bundle of sheets S receives the resistance force Fa and the resistance force Fb due to over stacking, the conveyance time T increases. Then, if the conveyance time T exceeds a threshold value Tk, which is equal to or larger than the upper limit value of the tolerance X, the CPU 51 determines that over stacking has occurred.

Figure 14A:
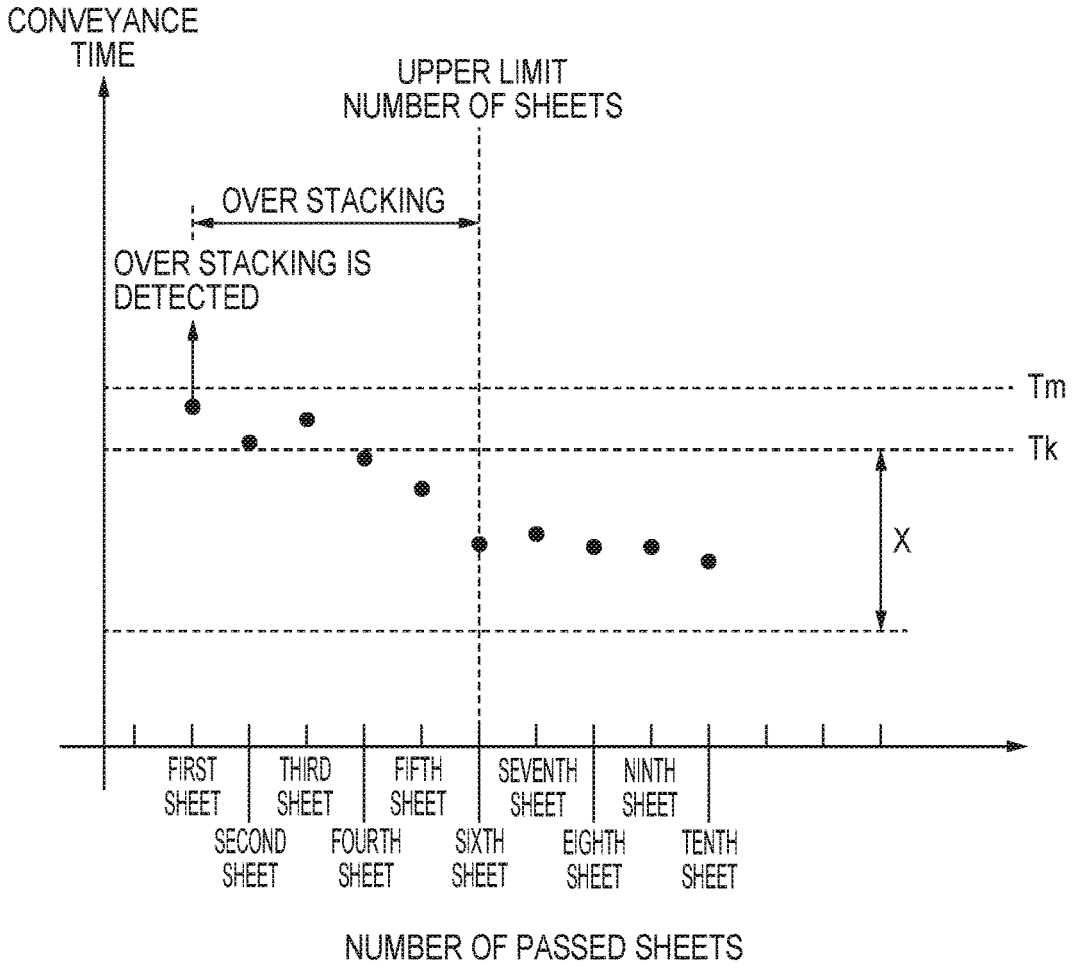
FIGS. 14A and 14B are diagrams showing a relationship between a threshold value for over stacking and conveyance time.

As shown in FIG. 14A, the threshold value Tk for determining over stacking is set to a value smaller than the threshold value Tm for determining a conveyance delay. Thus, the occurrence of a negligible conveyance delay that cannot be considered to be a conveyance delay is a condition for determining over stacking. The over stacking threshold value Tk is set to a value that is the same as or larger than the upper limit value of the tolerance X, and is stored in the storage device 55.

Figure 14B:
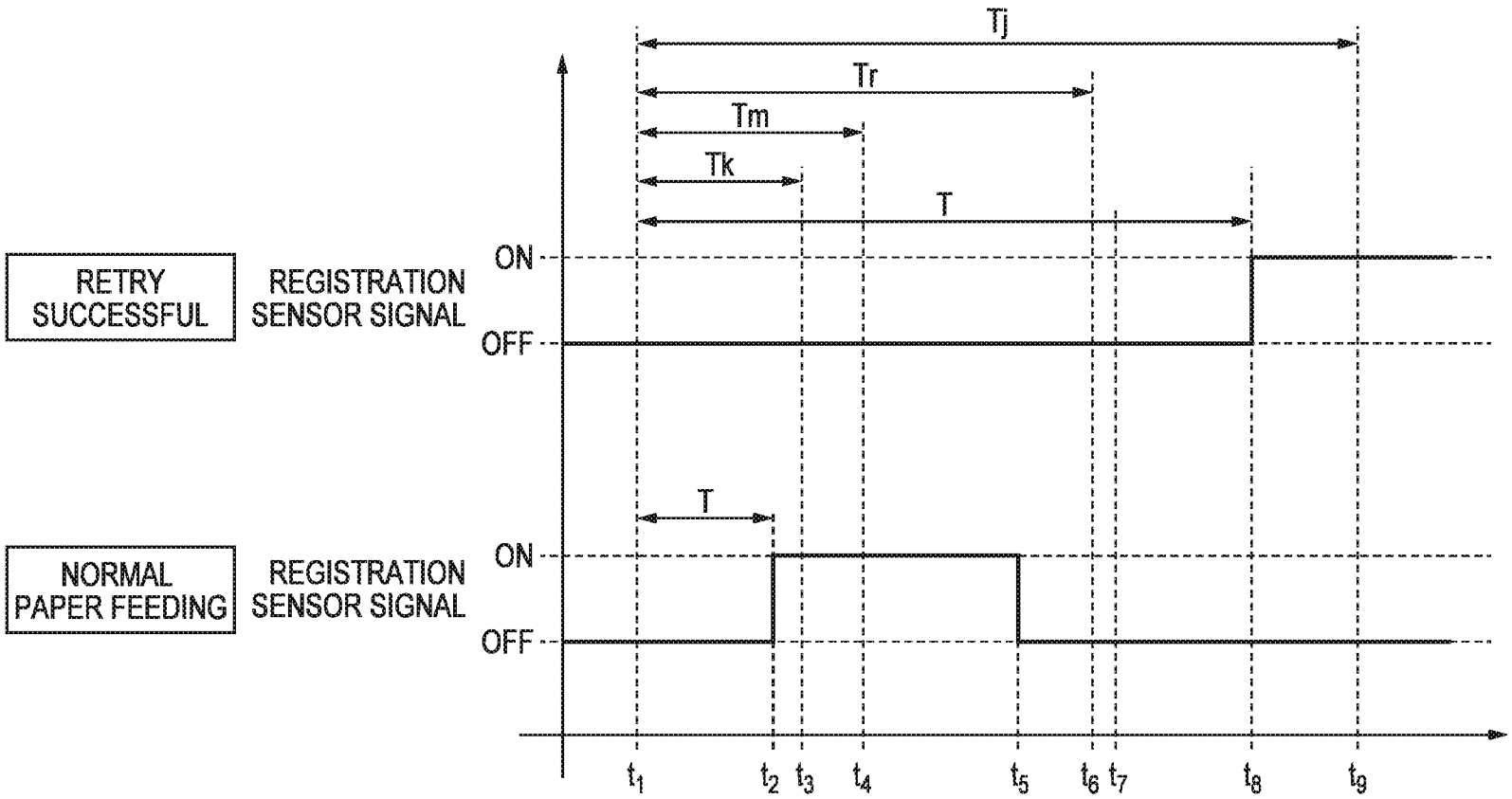

As shown in FIG. 14B, at time t1, the CPU 51 starts to feed the first sheet S in a print job, and the CPU 51 starts to count the conveyance time T. If the feeding is performed normally, the leading end of the sheet S arrives at the flag 46 at time t2. Also, at time t5, the trailing end of the sheet S passes the flag 46.

On the other hand, if the conveyance time T exceeds the over stacking threshold value Tk (i.e., if the leading end of the sheet S does not arrive at the flag 46 even after the time t3), the CPU 51 determines that over stacking has occurred. If the conveyance time T exceeds the conveyance error threshold value Tm (i.e., if the leading end of the sheet S does not arrive at the flag 46 even after the time t4), the CPU 51 may determine that a conveyance error has occurred. Note that detection of a conveyance error using the threshold value Tm is not applied to the first sheet S, but is applied to the second and subsequent sheets S. If the conveyance time T exceeds the retry threshold value Tk (i.e., if the leading end of the sheet S does not arrive at the flag 46 even after time t6), the CPU 51 determines that a feeding error has occurred. If the first feeding has failed, at time t7, the CPU 51 retries the feeding. If the retry is successful, at time t8, the leading end of the first sheet S arrives at the flag 46. Note that if the leading end of the sheet S does not arrive at the flag 46 even after the conveyance time T has exceeded the jam threshold value Tj, the CPU 51 determines that a jam has occurred. As shown in FIG. 14B, the value of the conveyance time T at the time when a retry occurs is much larger than the normal conveyance time T at the time when a retry does not occur, and exceeds the over stacking threshold value Tk. Accordingly, even in the case where a retry has occurred due to over stacking, the CPU 51 can detect over stacking based on the conveyance time T.

If the conveyance time T of the second or subsequent sheet S exceeds the threshold value Tk and the threshold value Tm, the CPU 51 determines that a conveyance delay has occurred, and stops image formation. Also, since the conveyance time T exceeds the threshold value Tk, the CPU 51 determines that over stacking has occurred.

Although this embodiment has mainly described the case where envelopes E are stacked in the manual bypass tray 38, this is only an example. For example, the present invention is also applicable to a case where plain paper is stacked in the feed cassette 23. That is to say, as a result of over-stacking envelopes E in the feed cassette 23, a conveyance delay may occur due to the locking claws, the guiding members, or the like provided in the feed cassette 23. Accordingly, the CPU 51 can also apply over stacking determination similar to that for the manual bypass tray 38 to the feed cassette 23 as well. Over stacking determination is applicable not only to the envelopes E but also to types of media with which a conveyance delay may occur due to the locking claws, the guiding members, or the like as a result of over stacking.

Conditions for Executing Over Stacking Determination

Over stacking determination does not need to be always executed. This is because there are situations where over stacking is likely to occur and is unlikely to occur. Therefore, conditions for executing over stacking determination will be described. A conveyance delay is likely to occur particularly due to over stacking of envelopes E. For this reason, the CPU 51 may consider the type of sheets S designated through the operation unit 59 being envelope type sheets such as envelopes E to be a condition for executing over stacking determination. Thus, the accuracy of over stacking determination can be improved based on the conveyance time. Furthermore, the CPU 51 will not erroneously determine that a conveyance delay caused by other factors is due to over stacking.

The CPU 51 may determine that the type of sheets S is the envelopes E in accordance with the image formation mode (e.g., envelope mode) that is set through the operation unit 59. The CPU 51 may also determine that the type of sheets S corresponds to envelopes E when the size of the sheets S that is set through the operation unit 59 is a typical size for envelopes E. The size of the envelopes E is stored in the storage device 55, and is read out and used by the CPU 51. The CPU 51 may specify the sheet type using a media sensor for identifying the sheet type.

Figure 15:
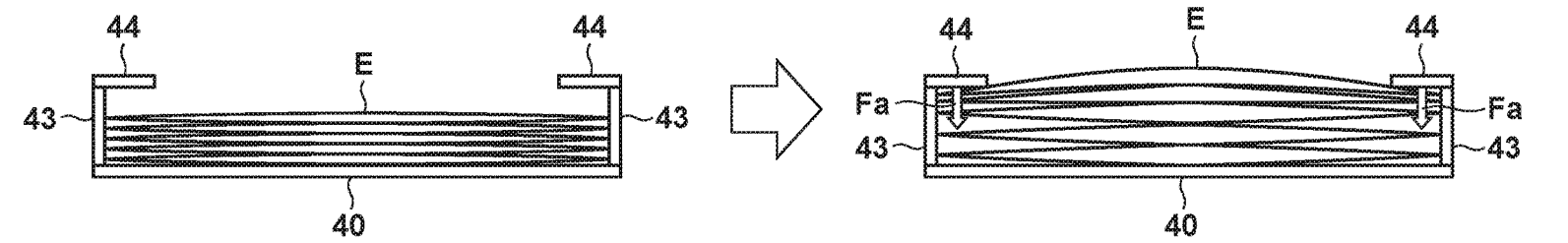
FIG. 15 is a diagram showing an envelope bundle that has swelled up due to an increase of the amount of vapor.

Incidentally, for a sheet S such as an envelope E, a large curl occurs as the amount of vapor in the air increases following a rise in temperature and humidity. Furthermore, an envelope E may largely swell up in some cases. As shown in FIG. 15, even when envelopes E are not over-stacked, the bundle of envelopes E becomes thick, and a large resistance force Fa is applied thereto from the locking claws 44. For this reason, even though the envelopes E are not over-stacked, the conveyance speed decreases, the conveyance time T exceeds the over stacking threshold value Tk, and over stacking is detected. Under the environmental conditions that the absolute amount of vapor is 15 g/m^3 or less, the temperature is 35° C. or less, and the humidity is 70% or less, an end portion of an envelope E will not largely curl or largely swell. Therefore, the CPU 51 may determine whether or not to execute over stacking determination in accordance with the environmental conditions acquired by the environment sensor 54. For example, it is assumed that execution conditions are that the amount of vapor is 15 g/m^3 or less, the temperature is 35° C. or less, and the humidity is 70% or less. Under such conditions, a curling or a swelling is not likely to occur, and accordingly, erroneous detection of over stacking decreases.

The CPU 51 can detect over stacking at the time of the first sheet S in a situation where a fixed number of sheets S or more are over-stacked exceeding the upper limit value. This is because, in general, the conveyance resistance exerted on the first sheet S is larger than the conveyance resistance exerted on the second sheet S. Even if the conveyance delay due to conveyance resistance varies, the CPU 51 can detect over stacking at least by the fifth sheet S. That is to say, there will be almost no cases where over stacking is detected for the first time at the fifth or subsequent sheet S. This is because, every time a sheet S is successfully conveyed, the height of the bundle of the sheets S lowers, and the conveyance resistance also decreases. Therefore, the condition for executing the over stacking determination may be that over stacking determination is executed from the first sheet S up to an $n^{th}$ (e.g., fifth) sheet S in a job. n is determined by experiments or simulation. This will improve the accuracy of over stacking determination. Upon a job being started, the CPU 51 counts the number of conveyed sheets S, and executes over stacking determination if the count value is smaller than or equal to a sheet number threshold value. Also, the CPU 51 stops over stacking determination if the count value exceeds the sheet number threshold value. Although the exemplary sheet number threshold value is five, this number may be determined in accordance with the shape or the conveyance resistance of the locking claws 44 and the guiding members 45.

Figure 16:
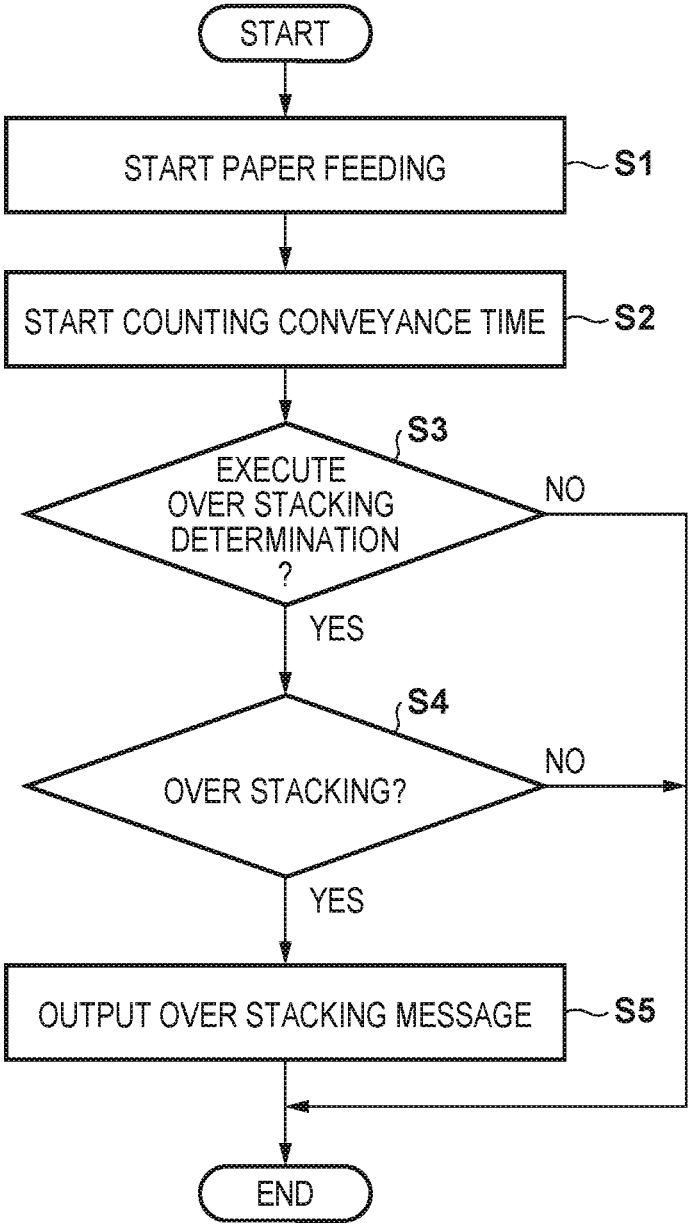
FIG. 16 is a flowchart showing over stacking determination.

FIG. 16 is a flowchart showing over stacking determination. Upon an instruction to form an image being input through the operation unit 59 or a host computer, the CPU 51 executes the following processing.

In step S1, the CPU 51 starts to feed the sheet S. For example, the CPU 51 outputs a control signal to cause the drive circuit 56 to start to drive the motor 57. The drive circuit 56 starts to drive the motor 57 based on the control signal. Note that the sheet S is fed from a feeding port (the feed cassette 23 or the manual bypass tray 38) designated by the job.

In step S2, the CPU 51 starts to count the conveyance time T using a timer or a counter.

In step S3, the CPU 51 determines whether or not to execute over stacking determination based on whether or not the conditions for executing over stacking determination are satisfied. Although several conditions have been listed as the execution conditions, the CPU 51 determines to execute over stacking determination when all of the above conditions are satisfied. Alternatively, the CPU 51 may determine to execute over stacking determination when one or a plurality of the conditions are satisfied. If the CPU 51 determines not to execute over stacking determination, the CPU 51 causes the image forming unit to form the image unless a conveyance delay or a jam has been detected based on the delay threshold value Tm or the jam threshold value Tj. If the CPU 51 detects a conveyance delay, the CPU 51 stops image formation after all sheets S on the conveyance path are discharged from the image forming apparatus 100. Also, if the CPU 51 detects a jam, the CPU 51 stops the image formation. The CPU 51 may also output a message regarding the conveyance delay or the jam to the operation unit 59. The CPU 51 may output a message for giving advice about an upper limit stacking amount and the correct stacking manner of sheets S, to the operation unit 59. In step S3, if the conditions for executing over stacking determination are not satisfied, the CPU 51 ends this processing. On the other hand, if, in step S3, the conditions for executing over stacking determination are satisfied, the CPU 51 proceeds to step S4. In step S4, the CPU 51 determines whether or not the sheets S are over-stacked in the manual bypass tray based on whether or not the conveyance time T exceeds the over stacking threshold value Tk.

In step S4, if over stacking is not detected, the CPU 51 ends this processing. On the other hand, if the CPU 51 determines that the conveyance time T exceeds the over stacking threshold value Tk, the CPU 51 proceeds to step S5.

In step S5, the CPU 51 outputs an over stacking message.

Over Stacking Information

Although the message regarding over stacking may be output to the operation unit 59, it may alternatively be transmitted to a computer (e.g., a server in a maintenance company) on a network via the communication device 58. For example, the CPU 51 may transmit, as an email, the over stacking message indicating the occurrence of over stacking to an email address of a maintenance person (maintenance company) with whom a maintenance contract has been concluded regarding the image forming apparatus 100. Note that the over stacking message may be transmitted to the server of the maintenance company using a communication protocol other than the email. Note that in the case where the message regarding over stacking is transmitted to the maintenance company, the message does not have to be output to the operation unit 59. The maintenance company may inform a user of the image forming apparatus 100 of the occurrence of over stacking by email or orally, as part of the maintenance contract. Furthermore, the maintenance company may give advice about the upper limit stacking amount and the correct stacking manner of sheets S, points that the user needs to be careful of in envelope printing, or the like.

Thus, in the case where the conveyance time T exceeds the over stacking threshold value Tk but a conveyance delay or a jam has not been detected, the CPU 51 can give a warning about over stacking. Over stacking may cause a conveyance delay or a jam. Therefore, by giving over stacking notification, an operator will recognize the correct stacking amount, and the occurrence of a conveyance delay or a jam will decrease.

By transmitting an over stacking message to the maintenance company, the operator is spared the time and effort to contact the maintenance company. The maintenance company can inform the operator of appropriate advice based on the over stacking message received from the image forming apparatus 100.

Erasing of Over Stacking Message

After the over-stacked state is resolved, the CPU 51 stops the output of the over stacking message, or erases the over stacking message. A condition for stopping the output of the over stacking message or erasing the over stacking message will be called a resolution condition. The resolution condition may be that the sheet sensor 53 no longer detects a sheet S (i.e., no sheet S is present on the tray unit 40 anymore). This is because, if there are no more sheets S, the over stacking situation has been absolutely resolved.

In the case where the type of sheets S being envelopes is the condition for executing over stacking determination, the type of the sheets S having been changed to something other than envelopes may alternatively be the resolution condition. For example, if the image formation mode is changed to a mode other than an envelope mode (e.g., a plain paper mode) or the like, the CPU 51 stops the output of the over stacking message. Also, if the size of the sheets S is changed to a size unique to the envelope, the CPU 51 may stop the output of the over stacking message.

Figure 17:
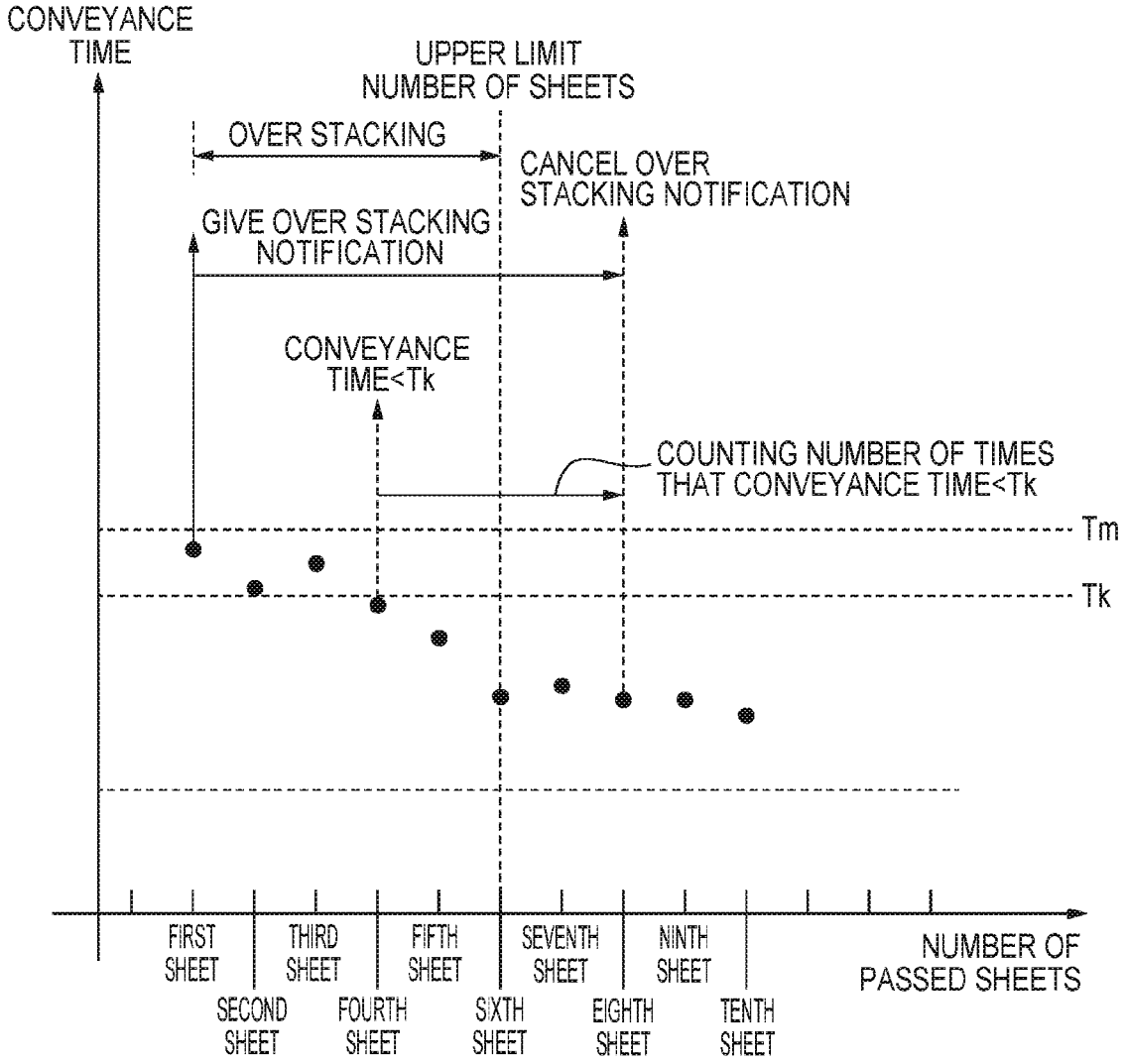
FIG. 17 is a diagram illustrating cancellation of over stacking notification.

As shown in FIG. 17, if the conveyance time T of the sheets S becomes smaller than or equal to the over stacking threshold value Tk in a state where the over stacking message (over stacking information) is output, the CPU 51 starts to count the number of sheets S. The CPU 51 may stop the output of the over stacking message when the conveyance time T of each of m successive sheets S is smaller than the threshold value Tk. The degree of over stacking decreases every time a sheet S is conveyed. Accordingly, if the conveyance time T of each of the m (e.g., five) successive sheets S is smaller than the threshold value Tk, it is highly likely that the over-stacked state has been resolved. Thus, the conveyance time T of each of the m successive sheets S being smaller than the threshold value Tk may be employed as the resolution condition.

Embodiment 2

In Embodiment 1, the conveyance time T of each sheet is counted with the first feeding operation as a reference. That is to say, the conveyance time T is not reset even if a retry occurs. In Embodiment 2, the conveyance time T is reset to 0 if a retry occurs. This means that the conveyance time T is recounted from the timing at which the second feeding operation is started.

Figure 18:
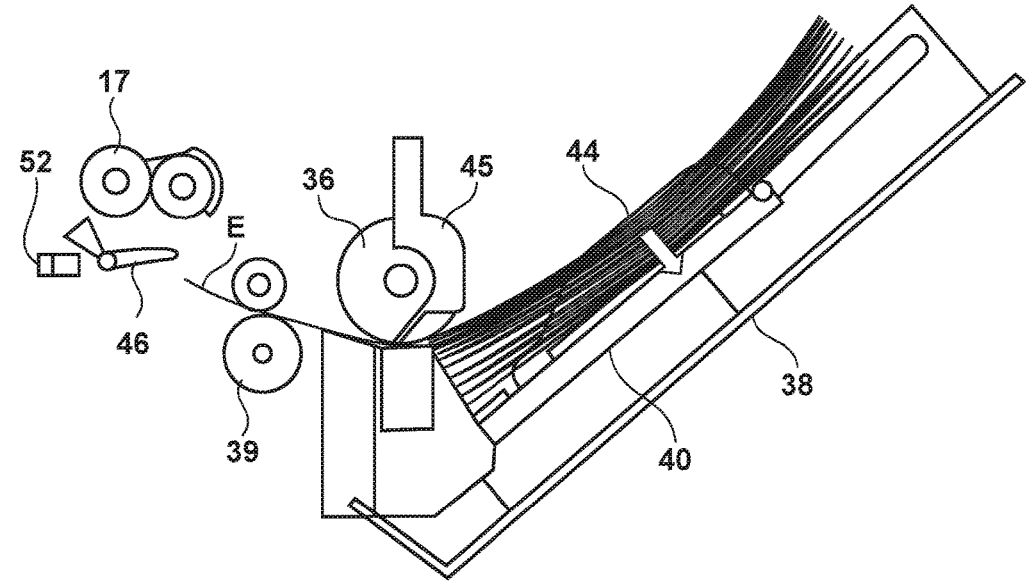
FIG. 18 is a diagram showing a position of an envelope that did not reach a flag as a result of a first feeding operation.
Figure 19A:
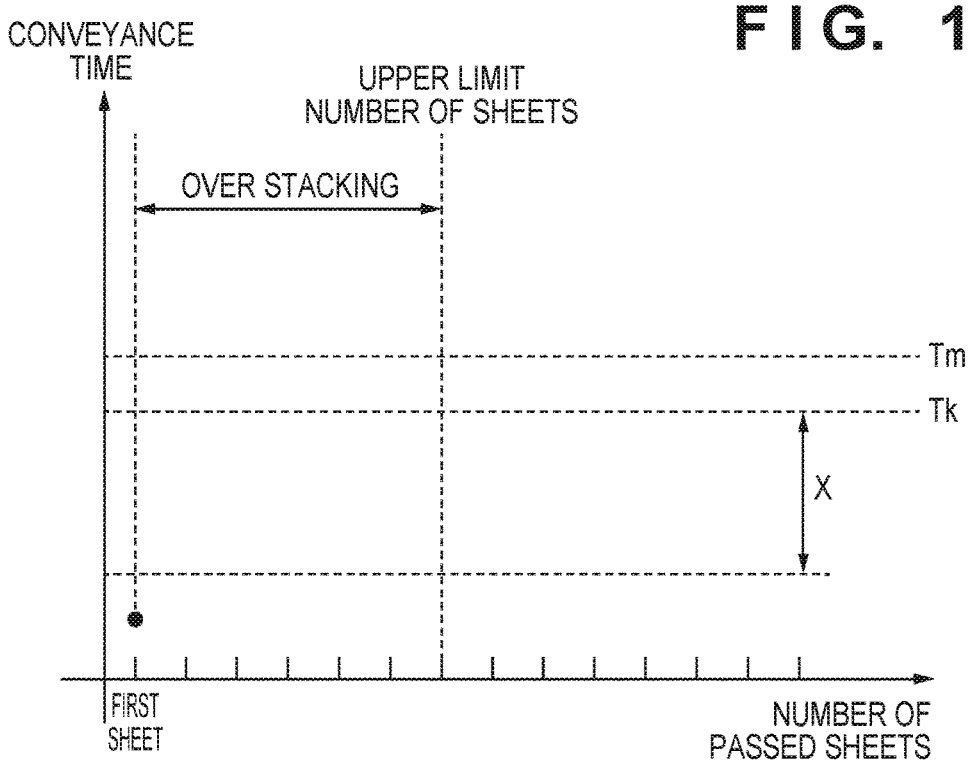
FIGS. 19A and 19B are diagrams showing a method for determining over stacking when a retry has occurred.

Another exemplary procedure for determining over stacking will be described in detail. Note that descriptions of items that are common to already-described items will be omitted. As described above, there are cases where, in the first feeding operation, a sheet S does not reach the flag 46 by the time the jam threshold value Tj elapses, due to a conveyance delay caused by the slipping or the rollers. However, there are cases where a sheet S reaches the flag 46 by executing the second feeding operation (retry). As shown in FIG. 18, there are cases where the leading end of the envelope E reaches the vicinity of the flag 46 as a result of the first feeding operation. Accordingly, if the conveyance time T is counted from the timing of starting the second feeding operation, the value of the conveyance time T becomes smaller than the lower limit value of the tolerance X, as shown in FIG. 19A. Even though the conveyance time T thus becomes smaller than or equal to the threshold value Tk, it cannot be said that over stacking has been resolved. Therefore, in this embodiment, even in the case of counting the conveyance time T from the timing of starting a retry, over stacking that may cause slipping of the rollers can be detected.

<Over Stacking Determination Conditions>

Figure 19B:
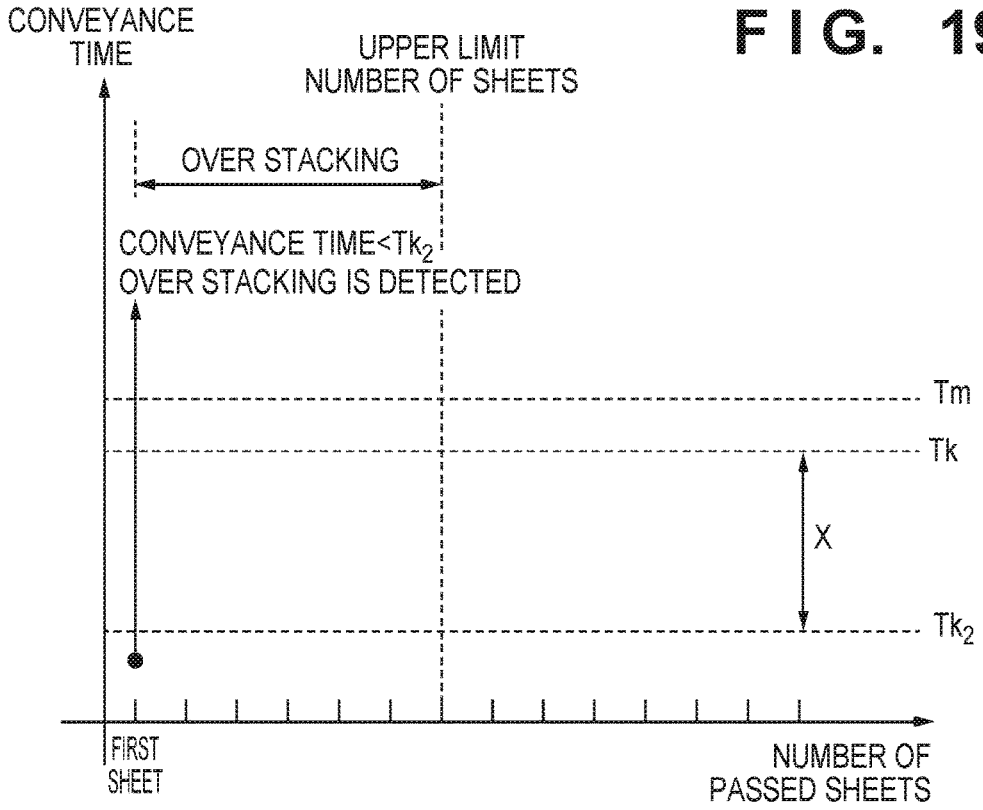

As shown in FIG. 19B, when a retry occurs on the first sheet S due to over stacking, the CPU 51 compares the conveyance time T with a threshold value Tk2. The threshold value Tk2 is set to a value that is smaller than or equal to the lower limit value of the tolerance X. If the conveyance time T of a sheet S for which the retry has been performed is smaller than the threshold value Tk2, the CPU 51 determines that over stacking has occurred.

Thus, the CPU 51 determines that over stacking has occurred when the first conveyance time T of a certain sheet S exceeds the threshold value Tk and the second conveyance time T of this sheet S is below the threshold value Tk2. As a result, even in the case of counting the conveyance time T from the timing of starting a retry, over stacking that may cause slipping of the rollers can be detected.

Embodiment 3

According to Embodiments 1 and 2, if the conveyance time T deviates from the tolerance X, the CPU 51 determines that over stacking has occurred. However, if the resistance forces Fa and Fb generated by over stacking become too large, even the first sheet S cannot be fed. The counting of the conveyance time T can also be designed to be completed only after the leading end of a sheet S has reached the flag 46. In this case, in a state where not even a single sheet S can be fed, the conveyance time T cannot be counted, and the CPU 51 cannot determine over stacking. In this embodiment, the following over stacking determination method is introduced.

[Over Stacking Determination Method]

Figure 20:
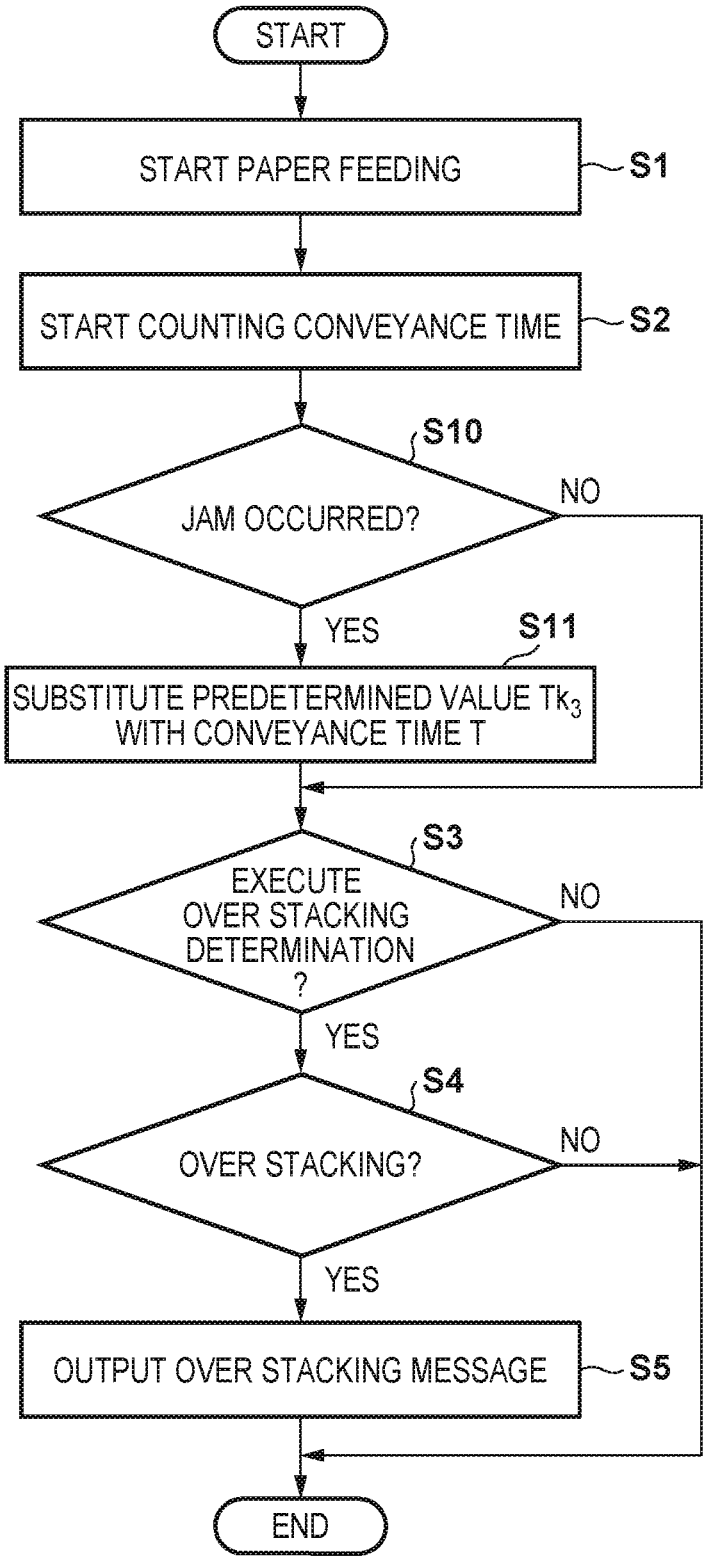
FIG. 20 is a diagram showing a method for determining over stacking when a jam has occurred.

An over stacking determination method according to Embodiment 3 will be described using a flowchart in FIG. 20. Compared with FIG. 16, in FIG. 20, steps S10 and S11 are inserted between steps S2 and S3.

In step S10, the CPU 51 determines whether or not a jam has occurred. For example, the CPU 51 determines that a jam has occurred when the leading end of a sheet S cannot be detected by the sheet sensor 52, even if a retry has been executed N times. If a jam has not occurred, the CPU 51 proceeds to step S3. On the other hand, if a jam is detected, the CPU 51 proceeds to step S11.

Figure 21:
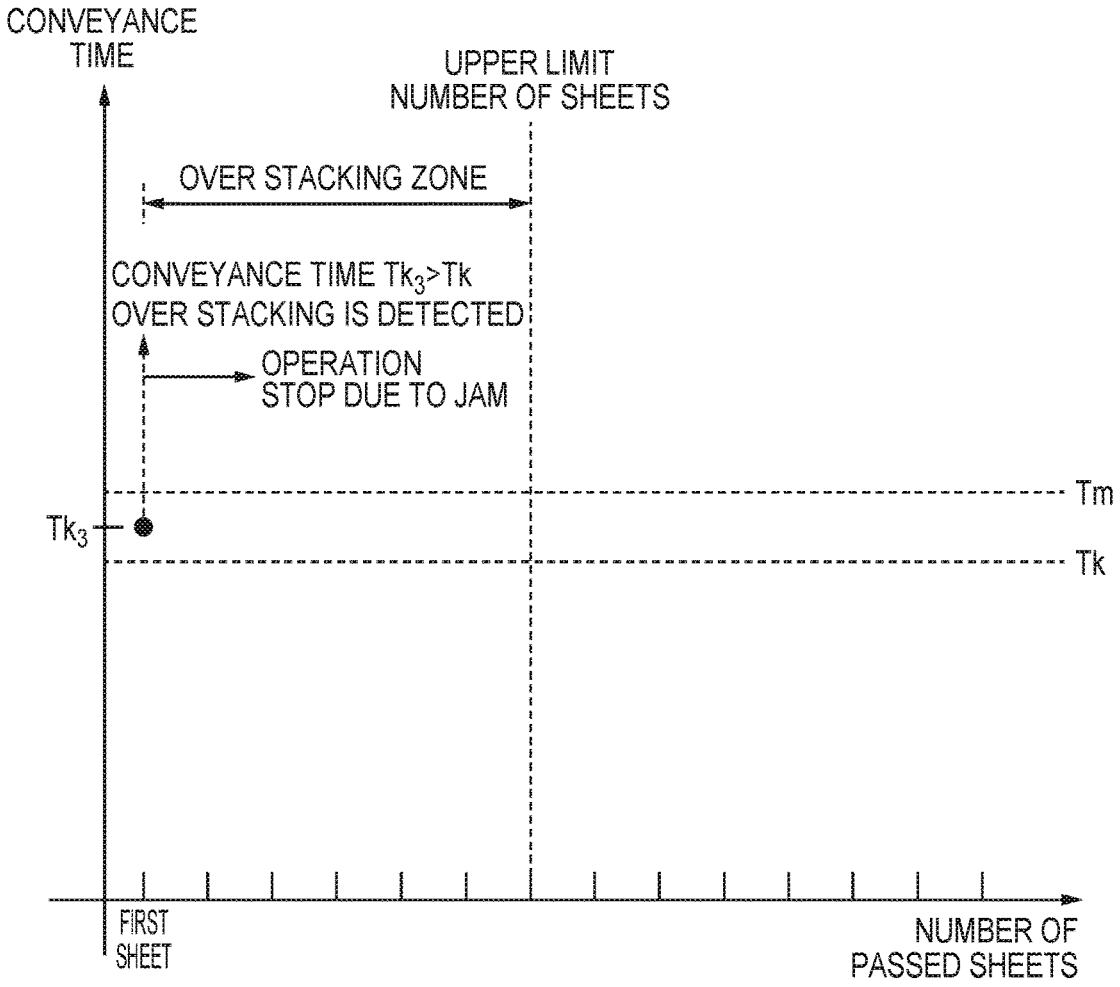
FIG. 21 is a diagram illustrating a threshold value used in the method for determining over stacking when a jam has occurred.

In step S11, the CPU 51 forcibly substitutes a predetermined value Tk3 with the conveyance time T. As shown in FIG. 21, the predetermined value Tk3 is a value that is smaller than the conveyance error threshold value Tm and larger than the over stacking threshold value Tk. Thus, the conveyance time T is ascertained even if a sheet S does not reach the flag 46. Moreover, since the predetermined value Tk3 that is larger than the over stacking threshold value Tk is substituted with the conveyance time T, over stacking is detected in step S4. Thus, in Embodiment 3, over stacking can be detected even if a jam occurs on the first sheet S.

Summary 1

Figure 22:
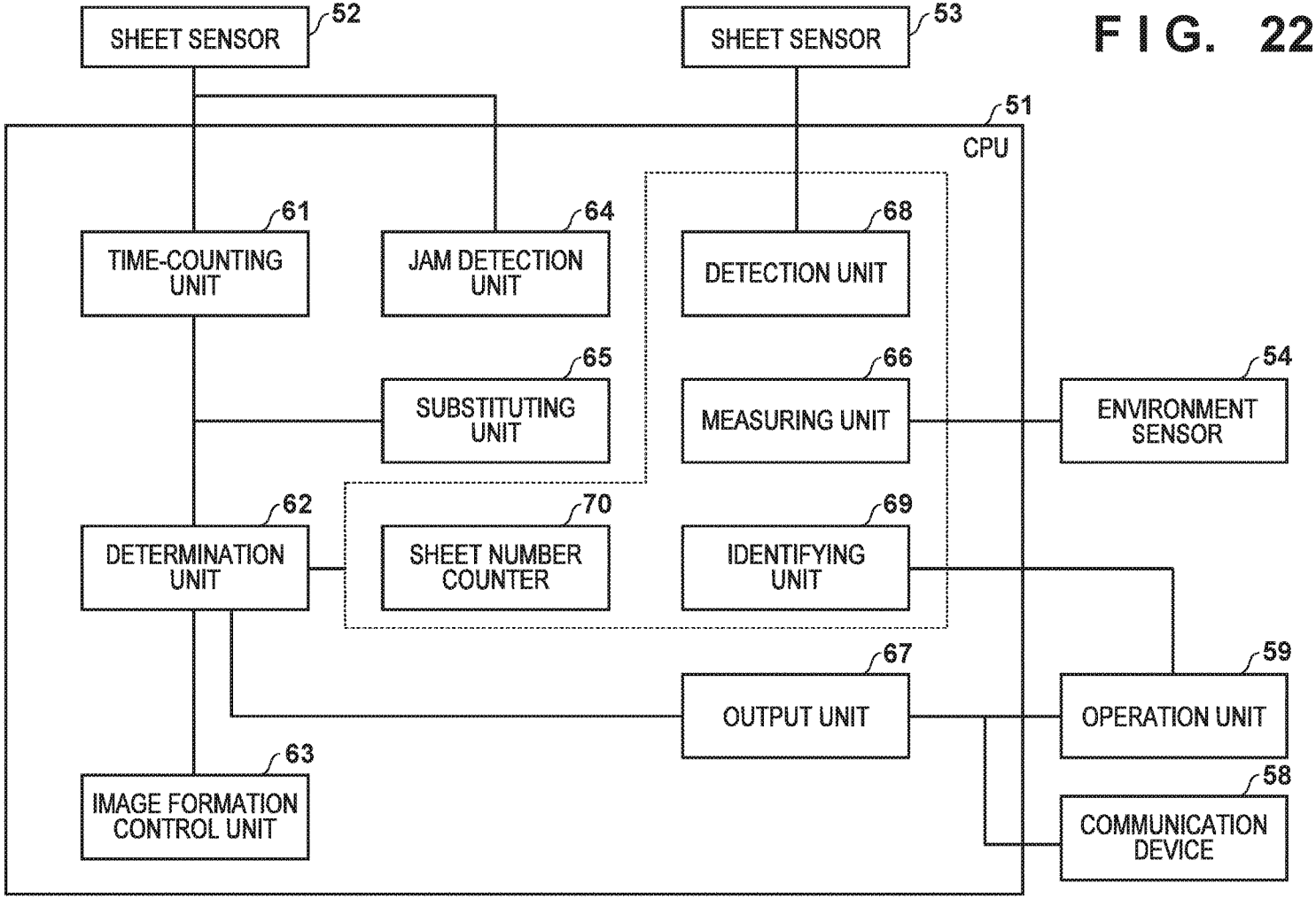
FIG. 22 is a diagram illustrating functions of a CPU.

Functions of the CPU 51 will be described using FIG. 22. The functions of the CPU 51 are achieved by the CPU 51 executing programs stored in the ROM. The functions of the CPU 51 may be achieved by hardware such as an FPGA (field programmable gate array) or an ASIC (application specific IC). A configuration may also be employed in which some functions are achieved by the CPU 51 and software, and the other functions are achieved by hardware. As described using FIG. 4 and regarding step S2, a time-counting unit 61 counts the conveyance time T from when the motor 57 starts to convey the sheet S until the sheet S arrives at a predetermined position on the conveyance path. As described regarding step S4, a determination unit 62 determines whether or not the conveyance time T of the sheet S exceeds the threshold value Tk, which is a first over stacking threshold value. In particular, the determination unit 62 determines that over stacking has occurred if the conveyance time T of a sheet S exceeds the threshold value Tk that is the first over stacking threshold value. By thus paying attention to the conveyance time of a sheet without using a sensor for estimating/measureing the height of a bundle of sheets S, over stacking of the sheets can be more accurately detected than with conventional techniques. Note that an image formation control unit 63 controls the image forming unit to form an image on the sheet S if the conveyance time T does not exceed the threshold value Tk. If the conveyance time T of a sheet S exceeds the threshold value Tk, the image formation control unit 63 controls the image forming unit not to form an image on the sheet S.

As described using FIG. 14B, a jam detection unit 64 may detect that a conveyance delay has occurred on a sheet S based on whether or not the conveyance time T of the sheet S exceeds the threshold value Tm, which is a conveyance delay threshold value. The jam detection unit 64 may detect that a jam has occurred on a sheet S based on whether or not the conveyance time T of the sheet S exceeds the jam threshold value Tj. Note that the threshold value Tk for detecting over stacking is smaller than the threshold value Tm and the jam threshold value Tj. As described using FIG. 14A and the like, if over stacking occurs, a negligible conveyance delay occurs. Note that excessive over stacking may cause a conveyance delay or a jam. Therefore, a conveyance delay and a jam can be prevented in advance by setting the threshold value Tk to be smaller than the threshold value Tm and the jam threshold value Tj.

As described regarding Embodiment 3, the time-counting unit 61 starts to count a predetermined time upon a conveyance unit such as the motor 57 starting to convey a sheet. If the sheet does not arrive at a predetermined position on the conveyance path within this predetermined time, a substituting unit 65 substitutes a value that exceeds the threshold value Tk with the conveyance time T. The feeding may be retried several times within the predetermined time. As a result, if sheets S are not successfully conveyed even once since the sheets S are stacked in the manual bypass tray 38, the jam detection unit 64 determines that a feeding jam has occurred. In this case, the conveyance time T is not defined in some cases. Therefore, the substituting unit 65 may cause the determination unit 62 to determine that over stacking has occurred by substituting a value that exceeds the threshold value Tk with the conveyance time T.

The determination unit 62 may determine whether or not to execute over stacking determination in accordance with the number of sheets S that have been conveyed since a conveyance job was started. For example, the determination unit 62 may execute over stacking determination until a predetermined number of sheets S has been conveyed after the sheets S are stacked in the manual bypass tray 38, and thereafter stop the determination. If sheets S are over-stacked in the manual bypass tray 38, the conveyance time T from the first sheet until an nth sheet is likely to be long. This is because, the higher the bundle of the sheets S is, the larger the resistance forces Fa and Fb are, which increases conveyance resistance. Accordingly, erroneous detection of over stacking decreases by executing the over stacking determination only in a period from when an image forming job is started until the $n^{th}$ sheet S is conveyed.

A measuring unit 66 may measure environmental conditions of the environment where the image forming apparatus 100 is set, using the environment sensor 54 or the like. The determination unit 62 executes over stacking determination if the environmental conditions measured by the measuring unit 66 are predetermined environmental conditions. Erroneous detection of over stacking is likely to occur under certain environmental conditions. Accordingly, when erroneous detection of over stacking is likely to occur, over stacking determination is skipped. That is to say, over stacking determination may be executed only under environmental conditions under which the accuracy of the over stacking determination is high. For example, over stacking determination is executed when the absolute amount of vapor is smaller than or equal to a predetermined amount of vapor, the environmental temperature is lower than or equal to a predetermined temperature, and the environmental humidity is lower than or equal to a predetermined humidity.

As described in FIG. 8, the manual bypass tray 38 may have the locking claws 44 as regulating members for regulating the height of the sheets S stacked in the manual bypass tray 38. As described in FIG. 10A, since over-stacked sheets S receive the resistance force Fa from the locking claws 44, the conveyance time T is likely to become long. Accordingly, as a result of paying attention to the conveyance time T, over stacking can be accurately detected.

Upon an instruction to convey the sheets S being given to the motor 57 and the drive circuit 56, the time-counting unit 61 starts to count the conveyance time T. However, as described regarding Embodiment 2, the time-counting unit 61 may be configured to re-count the conveyance time T if an instruction to retry conveyance of sheets S is given to the motor 57 and the drive circuit 56. In the latter case, the determination unit 62 may determine whether or not the conveyance time T of a sheet S is smaller than the threshold value Tk2 (i.e., smaller than a second over stacking threshold value), which is smaller than the threshold value Tk. For example, the determination unit 62 may determine that over stacking has occurred if the conveyance time T of a sheet S is smaller than the threshold value Tk2 (i.e., smaller than the second over stacking threshold value) that is smaller than the threshold value Tk. As described using FIG. 18, if a sheet S has approached the flag 46 as a result of the first feeding operation, the value of the conveyance time T counted with the retry as a reference is smaller than the tolerance X. Then, over stacking can be accurately detected using the threshold value Tk2 that is smaller than the threshold value Tk.

The image formation control unit 63 controls the image forming unit to form an image on a sheet S if the conveyance time T of the sheet S does not exceed the threshold value Tk and the conveyance time T of the sheet S is not smaller than the threshold value Tk2. On the other hand, the image formation control unit 63 may be configured not to form an image on a sheet S if the conveyance time T of the sheet S exceeds the threshold value Tk or the conveyance time T of the sheet S is smaller than the threshold value Tk. When over stacking is thus detected, the image forming unit may be controlled so as to give priority to resolving over stacking and not to form an image. As a result, the operator can easily recognize over stacking.

If the determination unit 62 determines that sheets S are over-stacked in the manual bypass tray 38, the output unit 67 may output over stacking information indicating that the sheets S are over-stacked. As a result, the operator and the maintenance company more easily recognizes over stacking. A sheet number counter 70 may function as a count unit for counting the number of sheets S conveyed from the manual bypass tray 38 after the determination unit 62 determines that the sheets S are over-stacked in the manual bypass tray 38. That is to say, the sheet number counter 70 performs counting so as to check how many successive sheets a phenomenon in which the conveyance time of the sheets conveyed from the manual bypass tray 38 did not exceed the first over stacking threshold value has occurred. The output unit 67 may be configured to stop the output of the over stacking information if the count value of the sheet number counter 70 reaches a stop threshold value. The degree of over stacking decreases every time a sheet S is conveyed. Accordingly, at the point when several sheets S are completely conveyed, it is likely that an over-stacked state has been resolved. Accordingly, over stacking notification may be stopped based on the number of conveyed sheets S.

The detection unit 68 may detect whether or not sheets S are stacked in the manual bypass tray 38. For example, the detection unit 68 detects the presence of sheets S using the aforementioned sheet sensor 53. After the determination unit 62 determines that sheets S are over-stacked in the manual bypass tray 38, if it is detected by the detection unit 68 that no sheet S is stacked in the manual bypass tray 38, the output unit 67 may stop the output of the over stacking information.

This is because, if not even a single sheet S is present in the manual bypass tray 38, over stacking has been absolutely resolved.

If the type of the sheets S stacked in the manual bypass tray 38 is changed after the determination unit 62 determines that the sheets S are over-stacked in the manual bypass tray 38, the output unit 67 may stop the output of the over stacking information. In the case of envelope type sheets such as envelopes, over stacking is often an issue. Therefore, when the type of sheets S is changed, the output of the over stacking information may be temporarily stopped. For example, if the type of sheets S stacked in the manual bypass tray 38 is changed from envelopes to plain paper, over stacking of envelopes has been resolved.

The output unit 67 may display the over stacking information on the display device of the operation unit 59. The operator can thereby be visually notified of the over stacking. Also, the output unit 67 may use the communication device 58 as a transmission unit for transmitting a message including the over stacking information. The over stacking message may be transmitted to an email address of the maintenance person (maintenance company) of the image forming apparatus 100. As a result, the maintenance company can notify a customer of a method for resolving over stacking as part of maintenance service.

The image forming apparatus 100 may further be provided with an identifying unit 69 for identifying the type of sheets S. The determination unit 62 may determine whether or not the conveyance time T of a sheet S, the type of which has been identified as the envelope type sheet, exceeds the threshold value Tk. In the case of envelope type sheets such as envelopes, over stacking is often an issue. Accordingly, the over stacking determination may be executed only when the envelope type sheets are used. This will improve the accuracy of the over stacking determination. The identifying unit 69 may identify the type of sheets S as the envelope type sheet if an envelope mode is designated from a plurality of control modes provided in the image forming apparatus 100. The operation unit 59 may also function as a size designation unit for designating the size of the sheets S. The identifying unit 69 may identify the type of sheets S as the envelope type sheet based on the size of the sheets S. Thus, the type of sheets S may be specified from indirect information.

Embodiment 4

The aforementioned Japanese Patent Laid-Open No. 05-278896 proposes an image forming apparatus that detects, using a sensor, over stacking by estimating, in an analog manner, the height of a sheet bundle stacked in a cassette.

However, with the technique described in Japanese Patent Laid-Open No. 05-278896, if, for example, a sheet is bent, the height of a sheet bundle is incorrectly measured, and therefore, over stacking may be erroneously determined. This embodiment detects over stacking of sheets more accurately than with conventional techniques.

[Functions of Controller]

Figure 23:
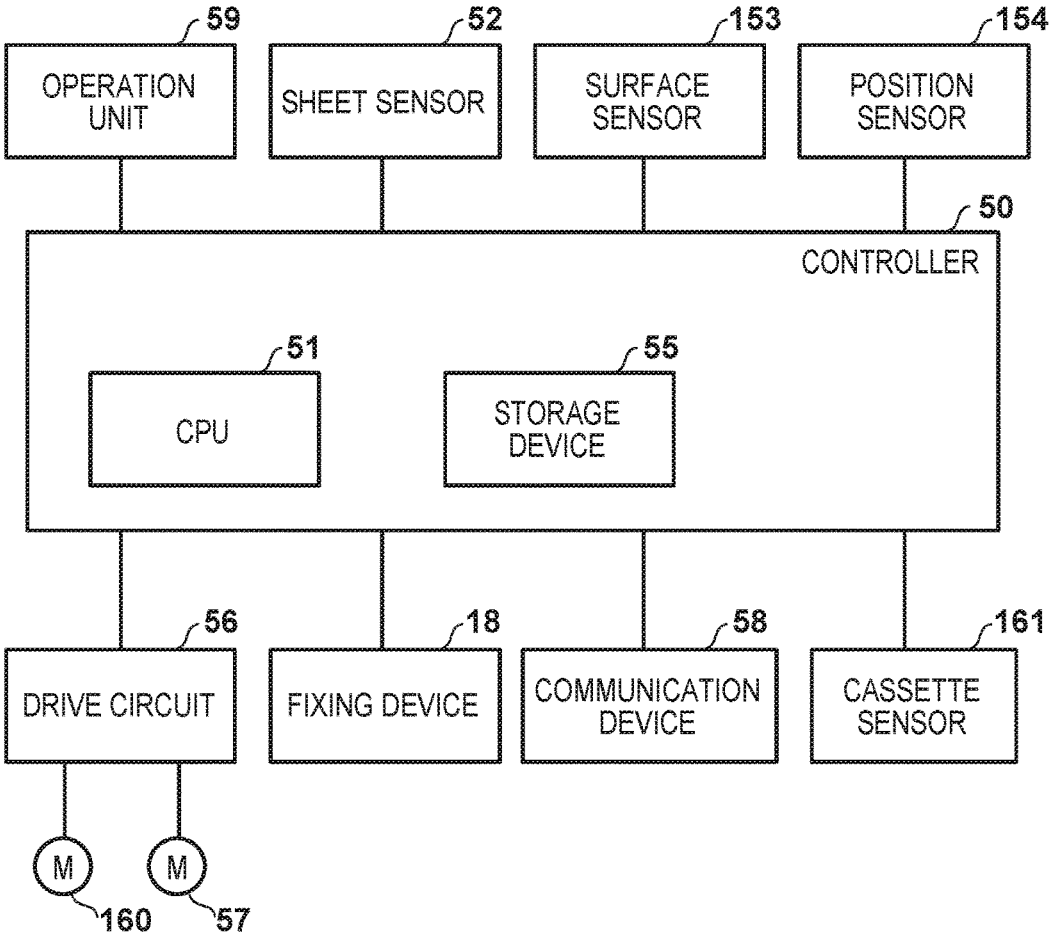
FIG. 23 is a diagram showing a control system.

Functions of the controller 50 will be described using FIG. 23. The overall image forming apparatus 100 is comprehensively controlled by executing control programs stored in the CPU 51 or the storage device 55. The storage device 55 has a memory such as a ROM or a RAM. The controller 50 sets image forming conditions in accordance with an image formation mode designated through the operation unit 59. The image forming conditions are, for example, the conveyance speed of sheets S, the fixing temperature of the fixing device 18, and the like. For example, the image formation modes may include a plain paper mode for forming an image on plain paper, a cardboard mode for forming an image on cardboard, an envelope mode for forming characters on an envelope, and the like. The controller 50 stores the image forming conditions for the respective image formation modes in the storage device 55, and reads out the image forming conditions corresponding to the designated image formation mode.

The CPU 51 counts the conveyance time T using the sheet sensor 52 for determining whether or not a conveyance delay or a jam has occurred. If a sheet S causes a conveyance delay or a jam on the conveyance path, the CPU 51 causes a message indicating the occurrence of the conveyance delay or the jam to be displayed on the display device of the operation unit 59. If the CPU 51 detects over stacking of sheets S in the feed cassette 23 or the manual bypass tray 38, the CPU 51 causes a message indicating the occurrence of the over stacking to be displayed on the display device of the operation unit 59. A conveyance delay is a phenomenon in which the conveyance time T of a sheet S becomes too long to be able to ensure the accuracy of an image forming position or the like, and may also be called a conveyance error or a failure in conveyance. A jam refers to, in the narrow sense, a phenomenon in which a sheet S is stuck or clogs on the conveyance path. A phenomenon in which large a conveyance resistance is applied to sheets S due to over stacking in the feed cassette 23 and not even a single sheet S can be conveyed is also a kind of jam. Thus, over stacking may cause the case where a sheet S has been successfully fed from the feed cassette 23 but the conveyance time T is too long, or the case where the feeding fails.

The CPU 51 detects, using a surface sensor 153, whether or not the surface of a sheet S located uppermost in the plurality of sheets S stacked in the feed cassette 23 has been lifted up (raised) to a predetermined height H. That is to say, the surface sensor 153 is an exemplary surface detection unit for detecting whether or not the surface of a sheet S stacked on the intermediate plate 143 has been lifted up to the predetermined height by the motor 160. The CPU 51 detects, using a position sensor 154, the position of a rear end regulating plate 141 (FIG. 25) for regulating the position of the rear end of sheets S stacked in the feed cassette 23. The position sensor 154 is an exemplary position detection unit for detecting the position of the rear end regulating plate 141.

The motor 57 is a drive source for driving the conveyance rollers such as the pickup roller 35 and the feed roller 24. The CPU 51 outputs a feed start signal to the drive circuit 56 for driving the motor 57. The drive circuit 56, upon receiving the feed start signal, starts to drive the motor 57. The CPU 51 sets the conveyance speed in advance corresponding to the image formation mode in the drive circuit 56. The motor 57 rotates at a rotation speed corresponding to the set conveyance speed. The motor 160 is a so-called lift-up motor, and is a motor for lifting up the intermediate plate on which sheets S are placed in the feed cassette 23. The motor 160 is an exemplary lift-up unit for lifting up the intermediate plate such that a sheet S stacked on the intermediate plate, which is a plate member, comes into contact with the pickup roller 35. The CPU 51 drives the motor 160 such that the surface sensor 153 detects an uppermost sheet Sa being located at the height H. A cassette sensor 161 is an exemplary pull-out/push-in detection unit for detecting that the feed cassette 23 has been pulled out from, and pushed into, the housing 101 of the image forming apparatus 100. The feed cassette 23 is a drawer-like cassette, for example. When the operator stores sheets S, the feed cassette 23 is drawn out from the housing 101. Upon storing the sheets S being completed, the feed cassette 23 is inserted in the housing 101. The CPU 51 detects, using the feed cassette 23, that the feed cassette 23 has been pulled out and pushed in.

Figure 24:
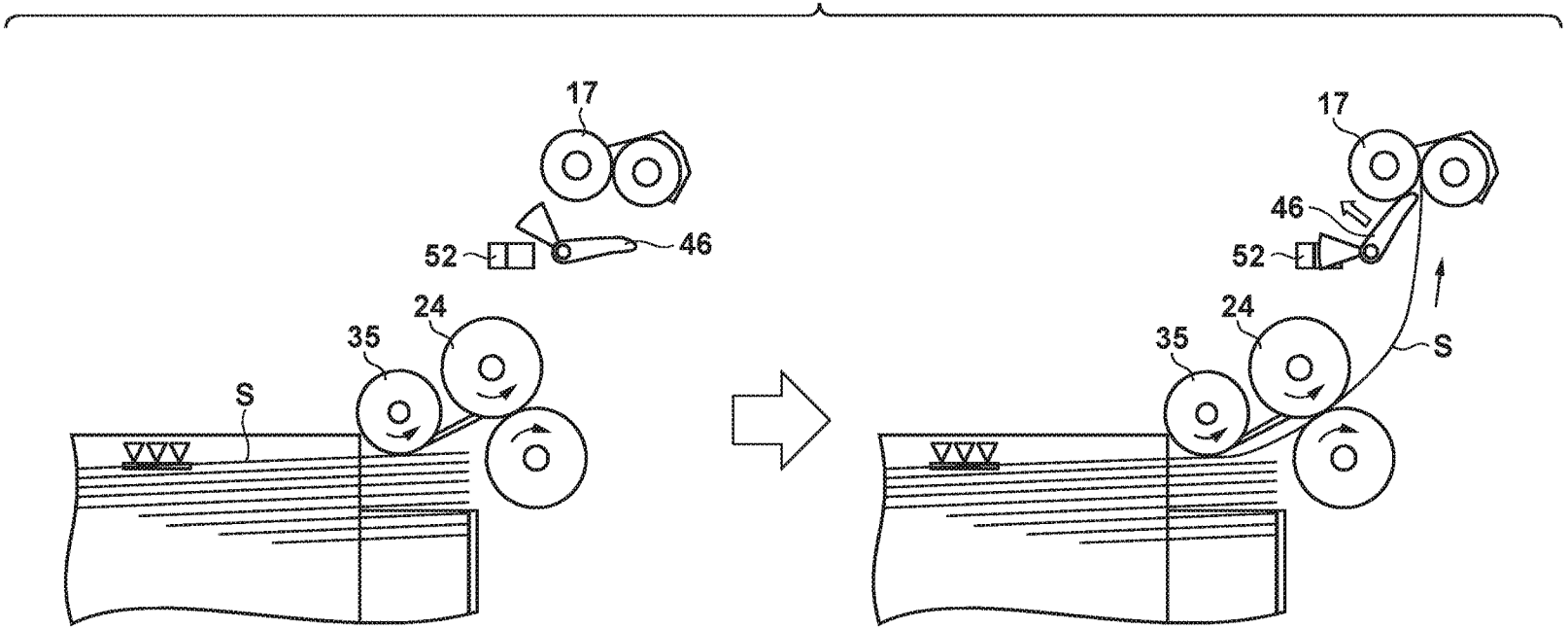
FIG. 24 is a diagram showing feeding of sheets from a feed cassette.

As shown in FIG. 24, when the leading end of a sheet S pulls down the flag 46 provided near the registration roller 17, the sheet sensor 52 outputs a detection signal indicating that the leading end of the sheet S has been detected, to the controller 50. The CPU 51 counts, using a timer or a counter, the conveyance time from the timing at which conveyance of a sheet S is started until the timing at which the sheet sensor 52 detects the leading end of the sheet S. The CPU 51 may obtain a difference in time data acquired from a real time-clock (RTC) in order to count the conveyance time. Note that the example of the detection signal of the sheet sensor 52 is as shown in FIG. 4.

As mentioned above, FIG. 5A shows exemplary conveyance time at the time when a plurality of sheets S are continuously fed. The conveyance time T may more or less vary depending on a friction state of the pickup roller 35 and the type of sheets S (thickness, basis weight, envelope type or not, presence of surface coating etc.). However, if the plurality of sheets S are correctly stacked in the feed cassette 23, and a jam does not occur, the conveyance time of each sheet S stays within the tolerance X.

FIG. 5B shows exemplary conveyance time at the time when a plurality of sheets S are continuously fed. In particular, a conveyance delay (conveyance error) has occurred on a fifth sheet S. As shown in FIG. 5B, there may be cases where a conveyance delay occurs for the second and subsequent sheets after a job is started. The CPU 51 monitors the conveyance time T of each sheet S, and determines whether or not the conveyance time T exceeds a delay threshold value Tm. If the conveyance time T exceeds the delay threshold value Tm, the CPU 51 determines that a conveyance delay has occurred, discharges all sheets S that remain on the conveyance path, and stops the motor 57. The delay threshold value Tm for determining a conveyance delay is set to a value that deviates from the tolerance X and is larger than an upper limit value of the tolerance X. If the conveyance time exceeds the delay threshold value Tm, the accuracy of image formation on a sheet S is not ensured, and accordingly, the CPU 51 stops image formation.

The CPU 51 may preferentially feed the first sheet S, and cause the first sheet S to wait at the registration roller 17 until the image forming unit is ready. In this case, the CPU 51 may not determine that a conveyance delay has occurred regarding a first sheet S, even if the conveyance time T of the first sheet S exceeds the delay threshold value Tm. That is to say, the conveyance delay determination processing for the first sheet S may be skipped. The time from when a job is started until the image forming unit is ready is longer than a normal conveyance time T, which is a conveyance time obtained by dividing a conveyance distance from the position of the leading end of a sheet S contained in the feed cassette 23 to the sheet sensor 52 by the conveyance speed. Therefore, the conveyance delay of the first sheet S is highly permissible. Thus, in this embodiment, the conveyance delay determination is applied to the second and subsequent sheets S.

However, there are cases where the first sheet S does not arrive at the flag 46 even though the conveyance time T at the time of performing a first feeding operation for the first sheet S greatly exceeds the threshold value Tm. That is to say, even if the count value of the timer of the CPU 51 exceeds the retry threshold value Tr, the sheet sensor 52 cannot detect the leading end of the sheet S (the threshold value Tm may be employed as the retry threshold value Tr). In this case, the CPU 51 instructs the drive circuit 56 to perform a second feeding operation (retry). Note that the CPU 51 may continue, also during the retry, counting of the conveyance time T starting from the first feeding operation. If the first sheet S does not arrive at the flag 46 even after the conveyance time T exceeds the jam threshold value Tj, the CPU 51 determines that a jam has occurred. If the CPU 51 detects a jam, the CPU 51 causes a message indicating the occurrence of the jam to be displayed on the operation unit 59, and transmits this message to an email address of a maintenance person via the communication device 58. The message may be delivered in the form of an email, for example.

[Configuration of Feed Cassette]

Figure 25:
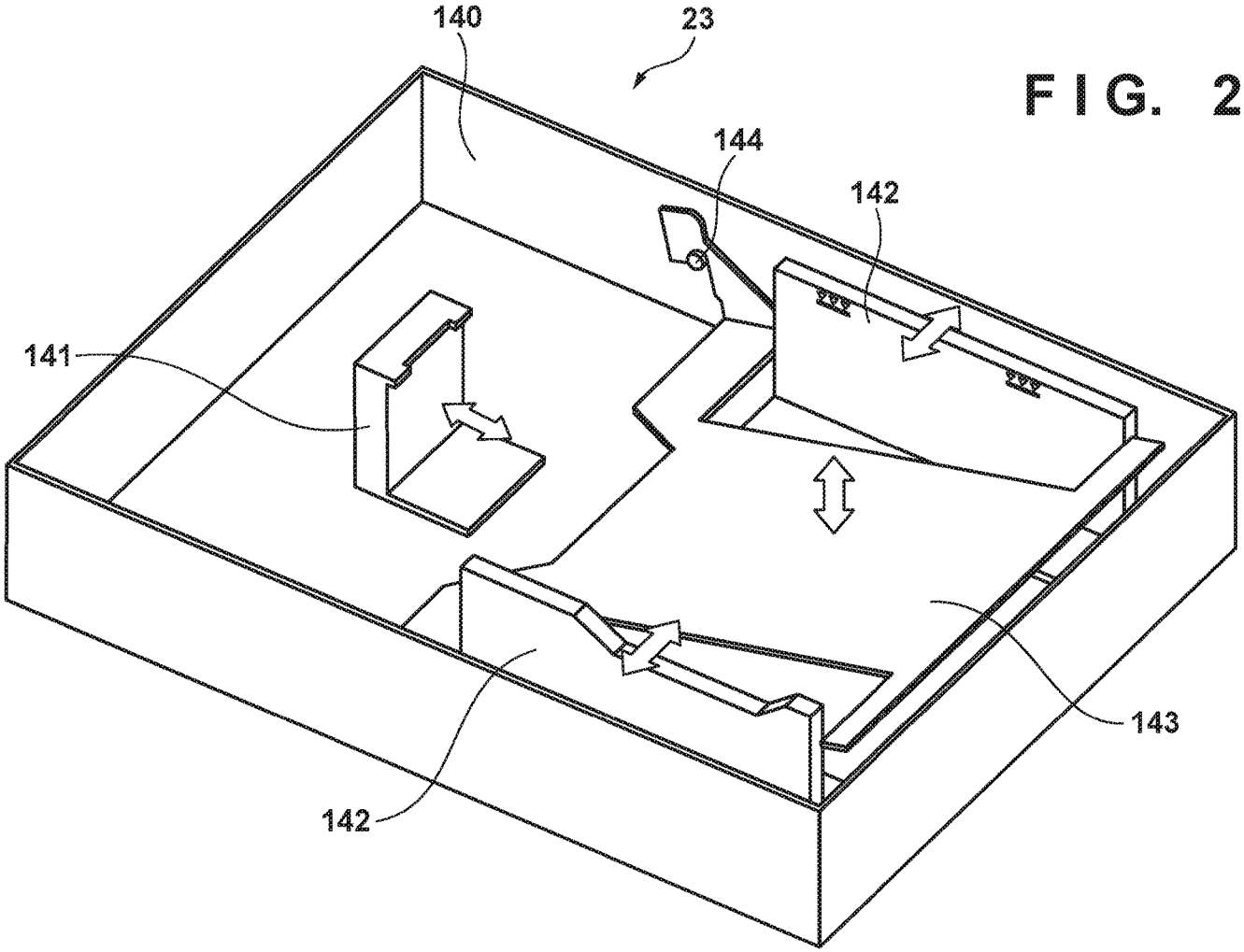
FIG. 25 is a perspective view of the feed cassette.

A configuration of the feed cassette 23 will be described using FIGS. 25 to 27. As described above, the feed cassette 23 can be pulled out from, and pushed into, the housing 101 of the image forming apparatus 100. As shown in FIG. 25, the feed cassette 23 has a cassette tank 140. An inner bottom face of the cassette tank 140 is provided with the rear end regulating plate 141 capable of moving in both the conveyance direction of sheets S and the opposite direction (that may be called front and rear directions). The operator moves the rear end regulating plate 141 in accordance with the size of the sheets S. The rear end regulating plate rear 141 is an exemplary regulating unit for regulating and aligning the rear end position of sheets S. Thus, conveyance of a plurality of sheets S is started from roughly the same position. The position of the rear end regulating plate 141 is detected by the aforementioned position sensor 154. The bottom face of the cassette tank 140 is provided with two side regulating plates 142 capable of moving in directions perpendicular to the conveyance direction of sheets S (that may be called left and right directions or width directions). The two side regulating plates 142 regulate and align the positions of both ends of sheets S. The intermediate plate 143 is a plate member that is provided in the feed cassette 23 and on which sheets S are stacked, and pivots around the fulcrum 144.

Figure 26A:
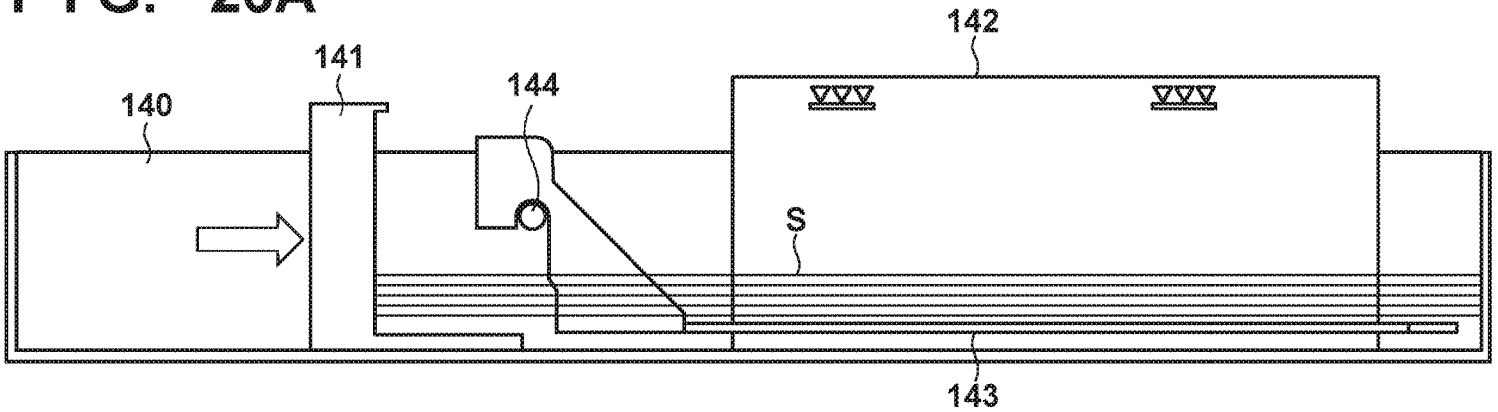
FIGS. 26A and 26B are cross-sectional views of the feed cassette.

As shown in FIG. 26A, when the feed cassette 23 is drawn out of the housing 101, the intermediate plate 143 is located near the bottom face of the cassette tank 140. The operator stacks a bundle of sheets S in the feed cassette 23, and manually moves the rear end regulating plate 141 such that the rear end regulating plate 141 abuts against the rear end of the sheets S stacked on the intermediate plate 143. Similarly, the operator manually moves the side regulating plates 142 such that the side regulating plates 142 abut against the left end and the right end of the sheets S stacked on the intermediate plate 143. Thus, the bundle of the sheets S stacked on the intermediate plate 143 is aligned in both the front and rear directions and the left and right directions.

Figure 26B:
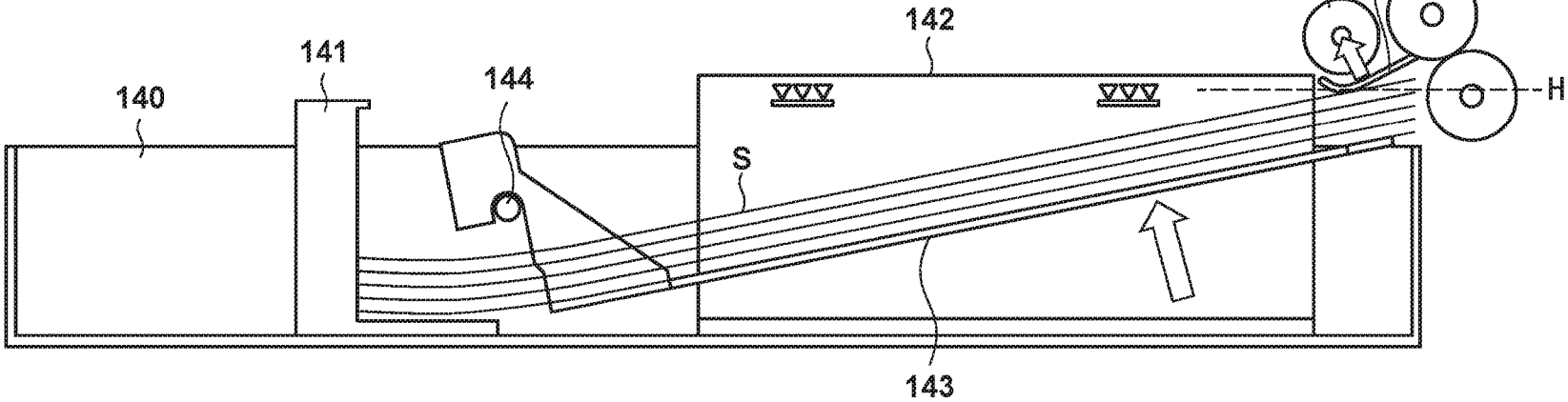

As shown in FIG. 26B, upon detecting that the feed cassette 23 has been inserted into the housing 101 with the cassette sensor 161, the CPU 51 drives the lift-up motor 160 to lift up the intermediate plate 143. As a result, the intermediate plate 143 pivots around the fulcrum 144. When the uppermost sheet S pushes up a surface flag 146, the surface sensor 153 outputs a detection signal indicating that the sheet S has been detected, to the CPU 51. For example, upon the surface of a sheet S reaching the height H as shown in FIG. 26B, the surface sensor 153 outputs the detection signal. The CPU 51 recognizes, based on the detection signal, that the surface of the sheet S has reached the height H, and stops the motor 160. Note that the smaller the number of sheets S stacked on the intermediate plate 143 is, the larger the amount of lifting up of the intermediate plate 143 is, and the longer the operating time of the motor 160 is. On the contrary, the larger the number of stacked sheets S is, the smaller the amount of lifting up of the intermediate plate 143 is, and the shorter the operating time of the motor 160 is. That is to say, the CPU 51 can estimate the number of sheets stacked on the intermediate plate 143 by estimating/measuring the operating time of the motor 160 using a timer or a counter. Every time a sheet S is fed to the conveyance path, the position of the surface of the uppermost sheet S stacked on the intermediate plate 143 lowers. When the surface sensor 153 no longer detects the surface of a sheet S, the CPU 51 again drives the motor 160 and lifts up the sheets S.

Thus, by providing the rear end regulating plate 141 and the like, sheets S stacked in the feed cassette 23 are always fed from the same position in the conveyance direction, without depending on the number of stacked sheets S. Furthermore, by lifting up the intermediate plate 143, the pressure applied to the sheets S by the pickup roller 35 is always kept at a constant, without depending on the number of stacked sheets.

The feed cassette 23 is provided with an upper limit value of the height of a bundle of sheets S (upper limit sheet number). In terms of design, it is ensured that the image forming apparatus 100 can normally form an image if the height of the bundle of sheets S is smaller than or equal to the upper limit value. As shown in FIG. 27, a side surface of each side regulating plate 142 is provided with a mark 72 indicating the upper limit value. The mark 72 may be adhered, or may be a groove.

Figure 27:
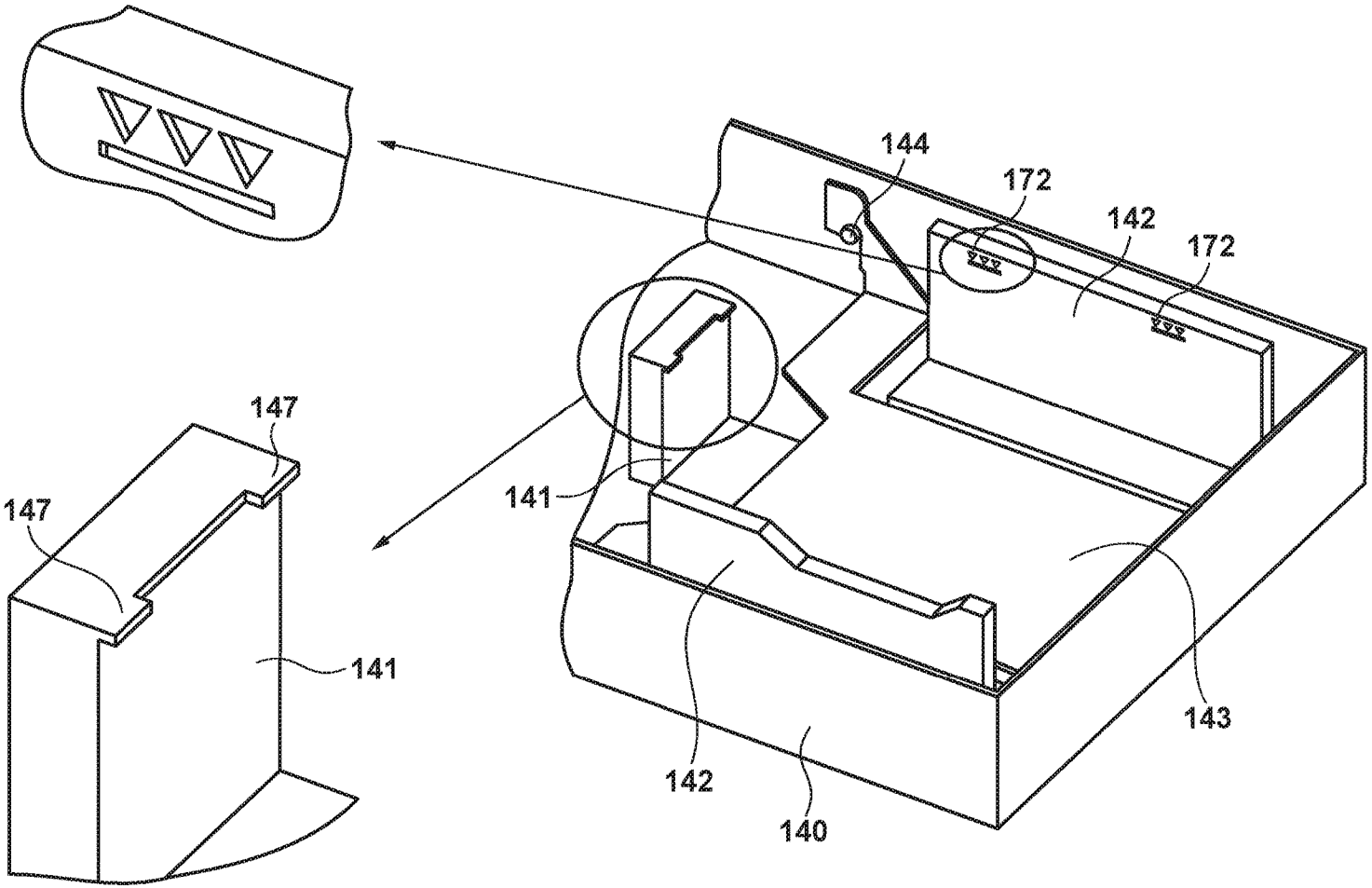
FIG. 27 is a perspective view showing a side regulating plate, an intermediate plate, a rear end regulating plate, and a locking claw.

As shown in FIG. 27, two locking claws 147 are provided in the rear end regulating plate 141. The locking claws 147 suppress sheets S riding up onto the side regulating plate 141. If sheets S ride up onto the rear end regulating plate 141, the sheets S that have ridden up shift to the upstream side (rearward) in the conveyance direction. As a result, the conveyance time T estimated/measured by the sheet sensor 52 becomes longer than the normal conveyance time of sheets S. This may cause an error when detecting over stacking based on the conveyance time T or estimating the length of sheets S in the conveyance direction based on the conveyance time T. Accordingly, the locking claws 147 are provided in the rear end regulating plate 141. Note that the height of the surfaces of the locking claws 147 that face the surface of sheets S is roughly the same as the upper limit value of the height of a bundle of the sheets S.

As described above, the position sensor 154 is provided to detect the position at which the rear end regulating plate 141 is located corresponding to the size of the sheets S. The CPU 51 identifies the size of the sheets S stacked in the feed cassette 23 based on the position of the rear end regulating plate 141 detected by the position sensor 154. However, although the accuracy of sheet size identification is high if the rear end regulating plate 141 is correctly positioned in accordance with the sheet size, the identification result will be incorrect if the rear end regulating plate 141 is positioned so as to be separate from the rear end of the sheets S. Accordingly, the CPU 51 may identify the sheet size by also using sheet size information that is input through the input device of the operation unit 59, sheet size information received from a host computer through the communication device 58, sheet size information obtained based on the conveyance time T, or the like.

[Over Stacking in Feed Cassette]

A state where sheets S are over-stacked in the feed cassette 23 will be described in detail. Here, a description will be given of the case of over stacking where sheets S are stacked on the locking claws 147 and the case of over stacking where the sheets S are forcibly stacked below the locking claws 147.

Case where Sheets S are Stacked on the Locking Claws 147

Figure 28:
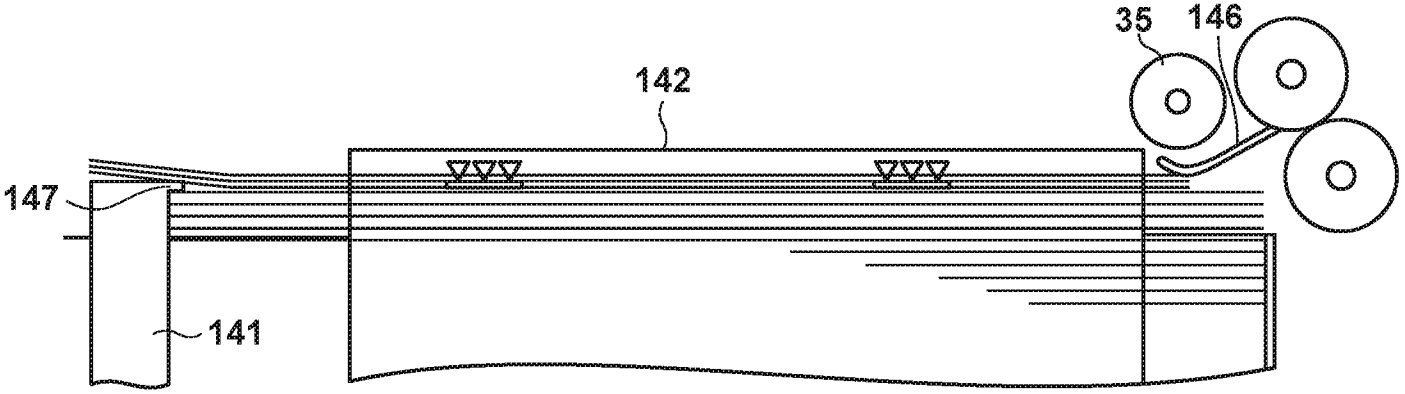
FIG. 28 is a diagram showing exemplary over stacking.

As shown in FIG. 28, if a large number of sheets S are stacked to a height that exceeds the upper value in design, some sheets ride up onto the locking claws 147. Note that the upper limit sheet number corresponding to the upper limit value varies depending on the thickness of the sheets S. Since the positions in the conveyance direction of some sheets S that have ridden up onto the locking claws 147 are not regulated by the rear end regulating plate 141, these sheets S shift to the upstream side in the conveyance direction (i.e., in the direction opposite to the conveyance direction).

Figure 29A:
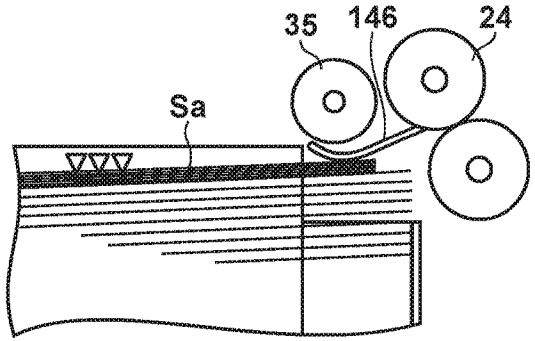
FIGS. 29A to 29D are diagrams showing behavior of over-stacked sheets.
Figure 29B:
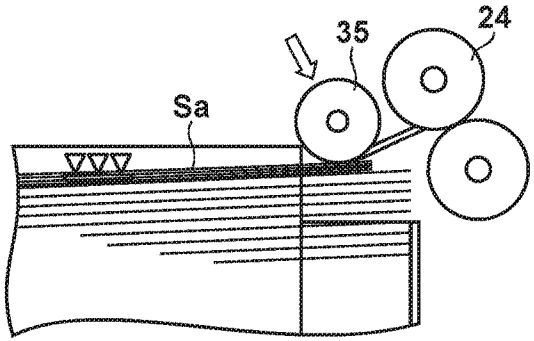
Figure 29C:
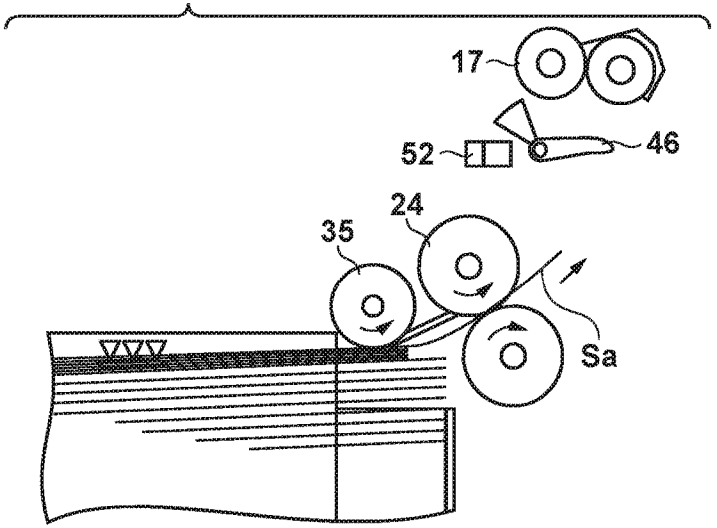
Figure 29D:
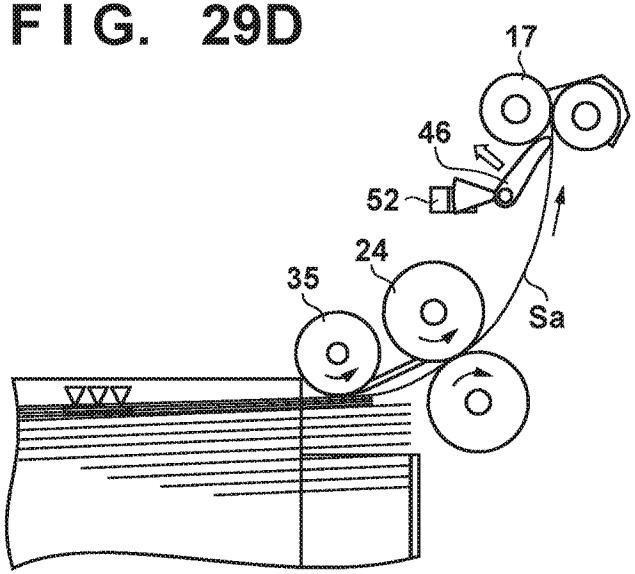

FIGS. 29A to 29D show the behavior of the sheets S when a small amount of sheets S are over-stacked on the locking claws 147. As shown in FIG. 29A, the leading ends of sheets Sa that are over-stacked so as to ride up onto the locking claws 147 are located while shifting in the direction opposite to the conveyance direction. Note that the pickup roller 35 is not in contact with the sheet Sa at a point before conveyance is started. As shown in FIG. 29B, the CPU 51 brings the pickup roller 35 into contact with the over-stacked sheets Sa by lifting up the intermediate plate 143 or lowering the pickup roller 35. The pickup roller 35 is lifted up and lowered by a drive source such as a motor or a solenoid that is driven by the CPU 51. Note that, as shown in FIG. 29B, the amount of shift of the over-stacked sheets S in the conveyance direction is small, and therefore, the pickup roller 35 can come into contact with the uppermost sheet Sa in the bundle of the sheets S. Accordingly, as shown in FIG. 29C, the sheet S to be fed by the pickup roller 35 is the uppermost sheet Sa. As shown in FIG. 29D, the leading end of the fed sheet Sa pushes down the flag 46, and further abuts against a nip portion of the registration roller 17.

Note that at the timing at which the CPU 51 outputs a control signal for instructing the drive circuit 56 to feed sheets, the leading end position of the sheet Sa is upstream of the leading end position of normally stacked sheets S. That is to say, the conveyance distance from the leading end position of the sheets Sa to the flag 46 is longer than the conveyance distance from the leading end position of the normally stacked sheets S to the flag 46. That is to say, the conveyance time T of the sheets Sa is longer than the conveyance time of the normally stacked sheets S. The normally stacked sheets S are sheets S that constitute a sheet bundle whose height is lower than or equal to the upper limit value. That is to say, the normally stacked sheets S are sheets S that are stacked at an expected position in both the conveyance direction and the height direction in terms of design.

Figure 30A:
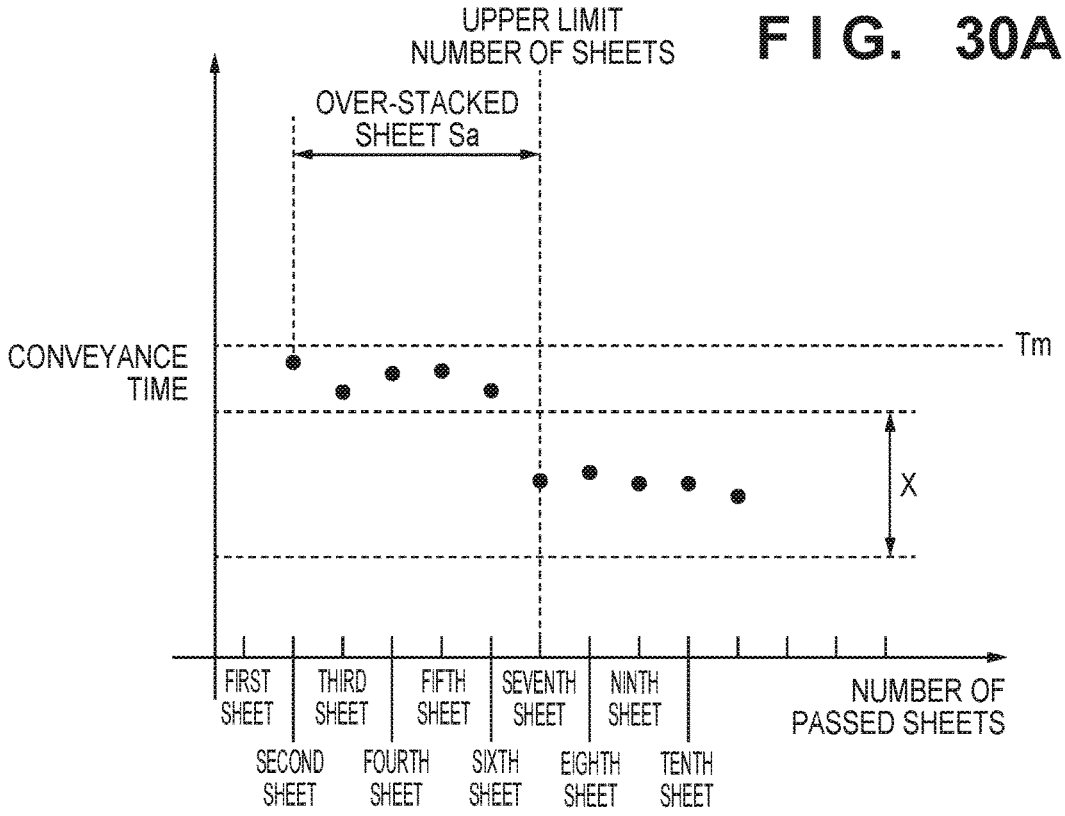
FIGS. 30A and 30B are diagrams showing exemplary conveyance time of over-stacked sheets.
Figure 30B:
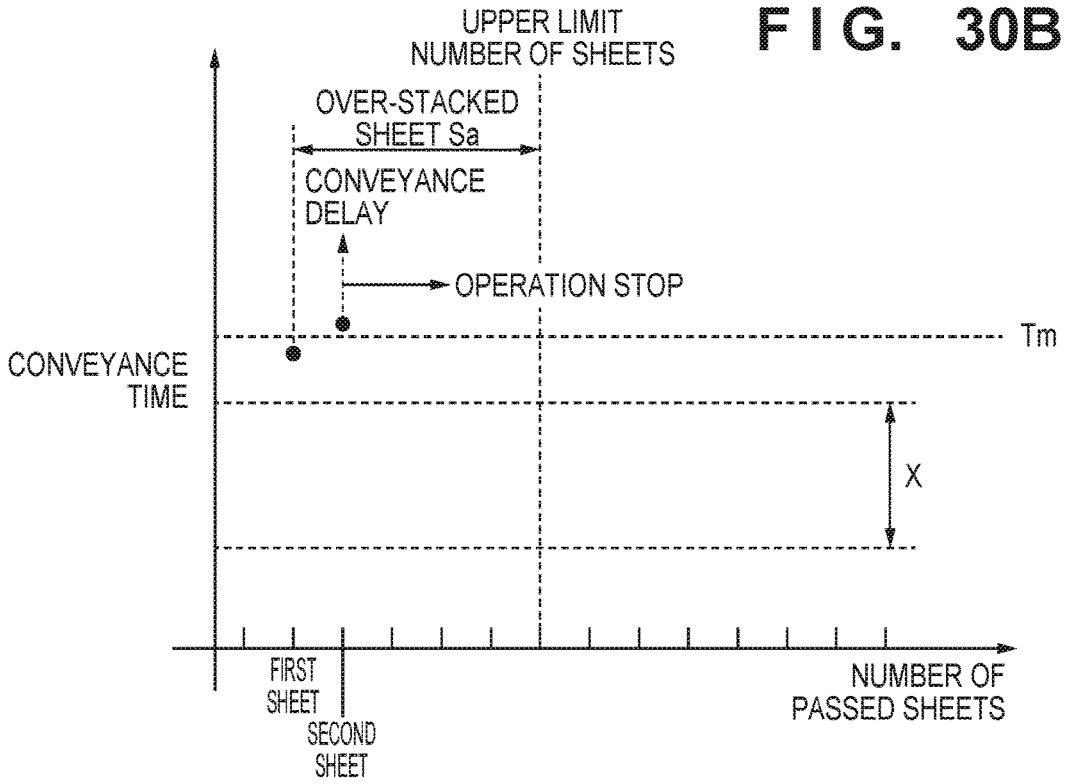

As shown in FIG. 30A, although the conveyance time T of five over-stacked sheets Sa exceeds the upper limit value of the tolerance X, this conveyance time T does not exceed the delay threshold value Tm for determining the conveyance delay. Since the sixth and subsequent sheets S are normally stacked, the conveyance time T of these sheets stays within the tolerance X. However, if the conveyance time T deviates from the tolerance X and further exceeds the delay threshold value Tm as shown in FIG. 30B, the CPU 51 determines that a conveyance delay (conveyance error) has occurred, and stops image formation after discharging all sheets S existing on the conveyance path.

Figure 31A:
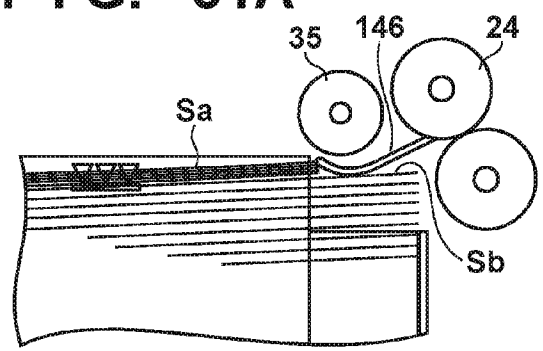
FIGS. 31A to 31D are diagrams showing behavior of over-stacked sheets.
Figure 31B:
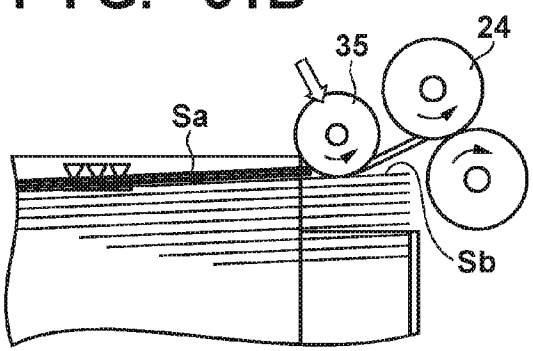

On the other hand, as shown in FIG. 31A, there are cases where the amount of over-stacked sheets S further increases, and the over-stacked sheets Sa are stacked while further shifting to the downstream side. As shown in FIG. 31B, the pickup roller 35 cannot come into contact with the sheets Sa even after having been lowered, and comes into contact with a sheet Sb that is stacked below the sheets Sa. The sheet Sb is stacked below the locking claws 147, and therefore stacked at a normal position in the conveyance direction. For this reason, the sheet to be picked up when the pickup roller 35 starts to rotate is the sheet Sb. Upon the sheet Sb starting to move, an over-stacked sheet Sa stacked on the sheet Sb is conveyed together with the sheet Sb still on the sheet Sb.

Figure 31C:
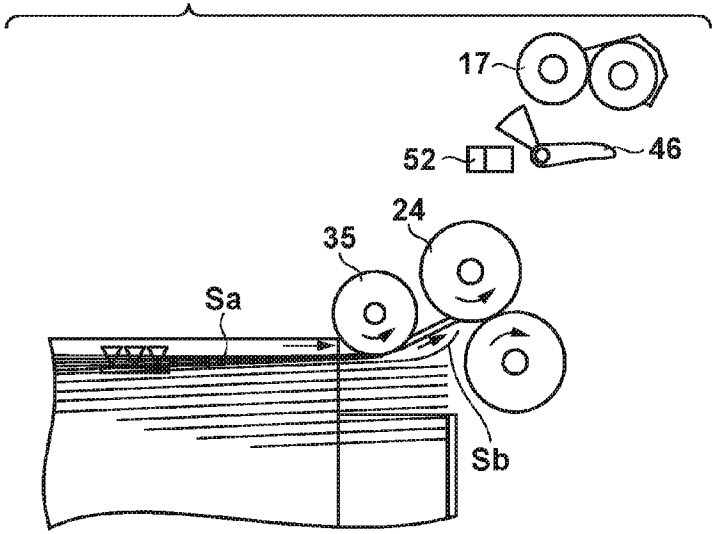
Figure 31D:
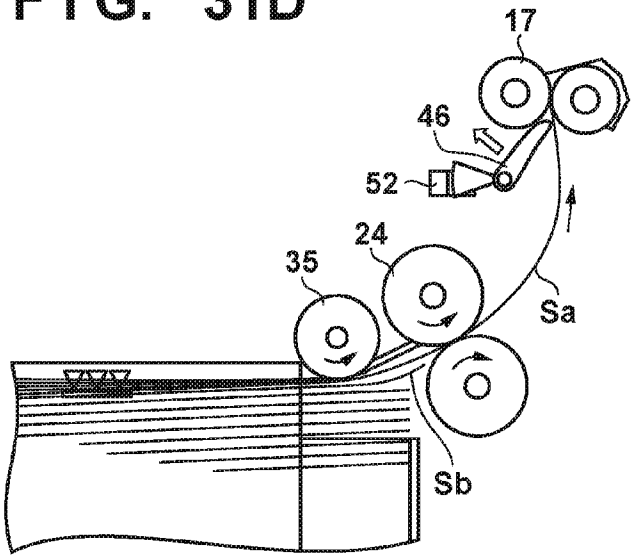

As shown in FIG. 31C, if the over-stacked sheet Sa comes into contact with the pickup roller 35, the sheet Sb loses contact with the pickup roller even though it has not reached the feed roller 24, and stops at this place. As shown in FIG. 31D, only the sheet Sa is conveyed by the pickup roller 35, and reaches the flag 46. Note that second and subsequent over-stacked sheets Sa are conveyed to a position where these sheets Sa can come into contact with the pickup roller 35, as shown in FIGS. 31C and 31D. That is to say, the behavior thereafter is the same as the behavior of the sheet Sa described using FIGS. 29A to 29D.

As shown in FIG. 31A, the leading end position of the uppermost sheet Sa in over-stacked sheets Sa is shifted to the upstream side in the conveyance direction relative to the leading end position of the normally stacked sheet Sb. Accordingly, the conveyance time T of the sheets Sa is longer than the conveyance time T of the sheet Sb. Accordingly, the CPU 51 can determine whether or not over stacking has occurred based on the conveyance time T of the sheets Sa.

[Over Stacking Determination]

Figure 32:
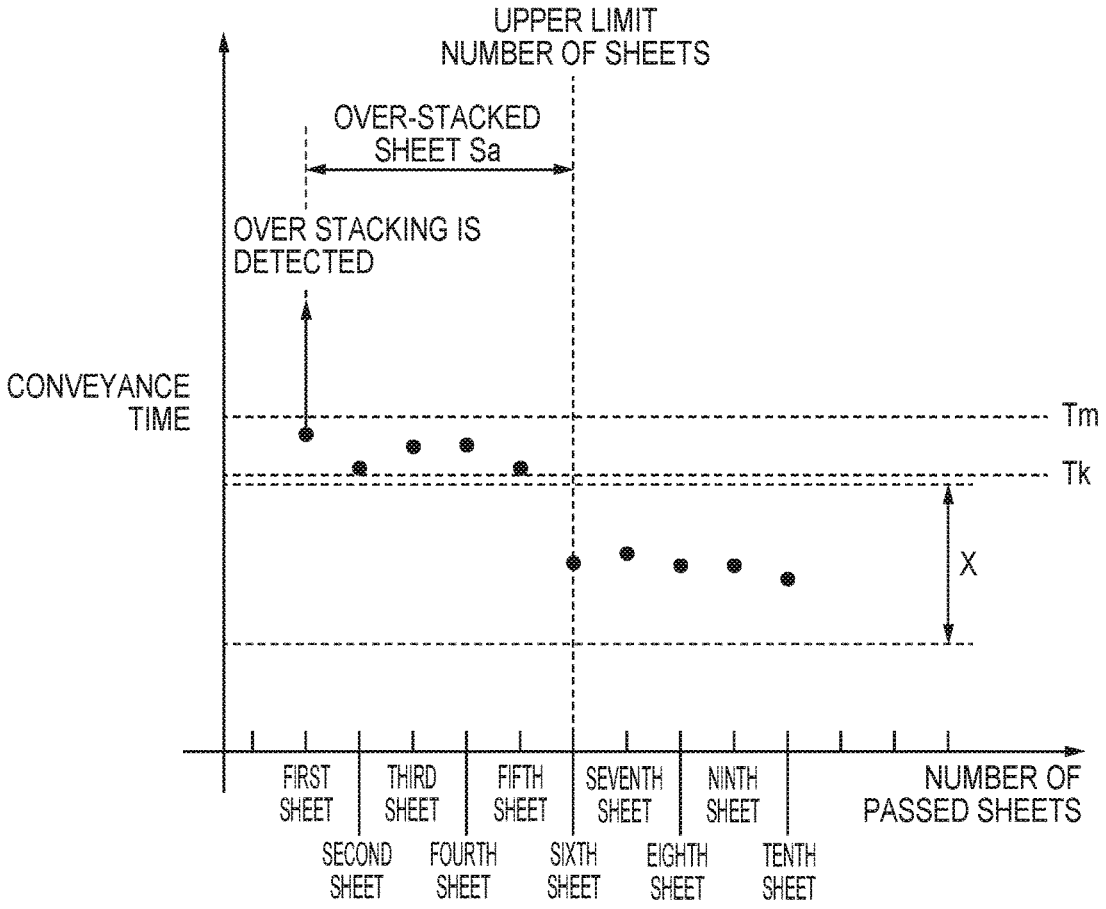
FIG. 32 is a diagram showing a relationship between a threshold value for over stacking and conveyance time.

A procedure for determining over stacking in the feed cassette 23 will be described in detail. As mentioned above, the conveyance time T of the over-stacked sheets Sa is longer than the conveyance time T of the normally stacked sheets S, but does not exceed the delay threshold value Tm. Therefore, an over stacking threshold value Tk is defined as shown in FIG. 32. The over stacking threshold value Tk is larger than or equal to the upper limit value of the tolerance X, and is smaller than the delay threshold value Tm. The CPU 51 determines whether or not over stacking has occurred by comparing the conveyance time T of a sheet S detected using the sheet sensor 52 with the over stacking threshold value Tk. That is to say, if the conveyance time T of a sheet S exceeds the over stacking threshold value Tk, the CPU 51 determines that this sheet S is an over-stacked sheet. Furthermore, if the conveyance time T of a sheet S does not exceed the over stacking threshold value Tk, the CPU 51 determines that this sheet S is a normally stacked sheet. Thus, the CPU 51 can detect, as an over-stacked sheet, a sheet that is not delayed to the extent that it is determined that a conveyance delay has occurred. Note that if the conveyance time T of a sheet S that is conveyed secondly or subsequently after an image forming job is started exceeds the delay threshold value Tm, the CPU 51 determines that a conveyance delay has occurred, and also determines that over stacking has occurred.

Conditions for Executing Over Stacking Determination (1) The CPU 51 may not always execute over stacking determination, and may execute over stacking determination when execution conditions are satisfied. Several execution conditions are conceivable. In order to stack a sheet S in the feed cassette 23, the operator needs to pull out and push in the feed cassette 23 from/to the housing of the image forming apparatus 100. Accordingly, the CPU 51 executes over stacking determination for the first fed sheet S after the cassette sensor 161 detects the pulling out or pushing in of the feed cassette 23. That is to say, the execution condition is that the sheet S is the first sheet S that is fed after the pulling out and pushing in of the feed cassette 23 has been detected. This is because, if sheets S are over-stacked, over stacking is always detected for the first sheet S, and over stacking will not be detected for the first time at the time of a second or subsequent sheet S even though over stacking did not detected for the first sheet S. Thus, the accuracy of the over stacking determination is improved by applying the over stacking determination only on the first sheet S after the feed cassette 23 is inserted. For example, in the case of control for always executing the over stacking determination, over stacking may be erroneously detected even though a conveyance delay has been caused by other factors. Accordingly, if the over stacking determination is executed only when the execution condition is satisfied, over stacking can be more accurately detected.

(2) An execution condition may be employed as such that the difference between the height of sheets S estimated from the operating time of the lift-up motor 160 and the upper limit value for assuring the operation is smaller than or equal to a predetermined threshold value. When over stacking has occurred, the height of the sheet S is close to the upper limit value. Accordingly, in a case where the height of sheets S is greatly lower than the upper limit value, it is unlikely that over stacking has occurred. Also, if over stacking determination is executed in such a situation, it may be determined that over stacking has occurred even though a conveyance delay has been caused by other factors. Accordingly, over stacking can be more accurately detected with the execution condition that the height of sheets S is close to the upper limit value.

Figures 33A, 33B:
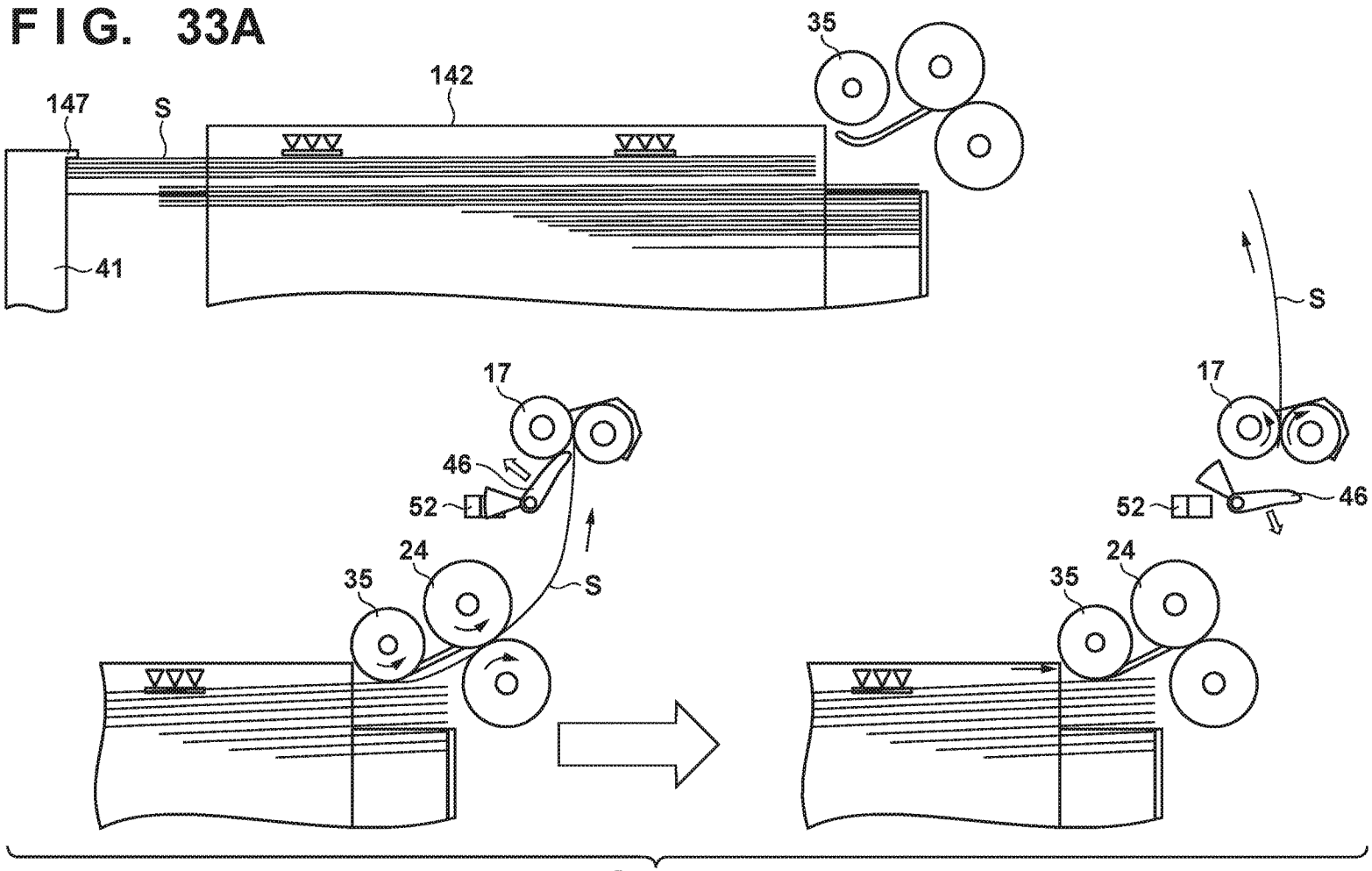
FIGS. 33A and 33B are diagrams showing behavior of over-stacked sheets.

(3) As shown in FIG. 33A, if the rear end regulating plate 141 is located at a position separate from the rear end of sheets S, the sheets S will be located at a position that is shifted in the direction opposite to the conveyance direction. As a result, even the conveyance time T of a sheet S that is not over-stacked will exceed the over stacking threshold value Tk. Therefore, an execution condition that the rear end regulating plate 141 is located in a correct position may be employed. This execution condition can reduce the likelihood of the conveyance time T becoming long due to the rear end regulating plate 141 being arranged in an incorrect position and results in erroneous detection of over stacking. The following method is conceivable as a method for determining whether or not the rear end regulating plate 141 is located in a correct position.

As shown in FIG. 33B, the CPU 51 converts time Tp taken from when the leading end of a sheet S reaches the flag 46 until the rear end of the sheet S passes the flag 46 into the size (length in the conveyance direction) of the sheet S. The length L in the conveyance direction is calculated by multiplying the conveyance speed v of the sheet S by the time Tp. On the other hand, the CPU 51 detects the position of the rear end regulating plate 141 using the position sensor 154, and converts this position into the size of the sheet S. The CPU 51 compares the size acquired using the sheet sensor 52 with the size acquired using the position sensor 154. If the size acquired using the sheet sensor 52 is smaller than the size acquired using the position sensor 154, the CPU 51 determines that the rear end regulating plate 141 is arranged in an incorrect position. Alternately, the CPU 51 may compare the size designated by the operation unit 59 or the host computer with the size acquired using the position sensor 154. If the size designated by operation unit 59 or the host computer is smaller than the size acquired using the position sensor 154, the CPU 51 determines that the rear end regulating plate 141 is arranged in an incorrect position.

(4) As the number of sheets S on which images are formed increases, roller surfaces of the pickup roller 35 and the feed roller 24 are worn down, resulting in a decrease of the roller diameter and a decrese of frictional resistance with respect to the sheets S. As the rollers are further worn down, the conveyance distance of each sheet S that is conveyed by rotating the rollers once decreases. Accordingly, the conveyance time T of sheets S of the same size gradually becomes longer. That is to say, the smaller the degree of wear of a contact member that forms the surface of each roller is, the higher the accuracy of the over stacking determination based on the conveyance time T is. Therefore, the degree of wear of the rollers being small may be employed as the execution condition. The accuracy of the over stacking determination is improved by executing the over stacking determination only when the rollers are not too worn down.

In the image forming apparatus according to this embodiment, if the rollers (contact members) are worn to the extent that a conveyance delay is caused, a phenomenon in which the conveyance time of a sheet S exceeds the over stacking threshold value Tk at least once in 500 sheets S, which corresponds to one cassette in this embodiment, even in the case where sheets are not over-stacked, occurs five consecutive times or more.

Therefore, in this embodiment, if the phenomenon in which the conveyance time of a sheet S exceeds the over stacking threshold value Tk at least once among M sheets (e.g., 500 sheets) occurs N (e.g., five) consecutive times or more, the CPU 51 determines that the degree of wear of the pickup roller 35 and/or the feed roller 24 exceeds the tolerance thereof. The tolerance of the degree of wear is determined from the viewpoint of the accuracy of the over stacking determination accuracy. Thus, if the degree of wear exceeds the tolerance, the CPU 51 interrupts the over stacking determination. N and M are determined in advance by simulation or experiments.

Note that the CPU 51 may resume over stacking determination if the pickup roller 35 and/or the feed roller 24 is replaced. If the pickup roller 35 and/or the feed roller 24 is not in a state of being too worn to cause a conveyance delay, erroneous detection of over stacking does not occur on even a single sheet S in K (e.g., 4000) sheets S. That is to say, the conveyance time of none of the K sheets S will exceed the over stacking threshold value Tk. Therefore, if the CPU 51 interrupts over stacking determination as a result of the determination that wear has occurred, the CPU 51 may determine whether or not the pickup roller 35 and/or the feed roller 24 has been replaced with a new one based on whether or not the conveyance time of each of the K consecutive sheets S does not exceed the over stacking threshold value Tk. If the conveyance time of each of the K consecutive sheets S does not exceed the over stacking threshold value Tk, the CPU 51 resumes over stacking determination. Note that if information indicating that the pickup roller 35 and/or the feed roller 24 has been replaced with a new one is input through the operation unit 59, the CPU 51 may resume over stacking determination. K is determined in advance by simulations or experiments.

Flowchart

As mentioned above, FIG. 16 is a flowchart showing over stacking determination. Upon an instruction to form an image being input through the operation unit 59 or a host computer, the CPU 51 executes the following processing.

In step S1, the CPU 51 starts to feed a sheet S. For example, the CPU 51 outputs a control signal (feed start signal) to the drive circuit 56 to start driving the motor 57. The drive circuit 56 starts to drive the motor 57 based on the control signal. Note that the sheet S is fed from a feeding port (the feed cassette 23 or the manual bypass tray 38) designated by a job.

In step S2, the CPU 51 starts to count the conveyance time T using a timer or a counter.

In step S3, the CPU 51 determines whether or not to execute over stacking determination based on whether or not the conditions for executing over stacking determination are satisfied. Although several conditions have been listed as the execution conditions, the CPU 51 determines to execute over stacking determination when all of the above conditions are satisfied. Alternatively, the CPU 51 may determine to execute over stacking determination when one or a plurality of conditions are satisfied. Upon determining not to execute over stacking determination, the CPU 51 causes the image forming unit to form an image unless the CPU 51 detects a conveyance delay based on the delay threshold value Tm or detects a jam based on the jam threshold value Tj. If the CPU 51 detects a conveyance delay, the CPU 51 stops image formation after all sheets on the conveyance path are discharged from the image forming apparatus 100. Also, if the CPU 51 detects a jam, the CPU 51 stops image formation. The CPU 51 may also output a message regarding the conveyance delay or the jam to the operation unit 59. The CPU 51 may output a message for giving advice about an upper limit stacking amount and a correct stacking manner of the sheets S to the operation unit 59. In step S3, if the conditions for executing the over stacking determination are not satisfied, the CPU 51 ends this processing. On the other hand, if, in step S3, the conditions for determining the over stacking determination are satisfied, the CPU 51 proceeds to step S4.

In step S4, the CPU 51 determines whether or not sheets S are over-stacked in the feed cassette 23 based on whether or not the conveyance time T exceeds the over stacking threshold value Tk. In step S4, if over stacking is not detected, the CPU 51 ends this processing. That is to say, the CPU 51 continues image formation. On the other hand, if the CPU 51 determines that the conveyance time T exceeds the over stacking threshold value Tk, the CPU 51 proceeds to step S5.

In step S5, the CPU 51 outputs an over stacking message. The CPU 51 stops image formation after all sheets S that exist on the conveyance path are discharged. The CPU 51 can detect that all sheets S existing on the conveyance path have been discharged using a sheet sensor (not shown) installed in a discharge portion on the conveyance path, for example.

Erasing of Over Stacking Message

Figure 34:
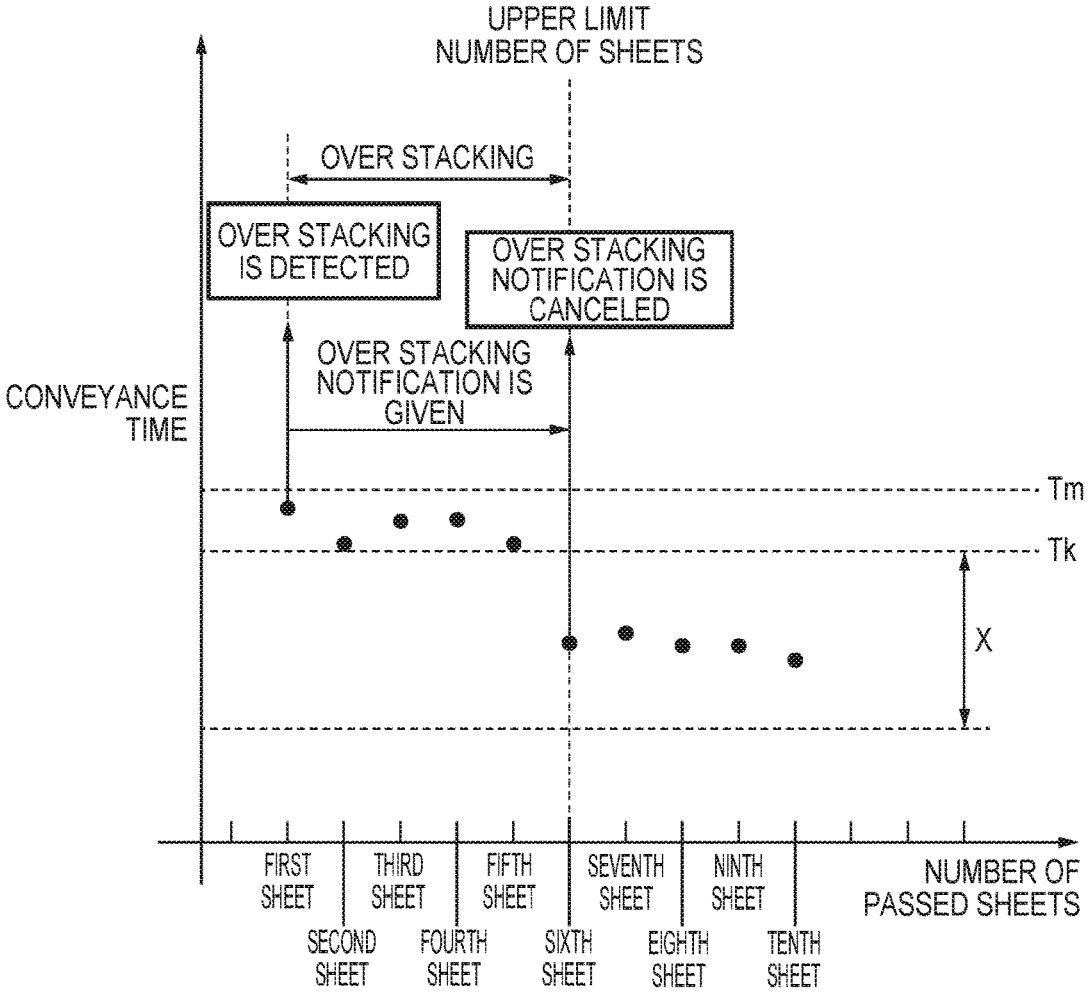
FIG. 34 is a diagram illustrating cancellation of an over stacking notification.

After the over-stacked state is resolved, the CPU 51 stops the output of the over stacking message, or erases the over stacking message. A condition for stopping the output of the over stacking message or erasing the over stacking message will be called a resolution condition. Alternatively, the CPU 51 displays a resolution message indicating that the over-stacked state has been resolved on the operation unit 59, or transmits the resolution message via the communication device 58. The resolution condition may be that the cassette sensor 161 detects the execution of the pulling out and pushing in of the feed cassette 23. Also, as shown in FIG. 34, if the conveyance time T of a sheet S becomes smaller than or equal to the over stacking threshold value Tk in a state where the over stacking message (over stacking information) is output, the CPU 51 may stop the output of the over stacking message. The degree of over stacking decreases every time a sheet S is conveyed. Accordingly, if the conveyance time T of a sheet S falls below the over stacking threshold value Tk, it is likely that the over-stacked state has been resolved. Thus, the conveyance time T of a sheet S falling below the over stacking threshold value Tk may be employed as the resolution condition.

Embodiment 5

Figure 35A:
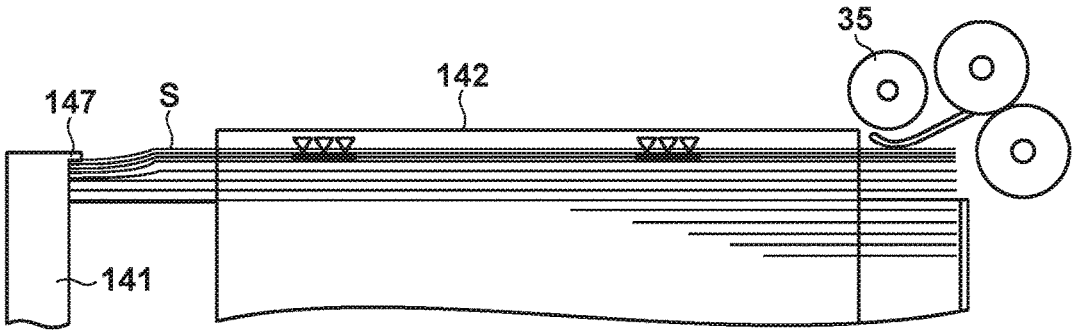
FIGS. 35A and 35B are diagrams showing a method for determining over stacking when a jam has occurred.

According to Embodiment 1, if the conveyance time T exceeds the over stacking threshold value Tk, the CPU 51 determines that over stacking has occurred. Incidentally, over stacking occurs even if sheets S are stacked below the locking claws 147 in some cases. As shown in FIG. 35A, if sheets S, the number of which exceeds the upper limit sheet number, are forcibly pushed in below the locking claws 147, the rear end portion of the sheets S is strongly held down by the locking claws 147. For this reason, the conveyance resistance exerted onto the sheets S is larger than the conveyance resistance applied to sheets S that are not over-stacked. In particular, there are cases where the conveyance resistance becomes so large that the pickup roller 35 cannot convey sheets S. If the leading end of a sheet S is not detected by the sheet sensor 52 even though the elapsed time since paper feeding was started exceeds the jam threshold value Tj, the CPU 51 determines that a jam has occurred.

The counting of the conveyance time T can also be designed to be completed only after the leading end of a sheet S reaches the flag 46. In this case, in a state where no sheet S can be fed, the conveyance time T cannot be counted, and the CPU 51 cannot determine over stacking. In this embodiment, the following over stacking determination method is introduced.

[Over Stacking Determination Method]

An over stacking determination method according to Embodiment 5 will be described using the flowchart in FIG. 20. Compared with FIG. 16, in FIG. 20, steps S10 and S11 are inserted between steps S2 and S3.

In step S10, the CPU 51 determines whether or not a jam has occurred. For example, the CPU 51 determines that a jam has occurred when the leading end of a sheet S cannot be detected by the sheet sensor 52 even if a retry has been executed J times. If a jam has not occurred, the CPU 51 proceeds to step S3. On the other hand, if a jam is detected, the CPU 51 proceeds to step S11.

Figure 35B:
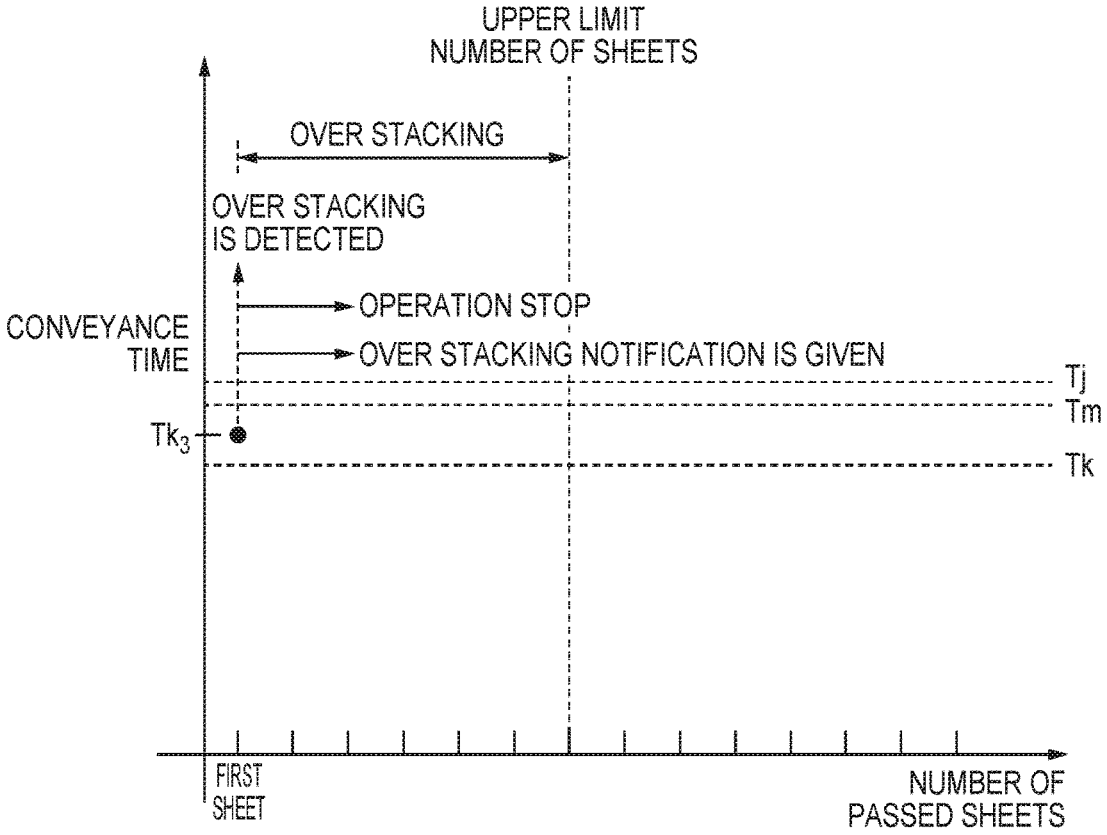

In step S11, the CPU 51 forcibly substitutes a predetermined value Tk3 with the conveyance time T. As shown in FIG. 35B, the predetermined value Tk3 is a value that is smaller than a delay threshold value Tm for detecting a conveyance error and larger than the over stacking threshold value Tk. Thus, the conveyance time T is ascertained even if a sheet S does not reach the flag 46. Moreover, since the predetermined value Tk3 that is larger than the over stacking threshold value Tk is substituted with the conveyance time T, over stacking is detected in step S4. Thus, in Embodiment 5, over stacking can be detected even if a jam occurs on the first sheet S.

Embodiment 6

Figure 36A:
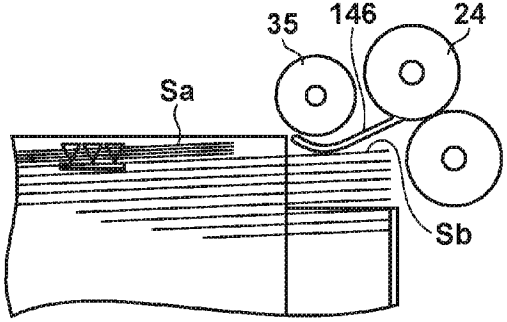
Figure 36B:
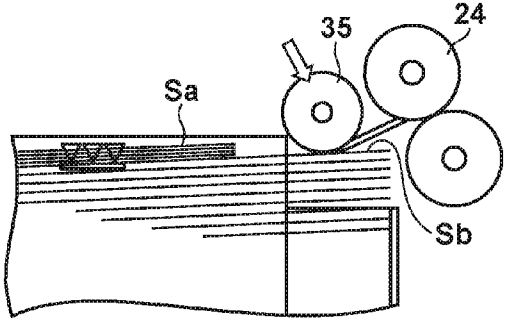
Figure 36B:
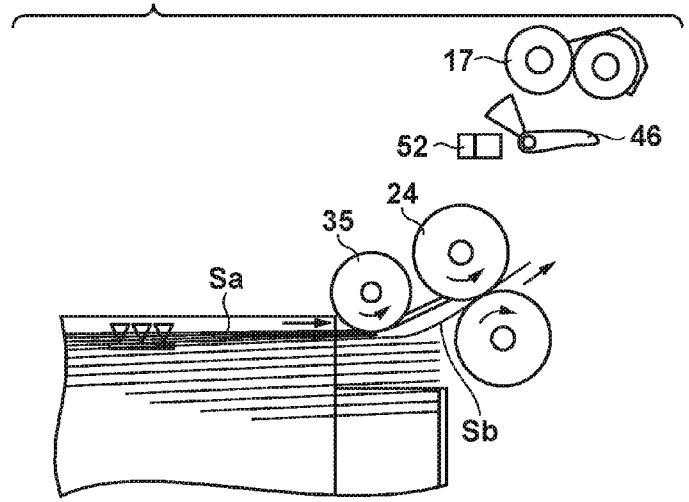
Figure 36D:
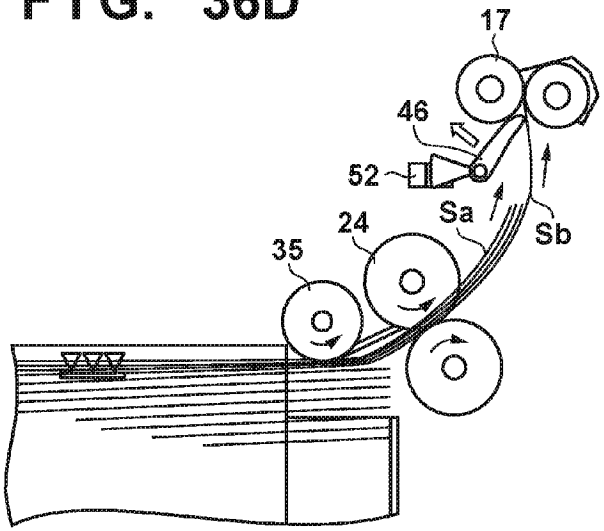

As shown in FIG. 36A, at least some of the over-stacked sheets S ride up onto the locking claws 147 and are significantly shifted in the direction opposite to the conveyance direction in some cases. As shown in FIG. 36B, since the pickup roller 35 is not in contact with an uppermost sheet Sa, a sheet Sb is fed by the pickup roller 35. As shown in FIG. 36C, the sheet Sa is also conveyed together with the sheet Sb, and the Sa reaches the feeding position of the pickup roller 35. At this point, the sheet Sb has already reached the nip portion of the feed roller 24. Accordingly, as shown in FIG. 36D, the sheet Sa and the sheet Sb continue to be conveyed thereafter. This phenomenon is called double feeding. The conveyance time T counted by the CPU 51 is a period from the timing at which feeding is started until the timing at which the sheet Sb reaches the flag 46. Accordingly, this conveyance time T is within the tolerance X in some cases. This is because the sheet Sb is conveyed from the regular position. Accordingly, in the case where double feeding occurs, the over stacking cannot be correctly determined based on the conveyance time T.

[Over Stacking Determination]

The CPU 51 can identify that double feeding has occurred when the size that is designated in advance is different from the size that is measured using the sheet sensor 52. Therefore, the CPU 51 determines that over stacking has occurred when the size of a sheet S acquired using the sheet sensor 52 is larger than the size corresponding to the position of the rear end regulating plate 141 detected by the position sensor 154.

Figure 37B:
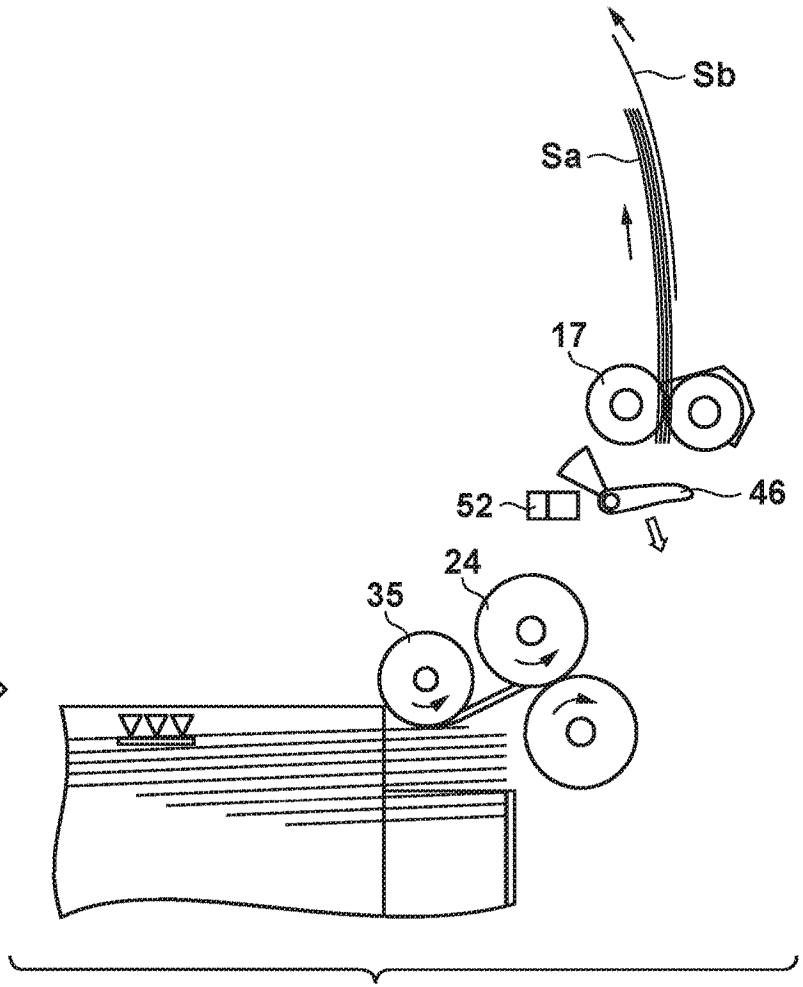
FIGS. 37A and 37B are diagrams illustrating double feeding of over-stacked sheets.
Figure 37A:
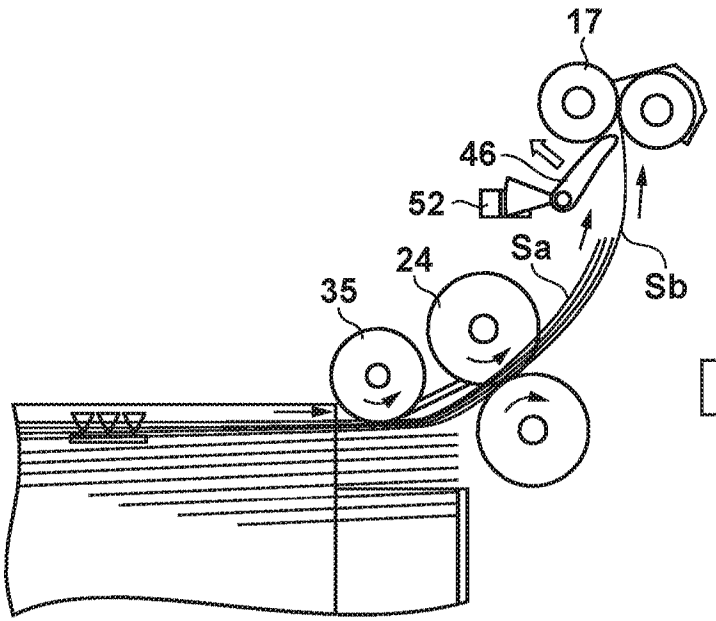

As mentioned above, the CPU 51 can detect the size in the conveyance direction based on the elapsed time from the timing at which the sheet sensor 52 detects the leading end of a sheet S until the timing at which the sheet sensor 52 detects the rear end thereof. As shown in FIG. 37A, the CPU 51 starts to count the time for obtaining the sheet size at the timing at which the leading end of the sheet Sb reaches the flag 46. As shown in FIG. 37B, the counting of the time is stopped at the timing at which the sheet Sa passes the flag 46, and the counted elapsed time Tp is converted into the sheet size. A conversion formula, a conversion table, or the like may be stored in the storage device 55.

Figure 38A:
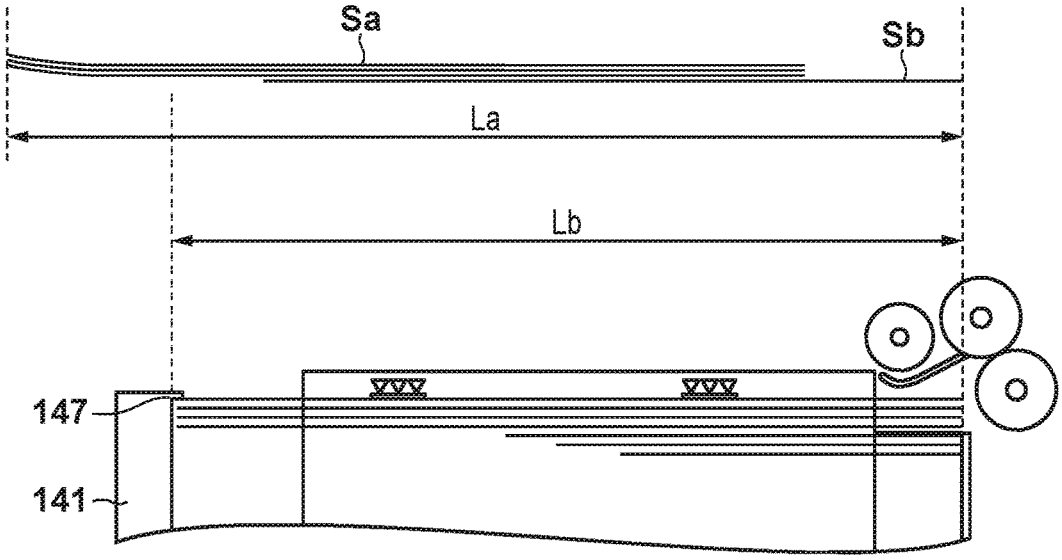
FIGS. 38A and 38B are diagrams showing an exemplary result of measurement of a sheet size in the case of double feeding.

As shown in FIG. 38A, the sheet size obtained by the CPU 51 using the sheet sensor 52 is La. The sheet size obtained by the CPU 51 using the position sensor 154 is Lb. In FIG. 38A, La>Lb holds, and therefore, the CPU 51 determines that over stacking has occurred. Thus, if the sheet sizes disagree (La>Lb), the CPU 51 stops image formation after discharging all sheets S existing on the conveyance path. Furthermore, the CPU 51 outputs information indicating the disagreement of the sheet sizes and information indicating the occurrence of over stacking to the operation unit 59 and the communication device 58.

Conditions for Executing Over Stacking Determination

Figure 38B:
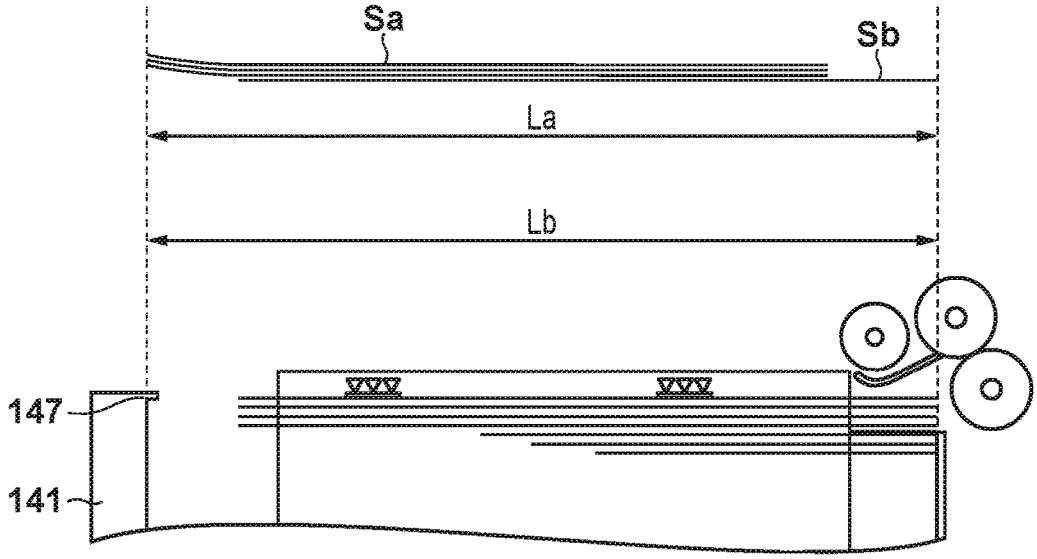

As shown in FIG. 38B, if the rear end regulating plate 141 is positioned while being shifted rearward of the rear end of sheets S, a sheet size La obtained using the sheet sensor 52 agrees with a sheet size Lb obtained using the position sensor 154 in some cases. In such cases, the CPU 51 cannot detect over stacking from the sheet sizes La and Lb.

Therefore, the rear end regulating plate 141 being located in a correct position may be employed as a condition for executing the over stacking determination. As mentioned above, the CPU 51 acquires the information about the sheet size designated by the operator via the operation unit 59 or the communication device 58. Accordingly, the CPU 51 executes over stacking determination if the sheet size designated by the operator agrees with the sheet size Lb obtained using the position sensor 154. On the other hand, the CPU 51 skips the over stacking determination if the sheet size designated by the operator disagrees with the sheet size Lb obtained using the position sensor 154. Thus, over stacking will be accurately detected even if double feeding and over stacking simultaneously occur.

Summary 2

Figure 39:
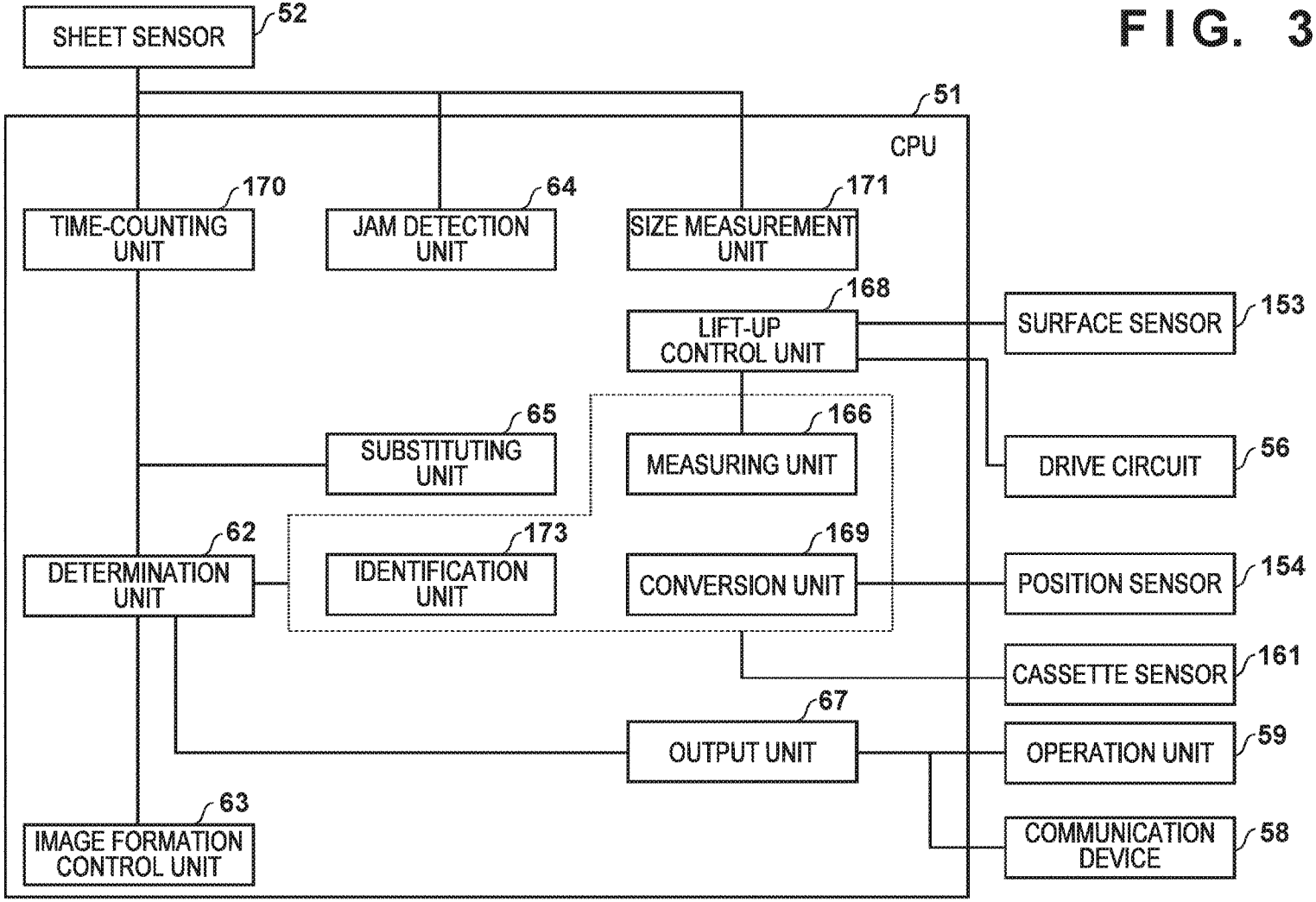
FIG. 39 is a diagram illustrating functions of a CPU.

Functions of the CPU 51 will be described using FIG. 39. As described using FIG. 4 and regarding step S2, a time-counting unit 170 counts the conveyance time T from when the motor 57 and the pickup roller 35 start to convey a sheet S until the sheet S arrives at a predetermined position on the conveyance path. As described regarding step S4 or the like, the determination unit 62 may determine whether or not the conveyance time T of the sheet S, which is conveyed first after the cassette sensor 161 has detected that the feed cassette 23 has been pulled out and pushed in, exceeds the over stacking threshold value Tk. The determination unit 62 determines whether or not sheets S are over-stacked in the feed cassette 23 based on whether or not the conveyance time T exceeds the over stacking threshold value Tk. An image formation control unit 63 controls the image forming unit to form an image on the sheet if the conveyance time T does not exceed the over stacking threshold value Tk. If the conveyance time T of a sheet S exceeds the over stacking threshold value Tk, the image formation control unit 63 controls the image forming unit not to form an image on the sheet S. By thus paying attention to the conveyance time of a sheet without using a sensor for estimating the height of a bundle of sheet S, over stacking of the sheets can be more accurately detected than with conventional techniques.

The jam detection unit 64 may detect the aforementioned conveyance delay. That is to say, the jam detection unit 64 is an exemplary detection unit for detecting that a conveyance delay has occurred on a sheet S based on whether or not the conveyance time of the sheet S exceeds the conveyance delay threshold value. Note that the over stacking threshold value may be the same as the conveyance delay threshold value.

In the design of the image forming apparatus, the maximum stacking height or the maximum number of stacked sheets that ensures normal operation may be defined. Furthermore, the CPU 51 may function as a stacking degree determination unit for determining the degree of stacking of sheets on the feed cassette 23. If the CPU 51 determines that the stacking degree corresponds to a stacking volume within a predetermined range with respect to the stacking height or the number of stacked sheets, the CPU 51 may cause the determination unit 62 to execute determination of whether or not over stacking has occurred. Note that the predetermined range with respect to the stacking height or the number of stacked sheets refers to a range of variation in accuracy with which the stacking degree determination unit can determine the stacking height or the number of stacked sheets, for example.

As described regarding the condition for executing the over stacking determination, the lift-up time required for lifting up of the intermediate plate 143 may be employed as the execution condition. The intermediate plate 143 is a plate member that is lowered to the lowermost portion upon the feed cassette 23 being pulled out of the image forming apparatus. A lift-up control unit 168 controls the motor 160 through the drive circuit 56 and lifts up the intermediate plate 143 such that the sheets S stacked on the intermediate plate 143 come into contact with the pickup roller 35. The measuring unit 166 measures the lift-up time necessary for lifting up the intermediate plate 143. When the lift-up time is smaller than a lift-up threshold value, the CPU 51 determines that the stacking degree corresponds to a stacking volume within the predetermined range with respect to the stacking height or the number of stacked sheets. Thus, when the lift-up time is smaller than the lift-up threshold value, the determination unit 62 determines whether or not sheets S are over-stacked in the feed cassette 23. Over stacking may occur when the number of stacked sheets S is close to the upper limit number. Accordingly, the accuracy of the over stacking determination is improved by activating the over stacking determination in a situation where over stacking is likely to occur. Also, when the lift-up time is not smaller than the lift-up threshold value, the determination unit 62 does not determine whether or not sheets S are over-stacked in the feed cassette 23. Thus, erroneous detection of over stacking in a situation where it is unlikely that over stacking has occurred will be suppressed.

The image forming apparatus 100 may have the surface sensor 153 for detecting whether or not the surface of a sheet S stacked on the intermediate plate 143 has been lifted up to a predetermined height H by the motor 160. Upon the sheet S stacked on the intermediate plate 143 having been lifted up to the predetermined height H, the lift-up control unit 168 stops the motor 160 through the drive circuit 56. Thus, the lifting up of the intermediate plate 143 stops. Accordingly, it is then possible to always maintain the position of the leading end of the sheet a S at the same position, and the accuracy of the measurement of the conveyance time T improves. That is to say, the accuracy of the over stacking determination based on the conveyance time T also improves. Furthermore, it is also possible to maintain the pressure to be applied to the sheets S by the pickup roller 35 at a fixed level.

As described regarding the conditions for executing the over stacking determination, the position of the rear end regulating plate 141 may be employed as the execution condition. The determination unit 62 determines whether or not the rear end regulating plate 141 is correctly positioned with respect to the size of the sheets S stacked in the feed cassette 23. For example, the determination unit 62 determines whether or not the position of the rear end regulating plate 141 detected by the position sensor 154 corresponds to the size of the sheets S stacked in the feed cassette 23. The determination unit 62 executes over stacking determination if the detected position of the rear end regulating plate 141 corresponds to the size of the sheets S. On the other hand, the determination unit 62 does not execute over stacking determination if the detected position of the rear end regulating plate 141 does not correspond to the size of the sheets S. The determination unit 62 may determine that the position of the rear end regulating plate 141 corresponds to the size of the sheets S stacked in the feed cassette 23 when the size of conveyed sheets S agrees with the size of the sheets S obtained based on the position of the rear end regulating plate 141. Also, the determination unit 62 may determine that the position of the rear end regulating plate 141 does not correspond to the size of the sheets S stacked in the feed cassette 23 when the size of the conveyed sheet S does not agree with the size of the sheets S obtained based on the position of the rear end regulating plate 141. More specifically, the size of the sheets S conveyed by the pickup roller 35 can be estimated/measured by a size estimation unit 171. The size estimation unit 171 may be called as a size measuring unit. Furthermore, a conversion unit 169 converts the position of the rear end regulating plate 141 detected by the position sensor 154 into the size of the sheets S (e.g., the length in the conveyance direction). The determination unit 62 determines whether or not sheets S are over-stacked in the feed cassette 23 when the size of the sheets S conveyed from the pickup roller 35 agrees with the size of the sheets S obtained based on the position of the rear end regulating plate 141. On the other hand, the determination unit 62 may not determine whether or not sheets S are over-stacked in the feed cassette 23 if the size of the sheets S conveyed by the pickup roller 35 does not agree with the size of the sheets S obtained based on the position of the rear end regulating plate 141. Thus, since the over stacking determination is executed in a situation where over stacking is likely to occur, the accuracy of the over stacking determination will improve. The image forming apparatus 100 may further have the size estimation unit 171 for estimating/measuring the size of the sheets S conveyed by the pickup roller 35. The determination unit 62 may determine whether or not the execution condition is satisfied by comparing the size of the sheets S estimated/measured by the size estimation unit 171 with the size of the sheets S obtained based on the position of the rear end regulating plate 141. The operation unit 59 and the communication device 58 each may function as an input unit for inputting the size of the sheets S conveyed by the pickup roller 35. The determination unit 62 may determine whether or not the execution condition is satisfied by comparing the input size of the sheets S with the size of the sheets S obtained based on the position of the rear end regulating plate 141.

The image forming apparatus 100 may further have the jam detection unit 64 for determining whether or not a sheet S has jammed based on the elapsed time since the pickup roller 35 started to convey the sheet S. As described using FIG. 20 and the like, the determination unit 62 may determine that sheets S are over-stacked in the feed cassette 23 if a sheet S has jammed. Also, if a sheet does not arrive at a predetermined position on the conveyance path in the period from when conveyance of the sheet is started until the time-counting unit 170 ends the counting of a predetermined time, the determination unit 62 may determine that sheets S are over-stacked. As described using FIG. 20 and the like, if a sheet S has jammed, the substituting unit 65 may cause the determination unit 62 to determine that sheets S are over-stacked in the feed cassette 23 by substituting the conveyance time Y with the predetermined value Tk3 that is larger than the over stacking threshold value Tk. Thus, over stacking determination can be performed even in a situation where the conveyance time T cannot be determined as a result of the occurrence of a jam. Similarly, if a sheet does not arrive at the predetermined position on the conveyance path in a period from when conveyance of the sheet is started until the time-counting unit 170 ends the counting of the predetermined time, the substituting unit 65 may substitute the conveyance time T with the predetermined value Tk3.

As described regarding Embodiment 3, if double feeding occurs, the size of the sheets S conveyed by the pickup roller 35 does not agree with the size of the sheets S obtained based on the position of the rear end regulating plate 141 in some cases. The determination unit 62 determines whether or not the size of the sheets S estimated/measured by the position sensor 154 and the conversion unit 169 agrees with the size of the sheets S that is input through the operation unit 59 or the host computer. If the rear end regulating plate 141 is correctly positioned with respect to sheets S, the estimated/measured size is to agree with the input size. Accordingly, the determination unit 62 may determine, based on the result of this determination, whether or not the rear end regulating plate 141 is correctly positioned with respect to the sheets S. The determination unit 62 determines whether or not the rear end regulating plate 141 is correctly positioned, and whether or not the size of the sheets S estimated/measured by the size estimation unit 171 is larger than the size obtained by the position sensor 154 or the size designated through the operation unit 59 or the like. When the rear end regulating plate 141 is correctly positioned and the size estimated/measured by the size estimation unit 171 is larger than the size estimated/measured by the position sensor 154 and the conversion unit 169 or the designated size, the determination unit 62 may determine that sheets S are over-stacked in the feed cassette 23 even if the conveyance time T does not exceed the over stacking threshold value Tk. For example, as described using FIG. 38A, disagreement of the sheet sizes is likely to occur if sheets S are over-stacked on the locking claws 147. Therefore, the determination unit 62 may determine whether or not over stacking has occurred based on agreement/disagreement of the sheet sizes.

As described regarding the execution conditions, an identification unit 173 for identifying whether or not the pickup roller 35 has deteriorated may further be provided. If the pickup roller 35 has not deteriorated, the determination unit 62 determines whether or not sheets S are over-stacked in the feed cassette 23. On the other hand, if the pickup roller 35 has deteriorated, the determination unit 62 does not determine whether or not sheets S are over-stacked in the feed cassette 23. If the pickup roller 35 and/or the feed roller 24 have deteriorated, the conveyance time T becomes long. Accordingly, the accuracy of the over stacking determination based on the conveyance time T may decrease. Therefore, the determination unit 62 may increase the determination accuracy by executing the over stacking determination only when the pickup roller 35 or the like has not deteriorated. The identification unit 173 may determine that the pickup roller 35 has deteriorated if a phenomenon in which the conveyance time of sheets S exceeds the over stacking threshold value Tk at least once among M sheets (e.g., 500 sheets) has occurred N (e.g., five) consecutive times. That is to say, it is determined whether or not a phenomenon in which the conveyance time exceeds the over stacking threshold value at least once in a first predetermined number of sheets has consecutively occurred a predetermined number of times. Also, if the conveyance time of none of the predetermined number of consecutive sheets S exceeds the over stacking threshold value Tk, the identifying unit 173 may determine that the pickup roller 35 has not deteriorated. If the conveyance time of none of the consecutive sheets S whose number is larger than a predetermined number (e.g., 4000) exceeds the over stacking threshold value Tk, the identifying unit 173 may resume the determination of whether or not sheets S are over-stacked in the feed cassette 23. That is to say, the over stacking determination may be resumed if the conveyance time of a second predetermined number of consecutive sheets or more does not consecutively exceed the over stacking threshold value after it is determined that the pickup roller 35 has deteriorated. Thus, if it is presumed that the pickup roller 35 or the like has been replaced with a new one, the over stacking determination may be resumed.

Note that the execution conditions may be that the rollers have not been worn down, the sheet to be conveyed is the first sheet after the feed cassette 23 is pulled out and pushed in, the estimated/measured amount of stacked sheets S is close to the upper limit stacking amount, and the position of the rear end regulating plate 141 is correct.

If the determination unit 62 determines that the sheets S are over-stacked in the feed cassette 23, the output unit 67 may output over stacking information indicating that the sheets S are over-stacked. As a result, the operator and the maintenance company more easily recognizes over stacking. Note that if it is determined that the over stacking of sheets S in the feed cassette 23 has been resolved after the determination unit 62 determines that the sheets S are over-stacked in the feed cassette 23, the output unit 67 may stop the output of the over stacking information. Thus, the operator or the maintenance company can easily recognize that over stacking has been resolved. Also, if the cassette sensor 161 detects pulling out and pushing in of the feed cassette 23 after the determination unit 62 determines that sheets S are over-stacked in the feed cassette 23, the output unit 67 may stop the output of the over stacking information. This is because, if the feed cassette 23 is pulled out and pushed in, there is a possibility that the operator has removed over-stacked sheets S. If the conveyance time no longer exceeds the over stacking threshold value after the determination unit 62 determines that sheets are over-stacked, the output unit 67 may stop the output of the over stacking information.

The output unit 67 may display the over stacking information on the display device of the operation unit 59. The operator can thereby be visually notified of over stacking. Also, the output unit 67 may use the communication device 58 as a transmission unit for transmitting a message including the over stacking information. The over stacking message may be transmitted to an email address of the maintenance person (maintenance company) of the image forming apparatus 100. As a result, the maintenance company can notify a customer of a method for resolving over stacking as part of maintenance service.

Note that, according to the embodiments, the manual bypass tray 38 and the feed cassette 23 each function as a stacking unit in which sheets are stacked. The registration roller 17 and the like function as a conveyance unit for conveying sheets. The CPU 51 and the time-counting unit 61 each function as a time-counting unit for counting the conveyance time from when the conveyance unit starts to convey a sheet until the sheet arrives at a predetermined position on the conveyance path. The output unit 67, the display device of the operation unit 59, the communication device 58, and the like each function as an output unit for outputting information regarding over stacking. The CPU 51, the image formation control unit 63, and the like each function as a control unit for causing the output unit to output information regarding over stacking and causing sheet conveyance by the conveyance unit to be continued, if the conveyance time of a sheet exceeds a first threshold value (the first over stacking threshold value etc.). Furthermore, the CPU 51, the image formation control unit 63, and the like each function as a control unit for stopping image formation and discharging sheets, or stopping sheet conveyance, if the conveyance time of a sheet exceeds a second threshold value (the conveyance delay threshold value and the jam threshold value etc.) that is larger than the first threshold value. Accordingly, if over stacking is detected, a message informing of over stacking is output, but sheet conveyance and image formation are continued. Furthermore, if a conveyance delay or an erroneous print is detected, image formation is stopped or interrupted and all sheets existing on the conveyance path are discharged. If a jam is detected, sheet conveyance is stopped. The output of the message for giving over stacking notification may be continued unless the over stacking is resolved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-129204, filed Jun. 26, 2015, and Japanese Patent Application No. 2015-129205, filed Jun. 26, 2015, which are hereby incorporated by reference wherein in their entirety.

What is claimed is:

1. An image forming apparatus comprising:

a stacking unit in which a sheet is stacked;

a conveyance unit configured to convey the sheet stacked in the stacking unit;

a time-counting unit configured to count a conveyance time from when the conveyance unit starts to convey the sheet until the sheet arrives at a predetermined position on a conveyance path; and a determination unit configured to determine that over stacking in the stacking unit has occurred, upon the conveyance time of the sheet exceeding a first over stacking threshold value.

2. The image forming apparatus according to claim 1, further comprising:

a detection unit configured to detect that a conveyance delay or a jam has occurred on the sheet based on whether or not the conveyance time of the sheet exceeds a conveyance delay threshold value for stopping image formation and discharging the sheet or a jam threshold value for stopping image formation and conveyance of the sheet, wherein the first over stacking threshold value is smaller than the conveyance delay threshold value and the jam threshold value.

3. The image forming apparatus according to claim 2, further comprising a substituting unit configured to cause the determination unit to determine that over stacking in the stacking unit has occurred by substituting a value larger than the first over stacking threshold value for the conveyance time in a case that the sheet does not arrive at the predetermined position within a predetermined time.

4. The image forming apparatus according to claim 1, further comprising a detection unit configured to detect the sheet conveyed by the conveyance unit at the predetermined position, wherein the time-counting unit is further configured to count the conveyance time from when the conveyance unit starts to convey the sheet until the detection unit detects the sheet.

5. The image forming apparatus according to claim 1, wherein the determination unit executes the over stacking determination from when the conveyance unit starts a conveyance job for the sheet until a predetermined number of sheets are conveyed.

6. The image forming apparatus according to claim 1, further comprising:

a measuring unit configured to measure an environmental condition of an environment in which the image forming apparatus is set, wherein the determination unit executes the over stacking determination upon the environmental condition measured by the measuring unit being a predetermined environmental condition.

7. The image forming apparatus according to claim 6, wherein the predetermined environmental condition is that an absolute amount of vapor is smaller than or equal to a predetermined amount of vapor, an environmental temperature is lower than or equal to a predetermined temperature, and environmental humidity is lower than or equal to a predetermined humidity.

8. The image forming apparatus according to claim 1, wherein the stacking unit has a regulating member that regulates a height of a sheet bundle stacked in the stacking unit.

9. The image forming apparatus according to claim 1, further comprising:

an identifying unit configured to identify a type of the sheet, wherein the determination unit executes the over stacking determination upon the type of the sheet being identified as an envelope type sheet.

10. The image forming apparatus according to claim 9, wherein the identifying unit is configured to identify the type of the sheet as the envelope type sheet upon an envelope mode being designated from among a plurality of control modes provided in the image forming apparatus.

11. The image forming apparatus according to claim 9, further comprising:

a size designation unit configured to designate a size of the sheet, wherein the identifying unit is configured to identify the type of the sheet as the envelope type sheet based on the size of the sheet.

12. The image forming apparatus according to claim 1, wherein the time-counting unit is configured to re-count the conveyance time upon the conveyance unit being instructed to retry sheet conveyance, and upon the conveyance time of the sheet counted after the conveyance unit is instructed to retry sheet conveyance being smaller than a second over stacking threshold value that is smaller than the first over stacking threshold value, the determination unit determines that over stacking has occurred.

13. The image forming apparatus according to claim 1, further comprising:

an output unit configured to output over stacking information indicating that sheets are over-stacked, upon the determination unit determining that sheets are over-stacked in the stacking unit.

14. The image forming apparatus according to claim 13, further comprising a sheet-counting unit configured to count a number of consecutive sheets for which an event occurred after the determination unit determines that over stacking in the stacking unit has occurred, the event being an event where the conveyance time of a sheet conveyed from the stacking unit does not exceed the first over stacking threshold value, wherein the output unit is further configured to stop outputting the over stacking information in a case that the number of consecutive sheets counted by the sheet-counting unit reaches a stop threshold.

15. The image forming apparatus according to claim 13, further comprising a detection unit configured to detect whether or not a sheet is stacked in the stacking unit, wherein the output unit is further configured to stop outputting the over stacking information in a case that the detection unit detects that the sheet is not stacked in the stacking unit after the determination unit determines that over stacking in the stacking unit has occurred.

16. The image forming apparatus according to claim 13, wherein the output unit is further configured to stop outputting the over stacking information in a case that a type of the sheet stacked in the stacking unit changes after the determination unit determines that over stacking in the stacking unit has occurred.

17. The image forming apparatus according to claim 1, further comprising:

a housing; and a pull-out/push-in detection unit configured to detect pulling out and pushing in of the stacking unit from and to the housing wherein the determination unit includes an over stacking determination unit configured to determine whether or not sheets are over-stacked in the stacking unit based on whether or not the conveyance time of a first sheet that is conveyed after the pull-out/push-in detection unit detects pulling out and pushing in of the stacking unit exceeds the first over stacking threshold value.

18. The image forming apparatus according to claim 17, further comprising an output unit configured to output over stacking information indicating that sheets are over-stacked, upon the determination unit determining that sheets are over-stacked in the stacking unit.

19. The image forming apparatus according to claim 18, wherein the output unit is further configured to stop outputting the over stacking information in a case that the over stacking determination unit determines that sheets are not over-stacked in the stacking unit after the over stacking determination unit determines that sheets are over-stacked in the stacking unit.

20. The image forming apparatus according to claim 18, wherein the output unit is further configured to stop outputting the over stacking information in a case that the pull-out/push-in detection unit detects pulling out and pushing in of the stacking unit after the over stacking determination unit determines that sheets are over-stacked in the stacking unit.

21. The image forming apparatus according to claim 18, wherein the output unit is further configured to stop outputting the over stacking information in a case that the conveyance time is below the first over stacking threshold value after the over stacking determination unit determines that sheets are over-stacked in the stacking unit.

22. The image forming apparatus according to claim 17, further comprising:

a detection unit configured to detect that a conveyance delay has occurred on the sheet based on whether or not the conveyance time of the sheet exceeds a conveyance delay threshold value, and the first over stacking threshold value is the same as the conveyance delay threshold value.

23. The image forming apparatus according to claim 17, wherein a maximum stacking height or a maximum number of stacked sheets that ensures normal operation is defined in the image forming apparatus, the image forming apparatus further comprises a stacking degree determination unit configured to determine a degree of stacking of sheets in the stacking unit, and upon it being determined that the stacking degree determined by the stacking degree determination unit corresponds to a stacking volume within a predetermined range with respect to the stacking height or the number of stacked sheets, determination of whether or not over stacking has occurred is executed by the over stacking determination unit.

24. The image forming apparatus according to claim 23, wherein being within the predetermined range with respect to the stacking height or the number of stacked sheets refers to being within a variation range of accuracy at which the stacking degree determination unit can determine the stacking height or the number of stacked sheets.

25. The image forming apparatus according to claim 23, further comprising:

a plate member on which the sheet is stacked, the plate member being provided in the stacking unit;

a lift-up unit configured to lift up the plate member such that the sheet stacked on the plate member comes into contact with the conveyance unit; and a measuring unit configured to measure lift-up time that is required for lifting up the plate member, wherein the plate member lowers down to a lowermost portion upon the stacking unit being pulled out of the image forming apparatus, and upon the lift-up time being shorter than a lift-up threshold value, the stacking degree determination unit determines that the stacking degree corresponds to a stacking volume within the predetermined range with respect to the stacking height or the number of stacked sheets, and the over stacking determination unit determines whether or not sheets are over-stacked in the stacking unit.

26. The image forming apparatus according to claim 25, further comprising:

a surface detection unit configured to detect whether or not a surface of the sheet stacked on the plate member has been lifted up to a predetermined height by the lift-up unit, wherein upon the surface of the sheet stacked on the plate member having been lifted up to the predetermined height, the lift-up unit stops lifting up the plate member.

27. The image forming apparatus according to claim 17, further comprising:

a regulating unit configured to regulate a position of a rear end of a sheet in a conveyance direction of a sheet stacked in the stacking unit, the regulating unit being capable of moving in the conveyance direction; and a position detection unit configured to detect a position of the regulating unit, wherein if the position of the regulating unit detected by the position detection unit corresponds to a size of the sheet stacked in the stacking unit, the over stacking determination unit determines whether or not sheets are over-stacked in the stacking unit, and if the position of the regulating unit detected by the position detection unit does not correspond to the size of the sheet stacked in the stacking unit, the over stacking determination unit does not determine whether or not sheets are over-stacked in the stacking unit.

28. The image forming apparatus according to claim 27, further comprising:

a conversion unit configured to convert the position of the regulating unit detected by the position detection unit into the size of a sheet, wherein, when a size of a sheet conveyed by the conveyance unit agrees with the size of the sheet obtained based on the position of the regulating unit, the over stacking determination unit determines that the position of the regulating unit detected by the position detection unit corresponds to the size of the sheet stacked in the stacking unit, and when the size of the sheet conveyed by the conveyance unit does not agree with the size of the sheet obtained based on the position of the regulating unit, the over stacking determination unit determines that the position of the regulating unit detected by the position detection unit does not correspond to the size of the sheet stacked in the stacking unit.

29. The image forming apparatus according to claim 28, further comprising:

a measurement unit configured to measure the size of the sheet conveyed by the conveyance unit, wherein the over stacking determination unit compares the size of the sheet measured by the measurement unit with the size of the sheet obtained based on the position of the regulating unit.

30. The image forming apparatus according to claim 28, further comprising:

an input unit configured to input the size of the sheet conveyed by the conveyance unit, wherein the over stacking determination unit compares the size of the sheet input through the input unit with the size of the sheet obtained based on the position of the regulating unit.

31. The image forming apparatus according to claim 27, wherein the regulating unit is provided with a locking claw that regulates a height of a sheet bundle.

32. The image forming apparatus according to claim 17, further comprising:

a regulating unit configured to regulate a position of a rear end of a sheet in a conveyance direction of a sheet stacked in the stacking unit, the regulating unit being capable of moving in the conveyance direction;

a position detection unit configured to detect a position of the regulating unit; and a conversion unit configured to convert the position of the regulating unit detected by the position detection unit into a size of a sheet, wherein when a size of a sheet conveyed by the conveyance unit is larger than the size of the sheet obtained based on the position of the regulating unit by the conversion unit, the over stacking determination unit determines that sheets are over-stacked in the stacking unit even if the conveyance time does not exceed the first over stacking threshold value.

33. The image forming apparatus according to claim 32, further comprising:

a measurement unit configured to measure the size of the sheet conveyed by the conveyance unit, wherein when the size of the sheet measured by the measurement unit is larger than the size of the sheet obtained based on the position of the regulating unit by the conversion unit, the over stacking determination unit determines that sheets are over-stacked in the stacking unit even if the conveyance time does not exceed the first over stacking threshold value.

34. The image forming apparatus according to claim 17, further comprising:

an identifying unit configured to identify whether or not the conveyance unit has deteriorated, wherein if the conveyance unit has not deteriorated, the over stacking determination unit determines whether or not sheets are over-stacked in the stacking unit, and if the conveyance unit has deteriorated, the over stacking determination unit does not determine whether or not sheets are over-stacked in the stacking unit.

35. The image forming apparatus according to claim 34, wherein if a phenomenon in which the conveyance time exceeds the first over stacking threshold value at least once in a first predetermined number of sheets consecutively occurs a predetermined number of times, the determination unit determines that the conveyance unit has deteriorated.

36. The image forming apparatus according to claim 34, wherein after the identifying unit determines that the conveyance unit has deteriorated, if the conveyance time of a second predetermined number of sheets or more does not consecutively exceed the first over stacking threshold value, the over stacking determination unit resumes the determination of whether or not sheets are over-stacked in the stacking unit.

37. The image forming apparatus according to claim 17, wherein the over stacking determination unit is further configured to determine that sheets are over-stacked in the stacking unit in a case that the sheet does not arrive at the predetermined position during a time period from when the conveyance unit starts to convey the sheet until the time-counting unit finishes counting of a predetermined time.

38. The image forming apparatus according to claim 17, further comprising a substituting unit configured to cause the determination unit to determine that over stacking in the stacking unit has occurred by substituting a value larger than the first over stacking threshold value for the conveyance time in a case that the sheet does not arrive at the predetermined position during a time period from the conveyance unit starts to convey of the sheet until the time-counting unit finishes counting of a predetermined time.

39. An image forming apparatus comprising:

a stacking unit in which a sheet is stacked;

a conveyance unit for conveying the sheet stacked in the stacking unit;

a time-counting unit configured to count a conveyance time from when the conveyance unit starts to convey the sheet until the sheet arrives at a predetermined position on a conveyance path;

an output unit configured to output information regarding over stacking in the stacking unit; and a control unit configured to cause the output unit to output the information regarding over stacking in the stacking unit and causes the conveyance unit to continue conveyance of the sheet in a case that the conveyance time of the sheet exceeds the first threshold time, and stops image formation and discharge the sheet or stops conveyance of the sheet in a case that the conveyance time of the sheet exceeds a second threshold time that is longer than the first threshold time.

40. The image forming apparatus according to claim 39, further comprising a detection unit configured to detect the sheet conveyed by the conveyance unit at the predetermined position, wherein the time-counting unit is further configured to count the conveyance time from when the conveyance unit starts to convey the sheet until the detection unit detects the sheet.

* * * * *